US010413054B2

(12) United States Patent
Jiang

(10) Patent No.: US 10,413,054 B2
(45) Date of Patent: Sep. 17, 2019

(54) TABLE, BED, AND CHAIR AND RECEIVING DEVICE THEREOF

(71) Applicant: Yixiang Blow Molding Furniture (Ningbo) Co., Ltd., Yuyao, Zhejiang (CN)

(72) Inventor: Jinglei Jiang, Yuyao (CN)

(73) Assignee: Yixiang Blow Molding Furniture (Ningbo) Co., Ltd., Yuyao, Zhejiang (CN)

( * ) Notice: Subject to any disclaimer, the term of this patent is extended or adjusted under 35 U.S.C. 154(b) by 0 days.

(21) Appl. No.: 15/575,391

(22) PCT Filed: May 17, 2016

(86) PCT No.: PCT/CN2016/082335
§ 371 (c)(1),
(2) Date: Nov. 20, 2017

(87) PCT Pub. No.: WO2016/184379
PCT Pub. Date: Nov. 24, 2016

(65) Prior Publication Data

US 2018/0153302 A1 Jun. 7, 2018

(30) Foreign Application Priority Data

May 18, 2015 (CN) ..... 2015 1 02538494

(51) Int. Cl.

| | |
|---|---|
| ***A47B 13/08*** | (2006.01) |
| ***A47C 19/22*** | (2006.01) |
| ***A47B 3/083*** | (2006.01) |
| ***A47B 95/00*** | (2006.01) |
| ***A47C 17/86*** | (2006.01) |
| ***A47B 3/087*** | (2006.01) |
| ***A47B 97/00*** | (2006.01) |
| ***A47C 5/12*** | (2006.01) |
| ***A47C 9/10*** | (2006.01) |

(Continued)

(52) U.S. Cl.
CPC ..... *A47B 13/08* (2013.01); *A47B 3/083* (2013.01); *A47B 3/087* (2013.01); *A47B 95/00* (2013.01); *A47B 97/00* (2013.01); *A47C 5/12* (2013.01); *A47C 7/624* (2018.08); *A47C 9/10* (2013.01); *A47C 17/70* (2013.01); *A47C 17/86* (2013.01); *A47C 19/22* (2013.01)

(58) Field of Classification Search
CPC ..... A47B 13/08; A47B 13/16; A47B 2200/03
USPC ..... 108/26, 25, 24, 36, 38, 129
See application file for complete search history.

(56) References Cited

U.S. PATENT DOCUMENTS 486,602 A * 11/1892 Morton
581,127 A * 4/1897 McCorkle ..... A47B 13/16 108/26

(Continued)

*Primary Examiner* — Jose V Chen
(74) *Attorney, Agent, or Firm* — Raymond Y. Chan; David and Raymond Patent Firm

(57) ABSTRACT

The present invention provides a table, comprising a table top made of plastic material, at least one receiving device, and a supporter. The table top has a flat table surface and a bottom surface. The receiving device has a receiving cavity. The supporter is for supporting the table top and keeping the table surface of the table top in a horizontal condition. The supporter is arranged at the bottom surface of the table top. The receiving device is arranged on the supporter.

10 Claims, 54 Drawing Sheets

(51) Int. Cl.
*A47C 17/70* (2006.01)
*A47C 7/62* (2006.01)

(56) References Cited

U.S. PATENT DOCUMENTS 581,681 A * 4/1897 Shauer ..... A47B 17/036 108/26
849,974 A * 4/1907 Cantrell ..... A47B 13/16 108/115
1,426,160 A * 8/1922 Driver ..... A47B 3/02 108/118
1,590,228 A * 6/1926 Caldwell et al. ..... A47B 13/16 108/26
2,140,685 A * 12/1938 Baxter ..... A47K 3/064 108/119
2,197,992 A * 4/1940 Baxter ..... A47D 5/006 108/11
2,241,309 A * 5/1941 Kovalik ..... D06F 95/004 108/25
2,281,309 A * 4/1942 Kennedy ..... A47K 3/064 108/120
2,557,801 A * 6/1951 Shapiro ..... A47J 47/16 108/26
3,386,444 A * 6/1968 Brenner ..... A61G 13/102 108/25
3,557,856 A * 1/1971 Berman ..... A47B 25/00 108/26
4,955,666 A * 9/1990 Baker ..... A61G 13/102 108/26
5,809,900 A * 9/1998 Alexander ..... A47B 21/06 108/26
6,662,732 B2 * 12/2003 Birsel ..... A47B 21/00 108/25
8,347,790 B1 * 1/2013 Maiers ..... A63F 1/067 108/25
8,857,346 B2 * 10/2014 Khanjian ..... A47B 3/087 108/26
2002/0092445 A1 * 7/2002 Glover ..... A47B 3/087 108/129
2002/0117092 A1 * 8/2002 Zeiders ..... A47B 23/041 108/43
2002/0129746 A1 * 9/2002 Donnelly ..... A47B 13/16 108/25
2005/0005826 A1 * 1/2005 Strong ..... A47B 3/087 108/132
2005/0241551 A1 * 11/2005 Neunzert ..... A47B 3/00 108/132
2006/0213401 A1 * 9/2006 Huang ..... A47B 37/04 108/50.12
2006/0225624 A1 * 10/2006 Grace ..... A47B 3/002 108/26
2007/0056482 A1 * 3/2007 Robinson ..... A47B 3/06 108/25
2008/0022904 A1 * 1/2008 Matheus ..... A47B 3/002 108/38
2015/0020716 A1 * 1/2015 Tsai ..... A47B 3/087 108/36

* cited by examiner

TABLE, BED, AND CHAIR AND RECEIVING DEVICE THEREOF

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a furniture, in particular, to a furniture having a receiving device to fully use the space to place objects. The present invention relates to a table for placing objects, wherein the table has a receiving device arranged on the table top, such that there is more space to place objects. The present invention also relates to a bed for rest, wherein the bed has a receiving device arranged on the bed panel of the bed, so as to provide more usable space. The present invention also relates to a chair, wherein the chair has a receiving device arranged in the lower space of the seat base of the chair, such that the lower space of the seat base of the chair can also be utilized.

Description of Related Arts

Common tables for placing objects, such as dining tables, office desks, usually have a table top and a supporter. The supporter is mostly used for keeping the table top in a horizontal position, such that objects can be stably placed thereon. It is understandable that when the table is utilized for placing objects, the table will certainly occupy an indoor space. Hence, a table that only has table top and supporter causes wasting of indoor space. That is, the space below the table top of the table is difficult to be used to place objects. In order to save and well use the indoor space, some tables further comprise receiving devices, such as drawers, arranged in the lower space of the table top, to put stuff or objects and to use the lower space of the table top of the table. However, conventional receiving devices for table have several drawbacks. First of all, a conventional receiving device for table, such as a drawer, is usually directly or indirectly arranged on the table top of the table, which makes the table top or the whole table more cumbersome. In order to extend the life of the table, conventional receiving device for table are mostly solid and durable. Nevertheless, it makes conventional receiving device more unwieldy or makes the entire table more unwieldy. Next, a conventional receiving device for table is usually fixedly arranged at a predetermined position. Therefore, after the receiving device or the receiving portion of the receiving device is detached, it will leave a hole thereat, which will affect the overall aesthetic of the table. In addition, because the receiving portion of the receiving device has a permanent shape, it is difficult to carry after removed. Again, a conventional receiving device for table is difficult to be arranged on a table top that is made of plastic material. As a result, a conventional receiving device is mostly required to be fixed on a table top. Hence, the table top for arranging the receiving device needs good processibility. However, after the table top made of plastic material was primarily formed, such as being blow molded or injection molded, its secondary processibility is poor and is hard to be processed to form screw hole and other connection structures to be kept the receiving device in a proper position. Also, because conventional receiving devices for table are directly or indirectly fixedly arranged on the table tops of the tables, conventional receiving devices for table generally relate to the supports of the table tops of the tables. In other words, when a conventional receiving device for table or its receiving portion is detached from the table, the support of the table top of the table or the use of the table will be affected. Lastly, conventional receiving device for table mostly have unchangeable shapes and cannot be used for foldable tables. Conventional receiving devices for table are mostly stout and heavy and having regular appearance. Thus, when combining the use of conventional receiving devices for table and foldable tables, it will affect the folding of foldable tables. As a result, conventional receiving devices for table are mostly difficult to be used in foldable tables.

Correspondingly, a common bed usually has a bed panel and a support, such as a supporter. The support is mostly to keep the bed panel in a horizontal position, such that a person can stably lie down thereon to rest. It is understandable that when a bed is utilized for resting, the bed will certainly occupy an indoor space. Therefore, a bed that only has bed panel and supporter can cause wasting of indoor space. That is, the space below the bed panel of the bed is hard to be used. In order to save and well use the indoor space, some beds further comprise receiving devices, such as drawers, arranged in the lower space of the bed panel, to put stuff or objects and to use the lower space of the bed panel of the bed. Nevertheless, a conventional receiving device for bed has several drawbacks. First of all, a conventional receiving device for bed, such as a drawer, is usually directly or indirectly arranged on the bed panel of the bed, which makes the bed panel or the whole bed more cumbersome. In order to extend the life of the bed, conventional receiving devices for bed are mostly solid and durable. Nevertheless, it makes conventional receiving devices more unwieldy or makes the entire bed more unwieldy. Next, a conventional receiving device for bed is usually fixedly arranged and formed to be part of the overall structure of the bed. Therefore, after the receiving device or the receiving portion of the receiving device is detached, it will leave a hole thereat, which will affect the overall aesthetic of the bed. In addition, because the receiving portion of the receiving device has a permanent shape, it is difficult to carry after removed. Again, a conventional receiving device for bed is difficult to be arranged on a bed panel that is made of plastic material. As a result, a conventional receiving device for bed is mostly required to be fixed on a bed panel. Hence, the bed panel for arranging the receiving device needs good processibility. However, after the bed panel made of plastic material was primarily formed, such as being blow molded or injection molded, its secondary processibility is poor and is hard to be processed to form screw hole and other connection structures to be kept the receiving device in a proper position. Also, because conventional receiving devices for bed are directly or indirectly fixedly arranged on the bed panels of the beds, conventional receiving devices for bed generally relate to the supports of the bed panels of the beds. In other words, when a conventional receiving device for bed or its receiving portion is detached from the bed, the support of the bed panel of the bed or the use of the bed will be affected. Lastly, conventional receiving devices for bed mostly have unchangeable shapes and cannot be used for foldable beds. Conventional receiving devices for bed are mostly stout and heavy and having regular appearance. Thus, when combining the use of conventional receiving devices for bed and foldable beds, it will affect the folding of foldable beds. As a result, conventional receiving devices for bed are mostly difficult to be used in foldable beds.

Correspondingly, a common chair usually has a seat base, a support for keeping the seat base in a proper position, such as a supporter to keep the seat base in a horizontal position, such that a person can stably sit thereon to rest, and a seat back. It is understandable that when the chair is utilized for resting, the chair will certainly occupy an indoor space. Therefore, a chair that only has seat base, supporter, and seat back can cause wasting of indoor space. That is, the space below the seat base of the chair is hard to be used. In order to save and well use the indoor space, some chairs further comprise receiving devices, such as drawers, arranged in the lower space of the seat base, to put stuff or objects and to use the lower space of the seat base of the chair. However, conventional receiving devices for chair have several drawbacks. First of all, a conventional receiving device for chair, such as a drawer, is usually directly or indirectly arranged on the seat base of the chair, which makes the seat base or the whole chair more cumbersome. In order to extend the life of the chair, conventional receiving devices for chair are mostly solid and durable. Nevertheless, it makes conventional receiving device more unwieldy or makes the entire chair more unwieldy. Next, a conventional receiving device for chair is usually fixedly arranged and formed to be part of the overall structure of the chair. Therefore, after the receiving device or the receiving portion of the receiving device is detached, it will leave a hole thereat, which will affect the overall aesthetic of the chair. In addition, because the receiving portion of the receiving device has a permanent shape, it is difficult to carry after removed. Again, a conventional receiving device for chair is difficult to be arranged on a seat base that is made of plastic material. As a result, a conventional receiving device for chair is mostly required to be fixed on a seat base. Hence, the seat base for arranging the receiving device needs good processibility. However, after the seat base made of plastic material was primarily formed, such as being blow molded or injection molded, its secondary processibility is poor and is hard to be processed to form screw hole and other connection structures to be kept the receiving device in a proper position. Also, because conventional receiving device for chair are directly or indirectly fixedly arranged on the seat base of the chair, conventional receiving device for chair generally relate to the supports of the seat base of the chair. In other words, when a conventional receiving device for chair or its receiving portion is detached from the chair, the support of the seat base of the chair or the use of the chair will be affected. As a result, conventional receiving devices for chair are mostly difficult to be used in foldable chairs.

SUMMARY OF THE PRESENT INVENTION

A main object of the present invention is to provide a table, wherein the table top of the table is made of plastic material and the table comprises a receiving device arranged in the lower space of the table top of the table, such that the upper space and the lower space of the table top of the table can both be utilized.

Another object of the present invention is to provide a table, wherein the receiving device of the table has an independent structure, so that when the receiving device is detached from the table top of the table, the overall aesthetic of the table will not be affected.

Another object of the present invention is to provide a table, wherein the second connector of the connecting element of the receiving device of table is hiddenly arranged in the lower space of the table top of the table, so that when the receiving body of the receiving device is detached from the table top of the table, the overall aesthetic of the table will not be affected.

Another object of the present invention is to provide a table, wherein the receiving device of the table is arranged to be unrelated to the support to the table top of the table, so that when the receiving device is detached from the table top of the table, the use of the table will not be affected.

Another object of the present invention is to provide a table, wherein after the table top of the table is processed and formed, it forms a mounting portion for a receiving device of the table to be arranged on the table top of the table.

Another object of the present invention is to provide a table, wherein the receiving device of the table is detachably arranged on the table top of the table. Therefore, the receiving device can be detached from the table in order not to influence the folding and unfolding of the table.

Another object of the present invention is to provide a table, wherein the receiving device of the table is foldably arranged on the table top of the table, so as not to influence the folding and unfolding of the table.

Another object of the present invention is to provide a table, wherein the table top of the table has a foldable structure. When the table top of the table is in an unfolded state, the receiving body of the receiving device can be opened and arranged in the lower space of the table top of the table. When the table top of the table is in a folded state, the receiving body of the receiving device can be folded. Therefore, the receiving device of the table will not influence the folding and unfolding of the table.

Another object of the present invention is to provide a table, wherein the receiving body of the receiving device of the table is made of soft material, so as to allow the receiving body to be opened, to form a receiving cavity, and to be folded, wherein the connecting element of the receiving device is arranged on the receiving body and the table top of the table. Besides, because the receiving body of the receiving device is made of soft material, the receiving body of the receiving device can be folded into various shapes, so as to be easy to be placed in the lower space of the table top of the table and to fully utilize that space.

Another object of the present invention is to provide a table, wherein the receiving body of the receiving device of the table can be detachably arranged through zipper zipping, roping, buckling, hook and loop fastening, etc.

Another object of the present invention is to provide a table, wherein the table top of the table comprises two pivoting portions. The two pivoting portions of the table top are arranged to be able to pivot with respect to each other, in order to form a flat table surface in the unfolded state.

Another object of the present invention is to provide a table, wherein the table does not require precision components and complex structure. Rather, its fabrication technology is simple, its costs is low, and its operation is easy.

Another object of the present invention is to provide a receiving device for table, wherein the receiving device forms an independent structure, so that when the receiving device was detached from the table top, the overall aesthetic of the table will not be affected.

Another object of the present invention is to provide a receiving device for table, wherein the receiving body of the receiving device can be detachably arranged on the table top of the table through zipper zipping, roping, buckling, hook and loop fastening, etc.

Another object of the present invention is to provide a table, wherein the receiving device of the table is arranged on the supporter of the table. Hence, the table of the present invention can be a regular table, or a foldable table.

Another object of the present invention is to provide a table, wherein the receiving device of the table has an independent structure, so that when the receiving device is detached from the supporter of the table, the overall aesthetic of the table will not be affected.

Another object of the present invention is to provide a table, wherein the receiving device of the table is arranged to be unrelated to the support to the table top of the table, so that when the receiving device is detached from the supporter of the table, the use of the table will not be affected.

Another object of the present invention is to provide a table, wherein the receiving device of the table is detachably arranged on the supporter of the table. Therefore, the receiving device can be detached from the table in order not to influence the folding and unfolding of the table.

Another object of the present invention is to provide a table, wherein the receiving device of the table is foldably arranged on the supporter of the table, so as not to influence the folding and unfolding of the table.

Another object of the present invention is to provide a table, wherein the receiving body of the receiving device of the table is made of soft material, so as to allow the receiving body to be opened, to form a receiving cavity, and to be folded, wherein the connecting element of the receiving device is respectively arranged on the receiving body and the supporter of the table.

Another object of the present invention is to provide a table, wherein the receiving device of the table is arranged between the two supporting legs of the supporter.

Another object of the present invention is to provide a receiving device for table, wherein the receiving body of the receiving device can be detachably arranged on the supporter of the table through zipper zipping, roping, buckling, hook and loop fastening, etc.

Another object of the present invention is to provide a table, wherein the table comprises a receiving device arranged in the lower space of the table top thereof, wherein the receiving portion of the receiving device is made of soft material, so as to allow the user to arrange the receiving portion into a proper shape and to form a receiving cavity without using any external tool.

Another object of the present invention is to provide a table, wherein the table top of the table is made of plastic material and the receiving device of the table is fixed on the supporting shelf of the table, such that the lower space of the plastic made table top of the table can also be utilized to place objects. Preferably, when objects are placed in the receiving device of the table, the user sit aside by the table will not be influenced.

Another object of the present invention is to provide a table, wherein the connecting element of the receiving device of table is hiddenly arranged in the lower space of the table top of the table, so that when the receiving body or the receiving portion of the receiving device is detached from the table top of the table, the overall aesthetic of the table will not be affected.

Another object of the present invention is to provide a table, wherein the receiving device of the table is arranged to be unrelated to the support to the table top of the table, so that when the receiving device is detached from the table top of the table, the use of the table will not be affected.

Another object of the present invention is to provide a table, wherein the receiving device of the table is arranged on the supporter of the table, so as to overcome the drawback that the table top made of plastic material is not suitable for mounting object.

Another object of the present invention is to provide a table, wherein the receiving portion of the receiving device of the table is made of soft material. Hence, the receiving device of the table is foldably arranged on the bottom of the table top of the table, so as not to influence the folding and unfolding of the table.

Another object of the present invention is to provide a table, wherein the table top of the table has a foldable structure. When the table top of the table is in an unfolded state, the receiving body or receiving portion of the receiving device can be opened and arranged in the lower space of the table top of the table. When the table top of the table is in a folded state, the receiving body or receiving portion of the receiving device can be folded. Therefore, the receiving device of the table will not influence the folding and unfolding of the table.

Another object of the present invention is to provide a table, wherein the receiving body or receiving portion of the receiving device of the table is made of soft material, so as to allow the receiving body or receiving portion to be opened, to form a receiving cavity, and to be folded, wherein the connecting element of the receiving device is arranged on the receiving body or receiving portion and the table top of the table. Besides, because the receiving body or receiving portion of the receiving device is made of soft material, the receiving body or receiving portion of the receiving device can be folded into various shapes, so as to be easy to be placed in the lower space of the table top of the table and to fully utilize that space.

Another object of the present invention is to provide a table, wherein the receiving body or receiving portion of the receiving device of the table can be detachably arranged through zipper zipping, roping, buckling, hook and loop fastening, etc.

Another object of the present invention is to provide a table, wherein the table top of the table comprises two panel units. The two panel units of the table top are arranged to be able to pivot with respect to each other, in order to form a flat table surface in the unfolded state.

Another object of the present invention is to provide a bed, wherein the bed panel of the bed is made of plastic material and the bed comprises a receiving device arranged in the lower space of the bed panel of the bed, such that the upper space and the lower space of the bed panel of the bed can both be utilized.

Another object of the present invention is to provide a bed, wherein the receiving device of the bed has an independent structure, so that when the receiving device is detached from the bed panel of the bed, the overall aesthetic of the bed will not be affected.

Another object of the present invention is to provide a bed, wherein the second connector of the connecting element of the receiving device of the bed is hiddenly arranged in the lower space of the bed panel of the bed, so that when the receiving body of the receiving device is detached from the bed panel of the bed, the overall aesthetic of the bed will not be affected.

Another object of the present invention is to provide a bed, wherein the receiving device of the bed is arranged to be unrelated to the support to the bed panel of the bed, so that when the receiving device is detached from the bed panel of the bed, the use of the bed will not be affected.

Another object of the present invention is to provide a bed, wherein after the bed panel of the bed is processed and formed, it forms a mounting portion for a receiving device of the bed to be arranged on the bed panel of the bed.

Another object of the present invention is to provide a bed, wherein the receiving device of the bed is detachably arranged on the bed panel of the bed. Therefore, the receiving device can be detached from the bed in order not to influence the folding and unfolding of the bed.

Another object of the present invention is to provide a bed, wherein the receiving device of the bed is foldably arranged on the bed panel of the bed, so as not to influence the folding and unfolding of the bed.

Another object of the present invention is to provide a bed, wherein the bed panel of the bed has a foldable structure. When the bed panel of the bed is in an unfolded state, the receiving body of the receiving device can be opened and arranged in the lower space of the bed panel of the bed. When the bed panel of the bed is in a folded state, the receiving body of the receiving device can be folded. Therefore, the receiving device of the bed will not influence the folding and unfolding of the bed.

Another object of the present invention is to provide a bed, wherein the receiving body of the receiving device of the bed is made of soft material, so as to allow the receiving body to be opened, to form a receiving cavity, and to be folded, wherein the connecting element of the receiving device is arranged on the receiving body and the bed panel of the bed. Besides, because the receiving body of the receiving device is made of soft material, the receiving body of the receiving device can be folded into various shapes, so as to be easy to be placed in the lower space of the bed panel of the bed and to fully utilize that space.

Another object of the present invention is to provide a bed, wherein the receiving body of the receiving device of the bed can be detachably arranged through zipper zipping, roping, buckling, hook and loop fastening, etc.

Another object of the present invention is to provide a bed, wherein the bed panel of the bed comprises two pivoting portions. The two pivoting portions of the bed panel are arranged to be able to pivot with respect to each other, in order to form a flat bed surface in the unfolded state.

Another object of the present invention is to provide a bed, wherein the bed does not require precision components and complex structure. Rather, its fabrication technology is simple, its costs is low, and its operation is easy.

Another object of the present invention is to provide a receiving device for bed, wherein the receiving device forms an independent structure, so that when the receiving device was detached from the bed panel, the overall aesthetic of the bed will not be affected.

Another object of the present invention is to provide a receiving device for bed, wherein the receiving body of the receiving device can be detachably arranged on the bed panel of the bed through zipper zipping, roping, buckling, hook and loop fastening, etc.

Another object of the present invention is to provide a bed, wherein the receiving device of the bed has an independent structure, so that when the receiving device is detached from the supporter of the bed, the overall aesthetic of the bed will not be affected.

Another object of the present invention is to provide a bed, wherein the receiving device of the bed is arranged to be unrelated to the support to the bed panel of the bed, so that when the receiving device is detached from the supporter of the bed, the use of the bed will not be affected.

Another object of the present invention is to provide a bed, wherein the receiving device of the bed is arranged on the supporter of the bed. Hence, the bed of the present invention can be a regular bed, or a foldable bed.

Another object of the present invention is to provide a bed, wherein the receiving device of the bed is detachably arranged on the supporter of the bed. Therefore, the receiving device can be detached from the bed in order not to influence the folding and unfolding of the bed.

Another object of the present invention is to provide a bed, wherein the receiving body of the receiving device of the bed is made of soft material, so as to allow the receiving body to be opened, to form a receiving cavity, and to be folded, wherein the connecting element of the receiving device is respectively arranged on the receiving body and the supporter of the bed. Besides, because the receiving body of the receiving device is made of soft material, the receiving body of the receiving device can be folded into various shapes, so as to be easy to be placed in the lower space of the bed panel of the bed and to fully utilize that space.

Another object of the present invention is to provide a bed, wherein the receiving device of the bed is arranged between the two supporting legs of the supporter.

Another object of the present invention is to provide a receiving device for bed, wherein the receiving device forms an independent structure, so that when the receiving device was detached from the supporter, the overall aesthetic of the bed will not be affected.

Another object of the present invention is to provide a receiving device for bed, wherein the receiving body of the receiving device can be detachably arranged on the supporter of the bed through zipper zipping, roping, buckling, hook and loop fastening, etc.

Another object of the present invention is to provide a chair, wherein the seat base of the chair is made of plastic material and the chair comprises a receiving device arranged in the lower space of the seat base of the chair, such that the upper space and the lower space of the seat base of the chair can both be utilized.

Another object of the present invention is to provide a chair, wherein the receiving device of the chair has an independent structure, so that when the receiving device is detached from the supporter of the chair, the overall aesthetic of the chair will not be affected.

Another object of the present invention is to provide a chair, wherein the receiving device of the chair is arranged to be unrelated to the support to the seat base of the chair, so that when the receiving device is detached from the supporter of the chair, the use of the chair will not be affected.

Another object of the present invention is to provide a chair, wherein the receiving device of the chair is arranged on the supporter of the chair. Hence, the chair of the present invention can be a regular chair, or a foldable chair.

Another object of the present invention is to provide a chair, wherein the receiving device of the chair is detachably arranged on the supporter of the chair. Therefore, the receiving device can be detached from the chair in order not to influence the folding and unfolding of the chair.

Another object of the present invention is to provide a chair, wherein the receiving device of the chair is foldably arranged on the supporter of the chair, so as not to influence the folding and unfolding of the chair.

Another object of the present invention is to provide a chair, wherein the chair pedestal of the chair has a foldable structure. When the chair pedestal of the chair is in an unfolded state, the receiving body of the receiving device can be opened and arranged in the lower space of the chair pedestal of the chair. When the seat base of the chair is in a folded state, the receiving body of the receiving device can be folded. Therefore, the receiving device of the chair will not influence the folding and unfolding of the chair.

Another object of the present invention is to provide a chair, wherein the receiving body of the receiving device of the chair is made of soft material, so as to allow the receiving body to be opened, to form a receiving cavity, and to be folded, wherein the connecting element of the receiving device is respectively arranged on the receiving body and the supporter of the chair. Besides, because the receiving body of the receiving device is made of soft material, the receiving body of the receiving device can be folded into various shapes, so as to be easy to be placed in the lower space of the seat base of the chair and to fully utilize that space.

Another object of the present invention is to provide a chair, wherein the receiving device of the chair is arranged between the two supporting legs of the supporter.

Another object of the present invention is to provide a chair, wherein the receiving body of the receiving device of the chair can be detachably arranged through zipper zipping, roping, buckling, hook and loop fastening, etc.

Another object of the present invention is to provide a chair, wherein the seat base of the chair comprises two pivoting portions. The two pivoting portions of the seat base are arranged to be able to pivot with respect to each other, in order to form a flat seat surface in the unfolded state.

Another object of the present invention is to provide a chair, wherein the chair does not require precision components and complex structure. Rather, its fabrication technology is simple, its costs is low, and its operation is easy.

Another object of the present invention is to provide a receiving device for chair, wherein the receiving device forms an independent structure, so that when the receiving device was detached from the supporter, the overall aesthetic of the chair will not be affected.

Another object of the present invention is to provide a receiving device for chair, wherein the receiving body of the receiving device can be detachably arranged on the supporter of the chair through zipper zipping, roping, buckling, hook and loop fastening, etc.

Other objects and features of the present invention can be well reflected through the following detail description and can be implemented through the approaches and devices particularly pointed out in the appended claims.

According to the present invention, a table of the present invention that can implement the above objects and other objects and advantages comprises:

a table top made of plastic material, wherein the table top has a flat table surface and a bottom surface;

at least one receiving device, having a receiving cavity; and a supporter adapted for supporting the table top and remaining the table surface of the table top in a horizontal condition, wherein the supporter comprises a supporting frame and at least one supporting leg, wherein the supporting frame of the supporter is arranged on the bottom surface of the table top, wherein every supporting leg of the supporter is pivotally arranged on the supporting frame of the supporter, wherein the receiving device is arranged on the supporter.

The present invention further provides a table, comprising:

a table top made of plastic material, wherein the table top has a flat table surface and a bottom surface;

a mounting portion made of plastic material, wherein the mounting portion and the table top are integrated with each other;

at least one receiving device, arranged at the mounting portion, wherein the receiving device has a receiving cavity; and a supporter adapted for supporting the table top and keep the table surface of the table top in a horizontal condition, wherein the supporter is arranged at the bottom surface of the table top.

The present invention further provides a table, comprising:

two panel units connected with each other pivotally;

two leg units arranged respectively on the panel units; and a receiving device respectively arranged on the panel units, wherein each of the panel units comprises a panel body and a supporter, wherein each of leg units comprises two supporting legs and each of the supporting legs are arranged on the supporter of the panel unit, wherein the panel body has a top surface and a bottom surface, wherein the supporter is arranged on the bottom surface of the panel body, wherein when the two panel units of the table is unfolded, the top surfaces of the panel bodies of the two panel units form a table surface for the table to be placed objects thereon.

The present invention further provides a bed, comprising:

a bed panel made of plastic material, wherein the bed panel has a flat bed surface and a bottom surface;

a mounting portion made of plastic material, wherein the mounting portion and the bed panel are integrated with each other;

at least one receiving device arranged at the mounting portion, wherein the receiving device has a receiving cavity; and a supporter adapted for supporting the bed panel and keep the bed surface of the bed panel in a horizontal condition, wherein the supporter is arranged at the bottom surface of the bed panel.

The present invention further provides a bed, comprising:

a bed panel made of plastic material, wherein the bed panel has a flat bed surface and a bottom surface;

at least one receiving device having a receiving cavity; and a supporter adapted for supporting the bed panel and keep the bed surface of the bed panel in a horizontal condition, wherein the supporter comprises a supporting frame and at least one supporting leg, wherein the supporting frame of the supporter is arranged on the bottom surface of the bed panel, wherein every of the supporting legs of the supporter is pivotally arranged on the supporting frame of the supporter, wherein the receiving device is arranged on the supporter.

The present invention further provides a chair, comprising:

a seat base, comprising a chair plate made of plastic material and a plurality of supporting legs respectively extended downwardly from the chair plate, wherein the supporting legs are arranged to support the chair plate in a horizontal position;

a seat back upwardly arranged on the seat base;

at least one receiving device, wherein the receiving device has a receiving cavity, wherein the receiving device is arranged between two the supporting leg of the seat base, so as to allow the receiving device to be arranged in the lower space of the chair plate of the seat base.

The present invention further provides a chair, comprising:

a seat base, comprising a chair plate made of plastic material and a plurality of supporting legs respectively extended downwardly from the chair plate, wherein the supporting legs are arranged to support the chair plate in a horizontal position;

a seat back upwardly arranged on the seat base;

at least one receiving device, wherein the receiving device has a receiving cavity, wherein the receiving device is arranged on chair plate of the seat base, so as to allow the receiving device to be arranged in the lower space of the chair plate of the seat base.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1A:
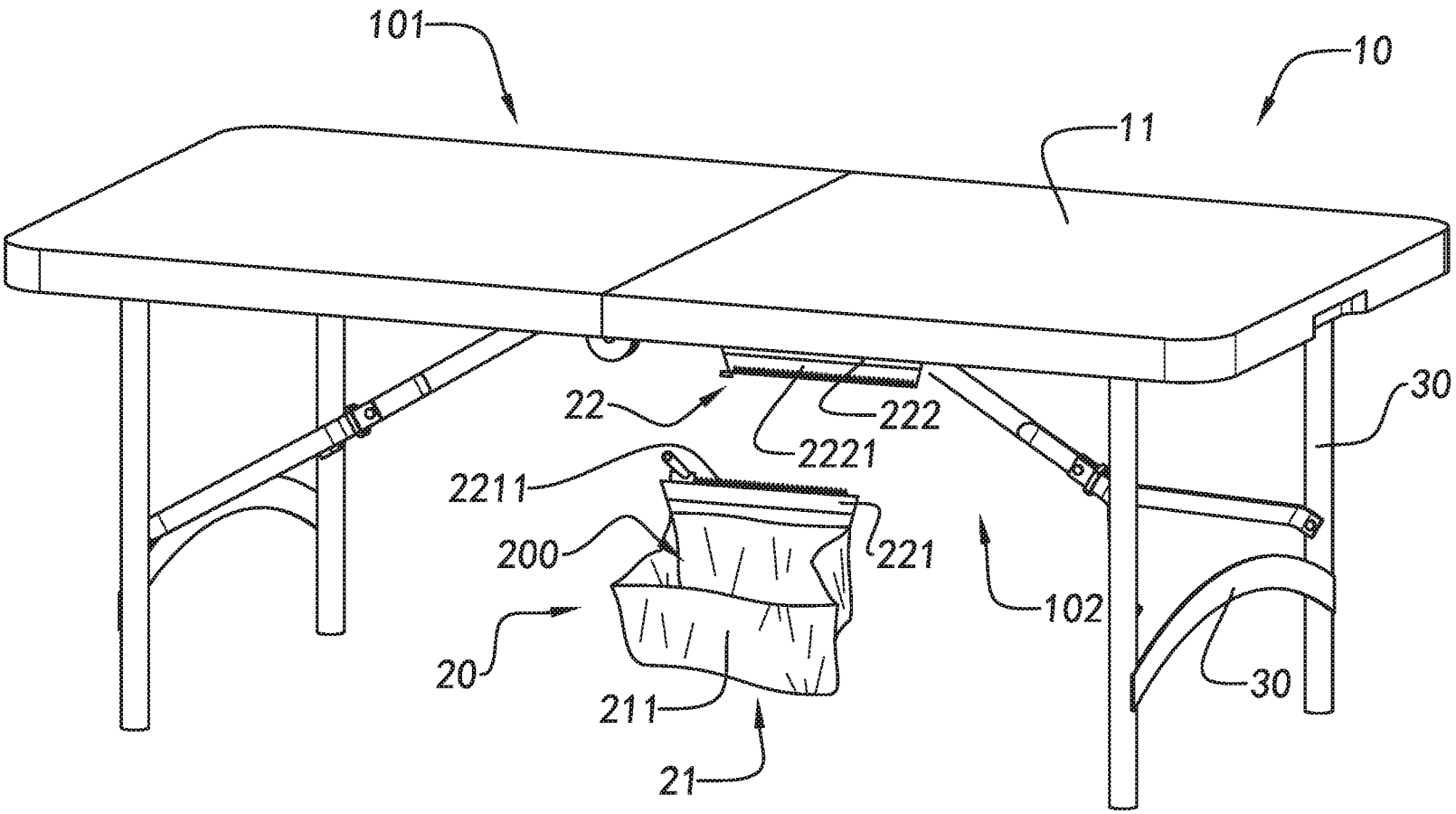
FIG. 1A is a perspective view of the table according to a first preferred embodiment of the present invention, illustrating the receiving device of the table being arranged on the table top of the table.

The following disclosure is to help person skilled in the art to be able to make and use the present invention. The first preferred embodiment provided in the following description is only an example and modification that is obvious to person skilled in the art and shall not be a limit of the scope of the present invention. General principles defined in the following description shall not be applied on other embodiments, alternatives, modifications, equivalents, and applications that depart from the spirit and scope of the present invention.

Referring to FIGS. 1A to 4C of the drawings of the specification of the present invention, a table according to a first preferred embodiment of the present invention is illustrated, wherein the table comprises a table top 10 made of plastic material, at least one receiving device 20, a supporter 30, and a mounting portion 40 made of plastic material, wherein the table top 10 has a table surface 11 and a bottom surface 12, wherein the mounting portion 40 and the table top 10 are integrated with each other. The supporter 30 is arranged on the bottom surface 12 of the table top 10. The receiving device 20 is arranged at the mounting portion 40. The supporter 30 is arranged to be able to support the table top 10 and to keep the table surface 11 of the table top 10 in a horizontal condition. In other words, the supporter 30 supports the table top 10, so as to keep the table surface 11 of the table top 10 horizontal, so that objects can be stably placed on the table surface 11 of the table top 10. Preferably, the table surface 11 of the table top 10 is flat. Person skilled in the art would understand that the table top 10 can be made by blow molding or injection molding. Hence, the mounting portion 40 of the table and the table top 10 of the table are formed together by blow molding or injection molding to form an integral structure. In other words, the mounting portion 40 can be considered as a part of the table top 10. Preferably, the table top 10 is formed through blow molding. Alternatively, the mounting portion 40 is hiddenly arranged on the bottom surface 12 of the table top 10. Alternatively, the mounting portion 40 is arranged on a side wall 14 of the table top 10, as FIG. 1F illustrates.

As shown in FIGS. 1A to 1F, the table top 10 of the table according to the above first preferred embodiment of the present invention defines an upper space 101 and a lower space 102. The upper space 101 is formed above the table surface 11 of the table top 10, and the lower space 102 is formed below the bottom surface 12 of the table top 10. The receiving device 20 is arranged in the lower space 102. Person skilled in the art would understand that the receiving device 20 can be any structure that can be arranged on the mounting portion 40 of the table for receiving objects therein. Hence, the receiving device 20 herein can be any structure that were known by person skilled in the art that can be arranged on the mounting portion 40 of the table and can accommodate objects therein. Preferably, the receiving device 20 is detachably arranged on the mounting portion 40 of the table. More preferably, the receiving device 20 is respectively arranged on the mounting portion 40 and hung in the air. In other words, the receiving device 20 has an absolute structure that can be arranged on the mounting portion 40, so as to be arranged respectively on the mounting portion 40 and hung in the air. Therefore, when the receiving device 20 or a receiving body 21 of the receiving device 20 is removed or detached from the mounting portion 40, it will not affect the overall aesthetic of the table.

Figure 5A:
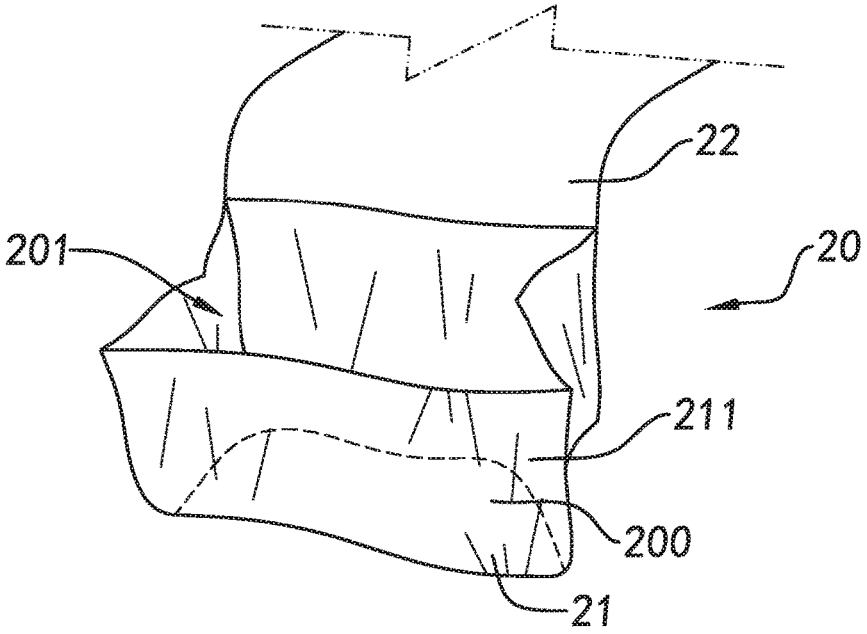
FIG. 5A illustrates the receiving device of table according to the above first preferred embodiment of the present invention in an open state.
Figure 5B:
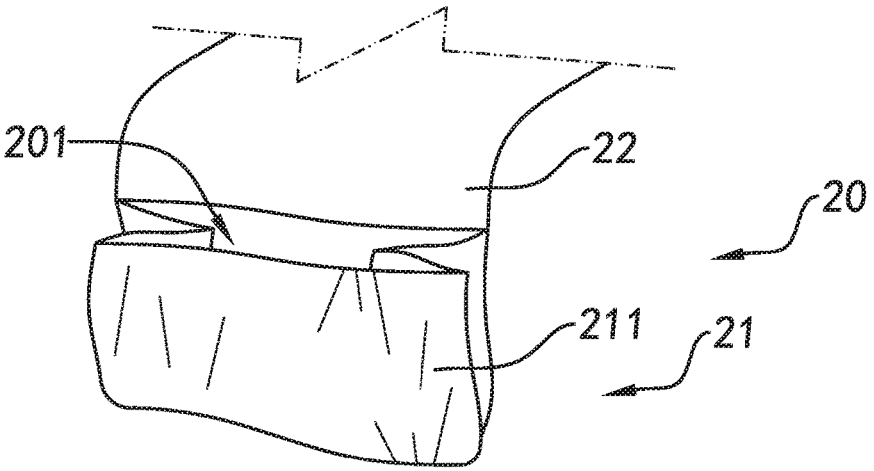
FIG. 5B illustrates the receiving device of table according to the above first preferred embodiment of the present invention in a folded state.

As shown in FIGS. 5A and 5B, wherein the receiving device 20 of the table according to the above first preferred embodiment of the present invention is further arranged to be openable and retractable. When the receiving device 20 is opened, the receiving device 20 forms a receiving cavity 200, wherein the receiving cavity 200 has a receiving opening 201. When the receiving device 20 is retracted, the receiving device 20 is folded so as to occupy a smaller space. Person skilled in the art would understand that the receiving device 20 can be arranged to allow a user to manually unfold and pack up the receiving device 20. The receiving device 20 can also be arranged to remain open when it is arranged at the mounting portion 40 of the table. The receiving device 20 can also be arranged to be remained opened when the supporter 30 of the table is unfolded and to be folded and retracted when the supporter 20 (and/or table top 10) of the table is folded.

It is understandable that the receiving body 21 of the receiving device 20 or the main structure of the receiving device 20 is made of soft material, so that when the receiving device 20 is arranged on the mounting portion 40, the receiving body 21 of the receiving device 20 will not affect the folding of the supporter 30 and/or the table top 10. Person skilled in the art would understand that the soft material is preferably cotton, hemp, silk, wool, chemical fiber, etc. The soft material can also be other material suitable for producing the receiving body 21 of the receiving device 20. Person skilled in the art would understand that the receiving device 20 further comprises a supporting shelf, wherein the receiving body 21 of the receiving device 20 is arranged on the supporting shelf and the supporting shelf is arranged to be able to keep the receiving body 21 in the open state. Preferably, the supporting shelf of the receiving device 20 is a foldable supporting shelf, so that the receiving device 20 can be folded into the folded state.

As shown in FIGS. 1A to 3C, the supporter 30 of the table according to a first preferred embodiment of the present invention, comprises a supporting frame 31 and at least one supporting leg 32. The supporting frame 31 of the supporter 30 is arranged on the bottom surface 12 of the table top 10. The supporting leg 32 of the supporter 30 is arranged on the supporting frame 31 of the supporter 30. As shown in FIGS. 1A to 3C, the supporter 30 further comprises at least two supporting legs 32.

As shown in FIG. 1A, the receiving device 20 of the table according to the above first preferred embodiment of the present invention comprises a receiving body 21 and at least one connecting element 22. The receiving body 21 forms the receiving cavity 200. The connecting element 22 is arranged on the receiving body 21 and the mounting portion 40 of the table.

Figure 2A:
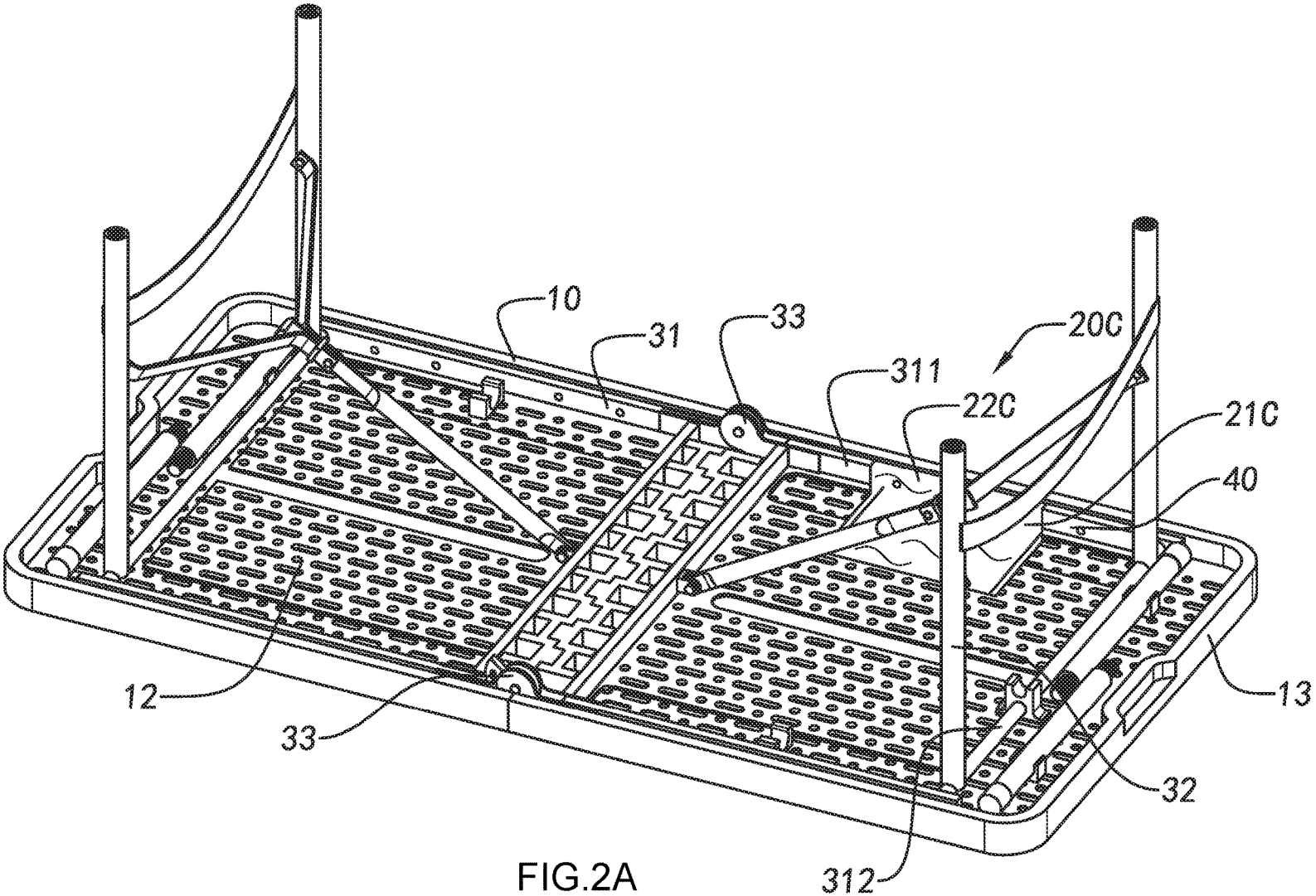
FIG. 2A is a perspective view of the table according to the above first preferred embodiment of the present invention, illustrating the supporter of the table being in an unfolded state and the receiving device of the table being arranged between the table top of the table.
Figure 2B:
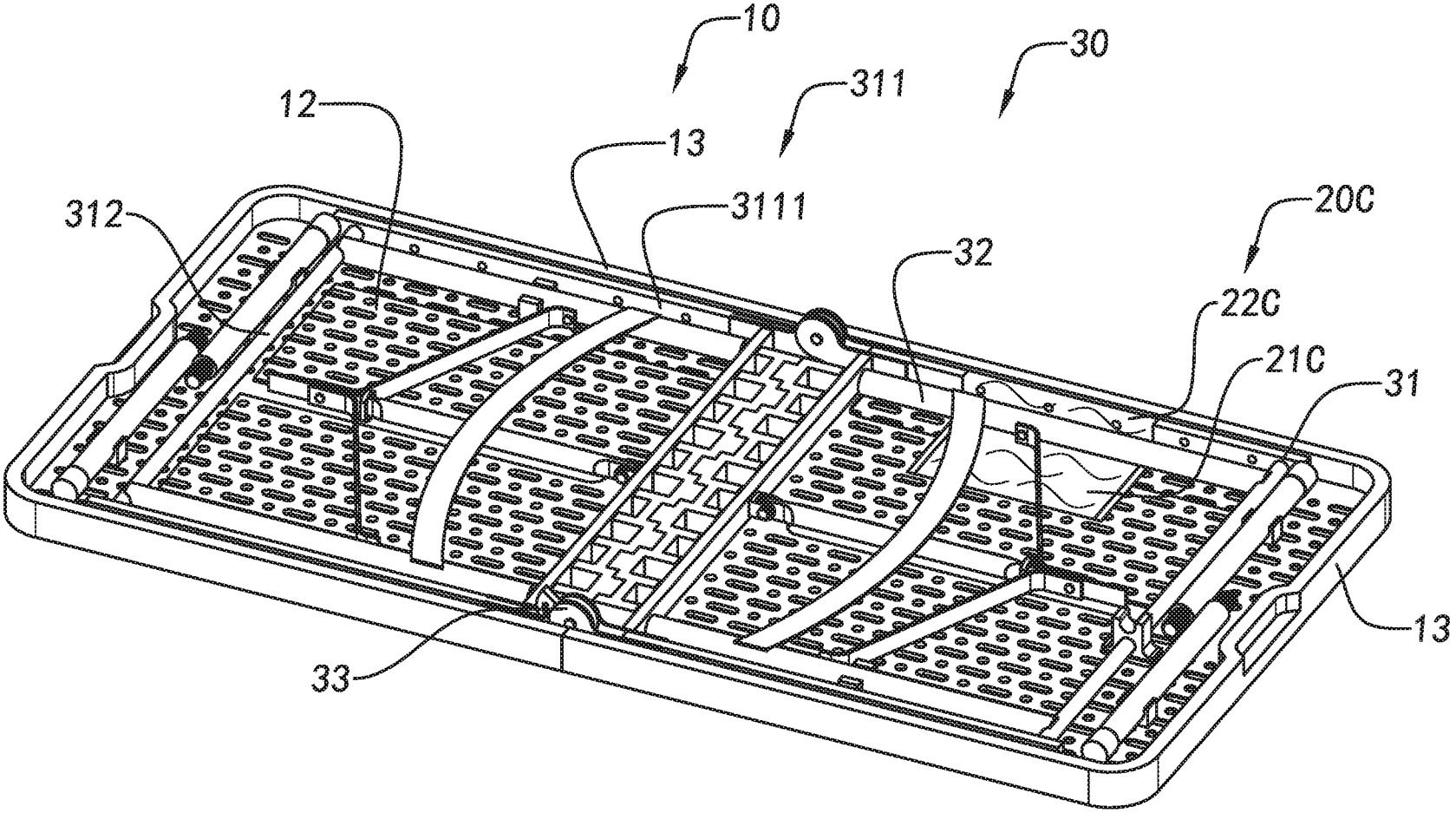
FIG. 2B is a perspective view of the table according to the above first preferred embodiment of the present invention, illustrating the supporter of the table being in a folded state.
Figure 2C:
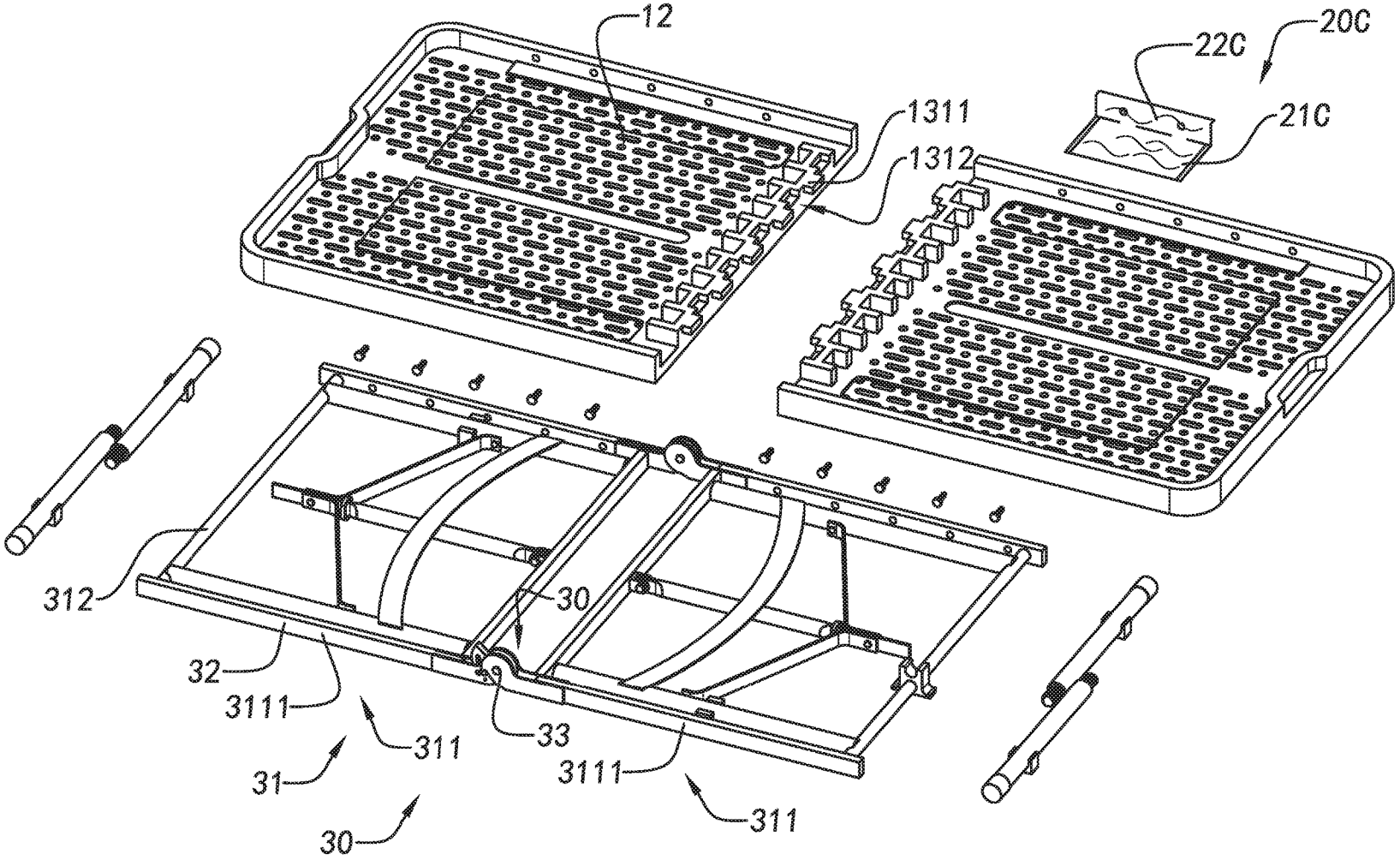
FIG. 2C is an exploded view of the table according to the above first preferred embodiment of the present invention.

As shown in FIGS. 2A to 2C, according to the above first preferred embodiment of the present invention, the table top 10 and the mounting portion 40 of the table are integrated with each other. The mounting portion 40 has at least one screw hole, such that the connecting element 22 of the receiving device 20 can be screwed at the mounting portion 40. Person skilled in the art would understand that the connecting element 22 of the receiving device 20 and the mounting portion 40 can also be connected through other connecting types. For example, the mounting portion 40 can be arranged to have a hanger structure and the connecting element 22 of the receiving device 20 is hung on the mounting portion 40.

As shown in FIG. 1A, the receiving device 20 of the table according to a first preferred embodiment of the present invention comprises a receiving body 21 and a connecting element 22. The receiving body 21 comprises two side walls 211. The connecting element 22 comprises a first connector 221 and a second connector 222. The two side walls 211 of the receiving body 21 are separately arranged. The first connector 221 of the connecting element 22 is arranged on one side wall 211 of the receiving body 21. The second connector 222 of the connecting element 22 of the receiving device 20 is arranged on the mounting portion 40. In other words, the second connector 222 of the connecting element 22 of the receiving device 20 is arranged on the mounting portion 40. Besides, when the receiving device 20 is arranged on the mounting portion 40 because the second connector 222 of the connecting elements 22 of the receiving device 20 is arranged on a side wall 211 of the receiving body 21 of the receiving device 20, the two side walls 211 of the receiving body 21 of the receiving device 20 will be kept separated under the influence of gravity, so as to remain the receiving body 21 of the receiving device 20 opened.

As shown in FIG. 1A, the second connector 222 and the first connector 221 of the connecting element 22 are arranged to be able to detachably connected together, so that the receiving body 21 of the receiving device 20 can be removed from the supporter 30. As shown in FIG. 1A, the connecting element 22 of the receiving device 20 preferably has a zipper structure, wherein the first connector 221 and the second connector 222 of the connecting element 22 can be zipped together. As shown in FIG. 1A, the first connector of the second connector 222 of the connecting element 22 have a toothed chain 2211 or 2221, such that the connecting element 22 has a zipper structure and the first connector 221 and the second connector 222 of the connecting element 22 can be zipped together. Hence, the connecting type between the first connector 221 and the second connector 222 of the connecting element 22 of the receiving device 20 is zipping type.

Alternatively, the connecting element 22 of the receiving device 20 has a hanger structure, so that the receiving device 20 can be hung on the supporter 30. In other words, the connecting element 22 can be a hanger, so that the receiving body 21 of the receiving device 20 can be detachably hung on the hanger.

Figure 1B:
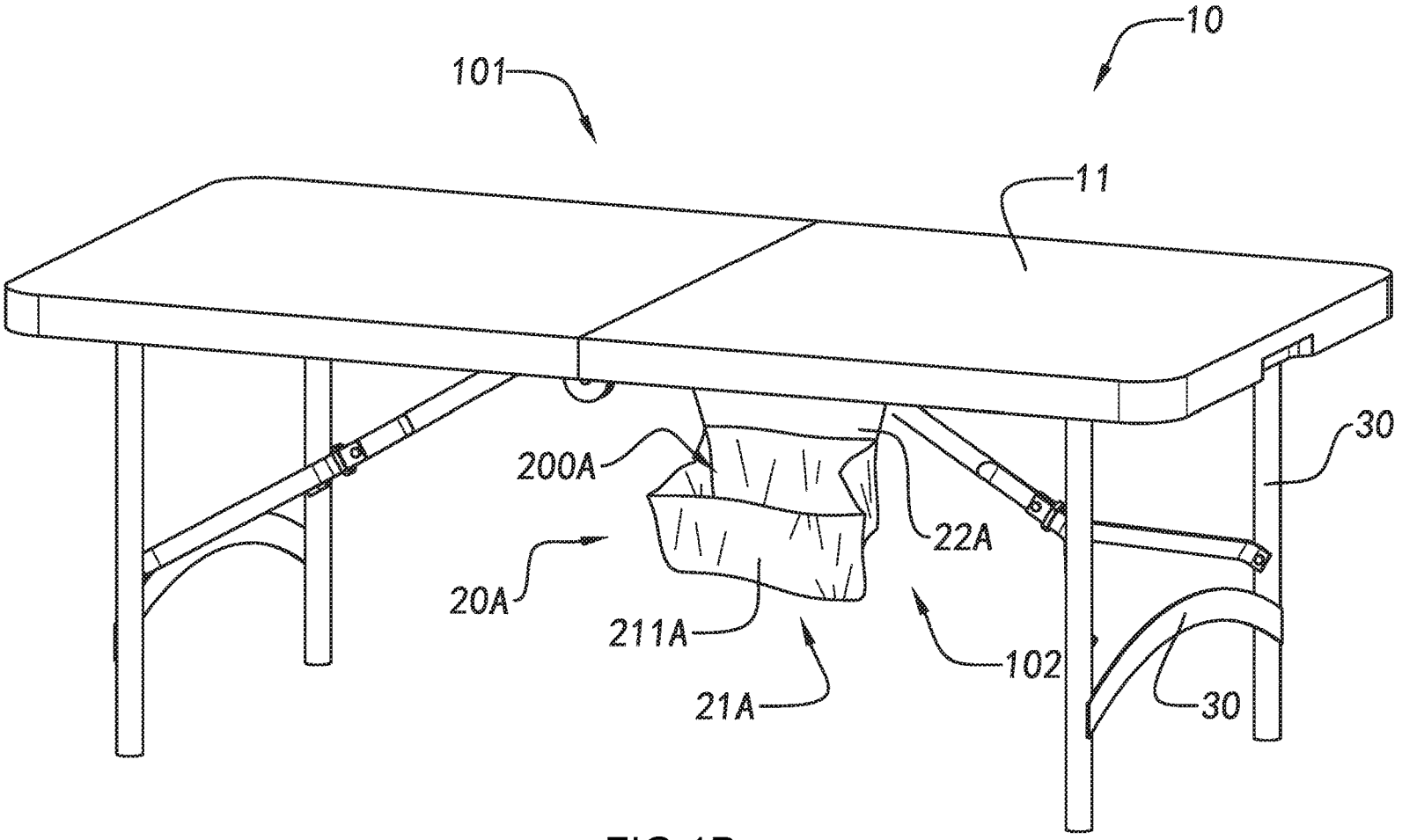
FIG. 1B illustrates an alternative of the receiving device of the table according to the above first preferred embodiment of the present invention.

FIG. 1B of the drawings illustrates an alternative of the receiving device 20 of the table according to the above first preferred embodiment of the present invention, wherein the receiving device 20A comprises a receiving body 21A and two connecting elements 22A. The receiving body 21A comprises two side walls 211A. The two side walls 211A of the receiving body 21A are separately arranged. The two connecting elements 22A of the receiving device 20A are respectively arranged on the same side wall 211A of the receiving body 21A and the mounting portion 40. Therefore, the receiving device 20A is arranged on the mounting portion 40. Besides, when the receiving device 20A is arranged on the mounting portion 40, because the two connecting elements 22A of the receiving device 20A are both arranged on the same side wall 211A of the receiving body 21A of the receiving device 20A, the two side walls 211A of the receiving body 21A of the receiving device 20A will be kept separated under the influence of gravity, so as to remain the receiving body 21A of the receiving device 20A opened. Preferably, the connecting element 22A of the receiving device 20A has a linear structure, so as to make the connecting element 22A of the receiving device 20A be respectively detachably tied on the mounting portion 40. Alternatively, the connecting element 22A of the receiving device 20A is band shaped. Therefore, the connecting type between the connecting element 22A of the receiving device 20A and the mounting portion 40 is rope tying type.

Figure 1C:
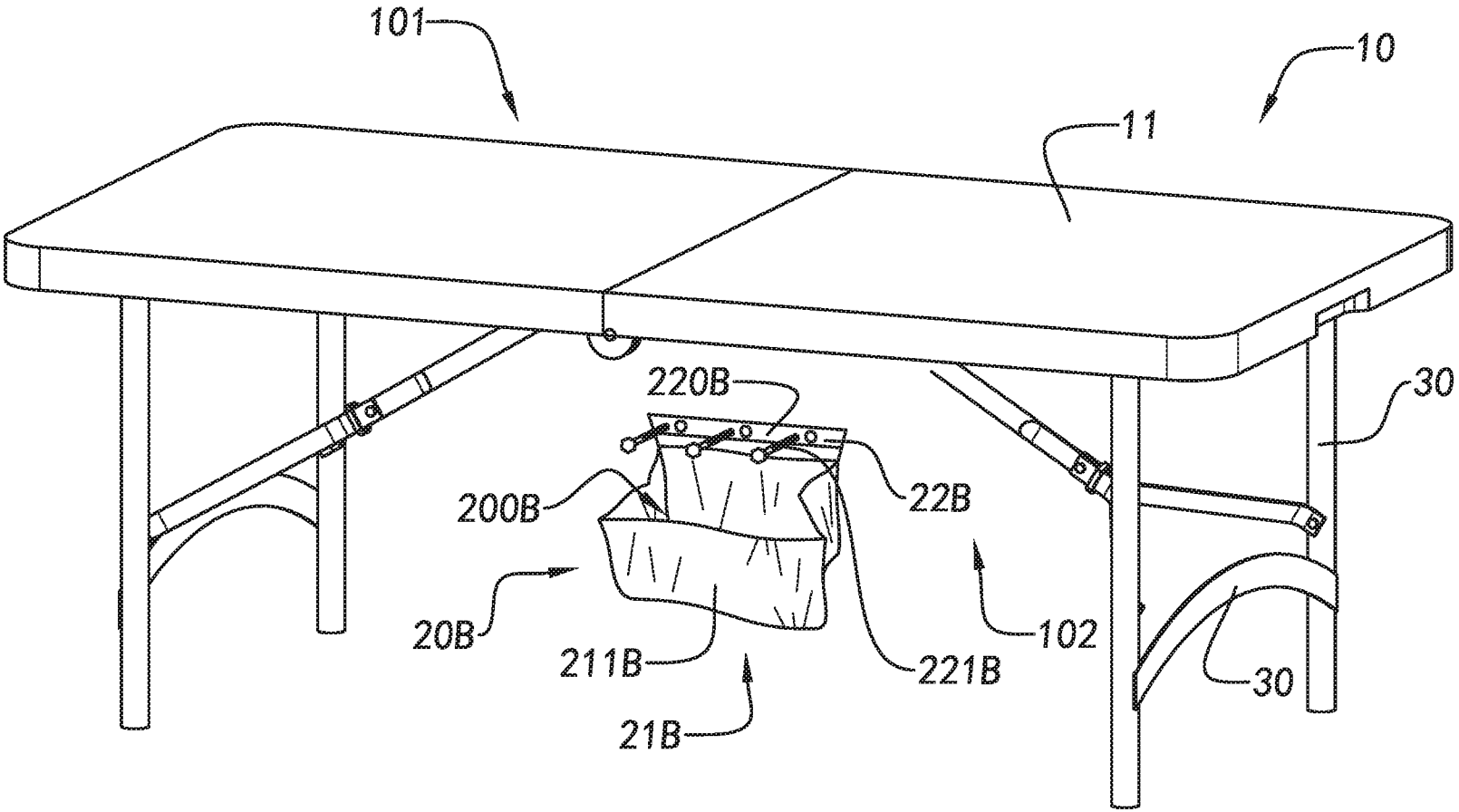
FIG. 1C illustrates another alternative of the receiving device of the table according to the above first preferred embodiment of the present invention.

FIG. 1C of the drawings illustrates another alternative of the receiving device 20 of the table according to the above first preferred embodiment of the present invention, wherein the receiving device 20B comprises a receiving body 21B and a connecting element 22B. The receiving body 21B comprises two side walls 211B. The two side walls 211B of the receiving body 21B are separately arranged. The connecting element 22B is arranged on one side wall 211B of the receiving body 21B. The connecting element 22B of the receiving device is arranged at the mounting portion 40. In other words, the receiving device 20B is arranged on the mounting portion 40. Besides, when the receiving device 20B is arranged on the mounting portion 40 because the connecting element 22B of the receiving device 20B is arranged on a side wall 211B of the receiving body 21B of the receiving device 20B, the two side walls 211B of the receiving body 21B of the receiving device 20B will be kept separated under the influence of gravity, so as to make the receiving body 21B of the receiving device 20B be kept opened.

As shown in FIG. 1C, the connecting element 22B and the mounting portion 40 are arranged to respectively have at least one screw hole 220B or 1000B, so that the connecting element 22B and the mounting portion 40 can be detachably screwed together and the receiving body 21B of the receiving device 20B can be removed from the mounting portion 40. As shown in FIG. 1C, the connecting element 22B of the receiving device 20B further comprises at least one screw 221B. The screw 221B can screw through the screw hole 220B and 1000B. Therefore, the connecting type between the connecting element 22B of the receiving device 20B and the mounting portion 40 is screwing type.

Figure 1D:
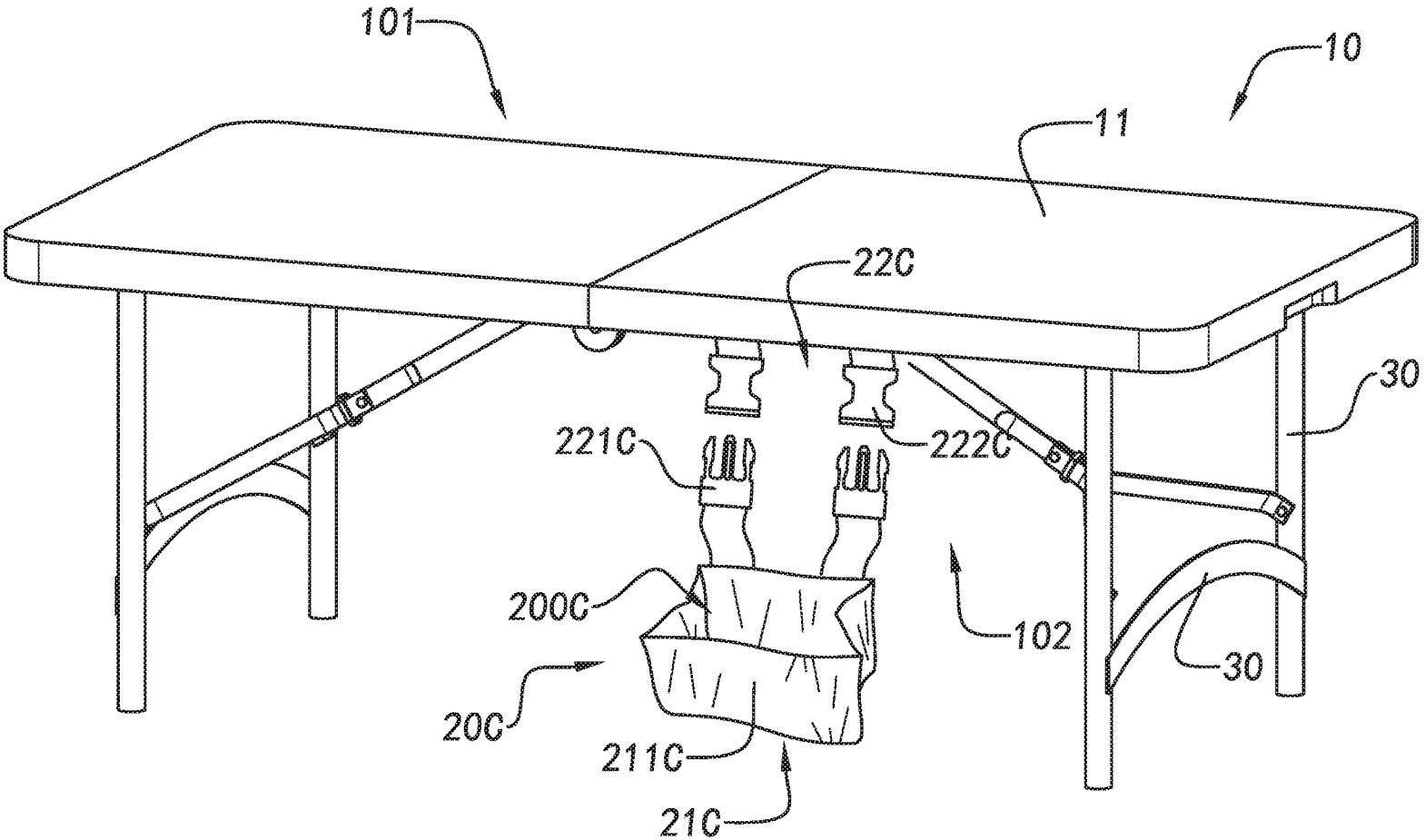
FIG. 1D illustrates another alternative of the receiving device of the table according to the above first preferred embodiment of the present invention.

FIG. 1D of the drawings refers to another alternative of the receiving device 20 of the table according to the above first preferred embodiment of the present invention, wherein the receiving device 20C comprises a receiving body 21C and two connecting elements 22C. The receiving body 21C comprises two side walls 211C. Each of the connecting element 22C comprises a first connector 221C and a second connector 222C. The two side walls 211C of the receiving body 21C are separately arranged. The first connectors 221C of the connecting elements 22C are respectively arranged on the same side wall 211C of the receiving body 21C. The second connectors 222C of the two connecting elements 22C of the receiving device 20C are respectively arranged on the mounting portion 40. In other words, the receiving device 20C is arranged on the mounting portion 40. Besides, when the receiving device 20C is arranged on the mounting portion 40 because the two connecting elements 22C of the receiving device 20C are both arranged on the same side wall 211C of the receiving body 21C of the receiving device 20C, the two side walls 211C of the receiving body 21C of the receiving device 20C will be kept separated under the influence of gravity, so as to cause the receiving body 21C of the receiving device 20C to be remained opened.

As shown in FIGS. 1D and 2A to 2C, the second connector 222C and the first connector 221C of the connecting element 22C are arranged to be able to detachably connected together, so that the receiving body 21C of the receiving device 20C can be detached or removed from the supporter 30. As shown in FIG. 1D, the connecting element 22C of the receiving device 20C is a detachable buckle, so as allow the first connector 221C and the second connector 222C of the connecting element 22C to be detachably locked or buckled together. As shown in FIG. 1D, the first connector 221C of the connecting element 22C is arranged to have an engaging end structure of a detachable buckle, wherein the second connector 222C is arranged to have a locking end of a detachable buckle, such that the first connector 221C and the second connector 222C of the connecting element 22C can be locked or buckled together. Alternatively, the first connector 221C of the connecting element 22C is arranged to have a locking end structure of a detachable buckle, wherein the second connector 222C is arranged to have an engaging end of a detachable buckle, such that the first connector 221C and the second connector 222C of the connecting element 22C can be locked or buckled together. Hence, the connecting type between the first connector 221C and the second connector 222C of the connecting element 22C of the receiving device 20C is buckling type.

Figure 1E:
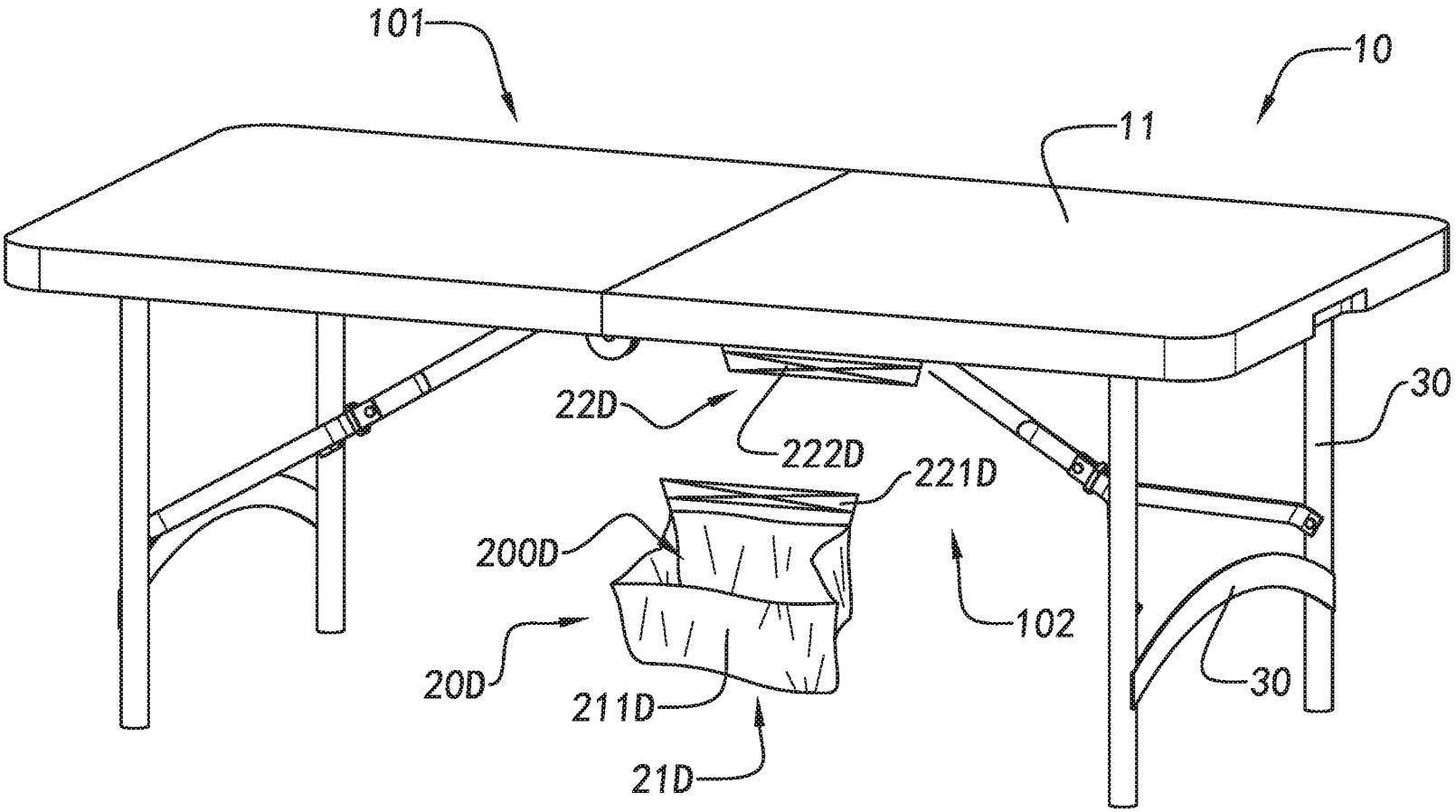
FIG. 1E illustrates another alternative of the receiving device of the table according to the above first preferred embodiment of the present invention.

FIG. 1E of the drawings refers to an alternative of the receiving device 20 of the table according to the above first preferred embodiment of the present invention, wherein the receiving device 20D comprises a receiving body 21D and two connecting elements 22D. The receiving body 21D comprises two side walls 211D. Each of the connecting elements 22D comprises a first connector 221D and a second connector 222D. The two side walls 211D of the receiving body 21D are separately arranged. The first connectors 221D of the two connecting elements 22D of the receiving device 20D are respectively arranged on the same side wall 211D of the receiving body 21D. The second connectors 222D of the two connecting elements 22D of the receiving device 20D are respectively arranged on the mounting portion 40. In other words, the receiving device 20D is arranged between two supporting legs 32 of the supporter 30. Besides, when the receiving device 20D is arranged between the two supporting legs 32 of the supporter 30 because the two connecting elements 22D of the receiving device 20D are both arranged on the same side wall 211D of the receiving body 21D of the receiving device 20D, the two side walls 211D of the receiving body 21D of the receiving device 20D will be kept separated under the influence of gravity, so as to cause the receiving body 21D of the receiving device 20D remained opened.

As shown in FIG. 1E, the second connector 222D and the first connector 221D of the connecting element 22D are arranged to be able to detachably connected together, so that the receiving body 21D of the receiving device 20D can be detached or removed from the supporter 30. As shown in FIG. 1E, the connecting element 22D of the receiving device 20D is a hook and loop fastener or magic tape so as allow the first connector 221D and the second connector 222D of the connecting element 22D to be detachably hook-loop fastened together. As shown in FIG. 1E, the first connector 221D of the connecting element 22D is arranged to have a hook structure of a hook and loop fastener, wherein the second connector 222D is arranged to have a loop structure of a hook and loop fastener, such that the first connector 221D and the second connector 222D of the connecting element 22D can be hook-loop fastened together. Alternatively, the first connector 221D of the connecting element 22D is arranged to have a loop structure of a hook and loop fastener, wherein the second connector 222D is arranged to have hook structure of a hook and loop fastener, such that the first connector 221D and the second connector 222D of the connecting element 22D can be hook-loop fastened together. Hence, the connecting type between the first connector 221D and the second connector 222D of the connecting element 22D of the receiving device 20D is hook-loop fastening or bonding type.

Figure 1F:
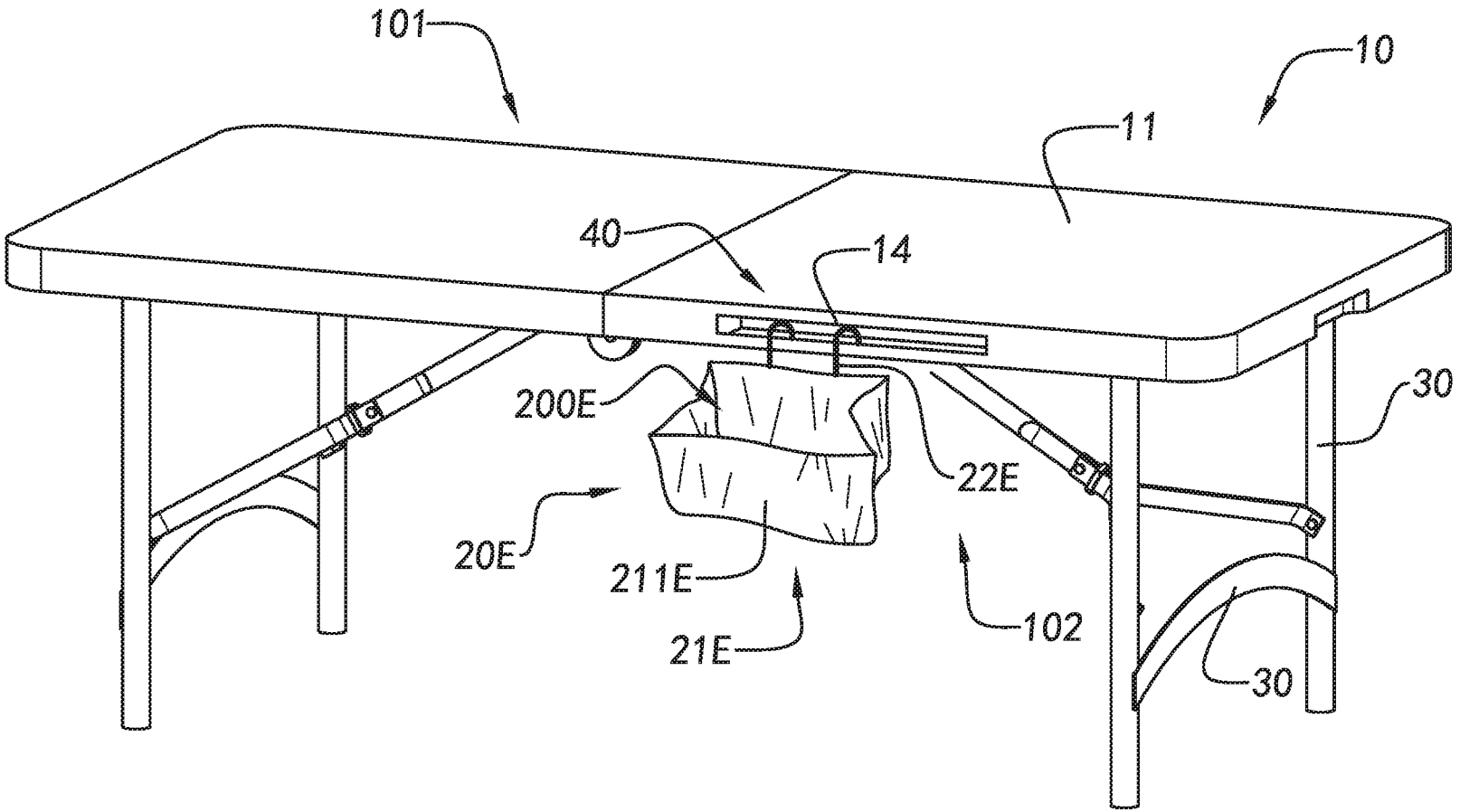
FIG. 1F illustrates another alternative of the receiving device of the table according to the above first preferred embodiment of the present invention.

FIG. 1F of the drawings illustrates an alternative of the receiving device 20 of the table according to the above first preferred embodiment of the present invention, wherein the receiving device 20E comprises a receiving body 21E and two connecting elements 22E. The receiving body 21E comprises two side walls 211E. The two side walls 211E of the receiving body 21E are separately arranged. The two connecting elements 22E of the receiving device 20E are respectively arranged on the same side wall 211E of the receiving body 21E and the mounting portion 40. Therefore, the receiving device 20E is arranged on the mounting portion 40. Besides, when the receiving device 20E is arranged on the mounting portion 40 because the two connecting elements 22E of the receiving device 20E are both arranged on the same side wall 211E of the receiving body 21E of the receiving device 20E, the two side walls 211E of the receiving body 21E of the receiving device 20E will be kept separated under the influence of gravity, so as to cause the receiving body 21E of the receiving device 20E remained opened. Preferably, the connecting element 22E of the receiving device 20E has a hanger structure, so as to make the connecting element 22E of the receiving device 20E be respectively detachably hung on the mounting portion 40. Therefore, the connecting type between the connecting element 22E of the receiving device 20E and the mounting portion 40 is wall mounting type. As shown in FIG. 30F, the mounting portion 40 of the table according to the above first preferred embodiment of the present invention is arranged on a side wall 14 of the table top 10 and the mounting portion 40 is arranged to have a rod-shaped structure, so that the connecting element 22E of the receiving device 20E can hook on the mounting portion 40.

As shown in FIGS. 2A to 2C, the supporter 30 of the table according to the above first preferred embodiment of the present invention, comprises a supporting frame 31 arranged on the bottom surface 12 of the table top 10 and at least two supporting legs 32 respectively arranged on the supporting frame 31 of the supporter 30. The supporting legs 32 are respectively arranged to pivot with respect to each other to the bottom surface 12 of the table top 10, so that the supporting legs 32 can be folded on the bottom surface 11 of the table top 10. In other words, the supporter 30 of the table is a foldable supporter.

As shown in FIGS. 2A to 2C, the supporting frame 31 of the supporter 30 comprises two transverse members 311 separately arranged on the bottom surface 12 of the table top 10 and two longitudinal members 312 separately arranged between the two transverse members, wherein each longitudinal member 312 is pivotally arranged between the transverse members 311 of the supporting frame 31, wherein the supporting leg(s) 32 of the supporter 30 is respectively arranged on the two longitudinal members 312 of the supporting frame 31, so as to allow the supporting leg(s) 32 of the supporter 30 be arranged to be pivotally with respect to the bottom surface 12 of the table top 10.

Figure 4A:
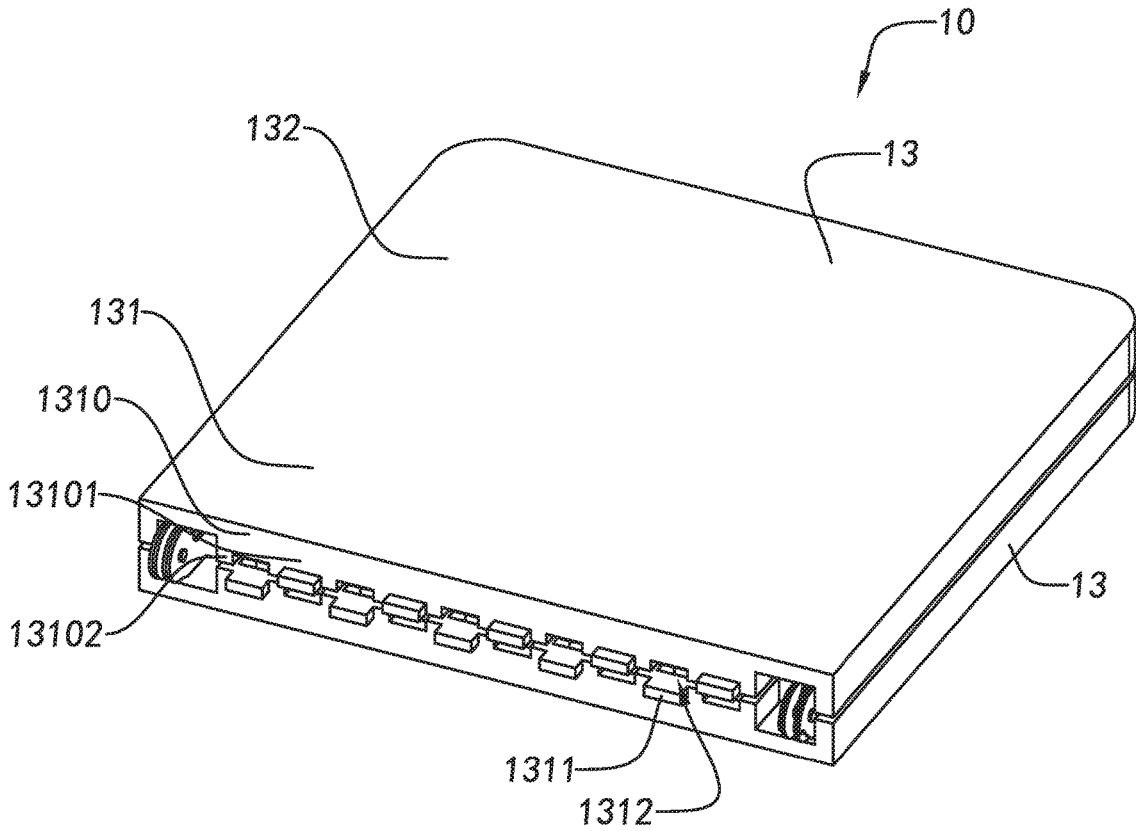
FIG. 4A is a perspective view of the table top of the table according to the above first preferred embodiment of the present invention, illustrating the table top of the table being in a folded state.
Figure 4B:
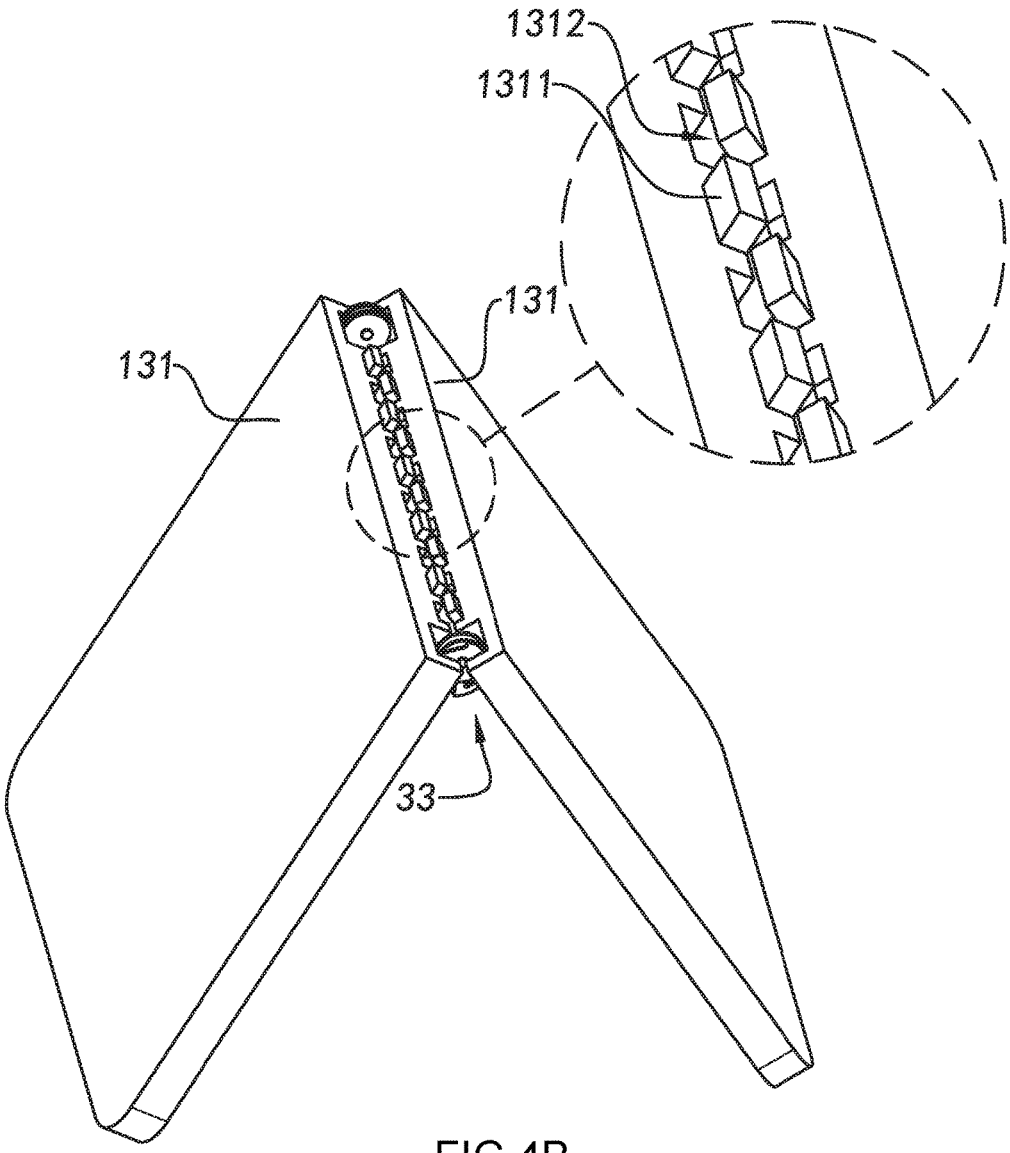
FIG. 4B is a perspective view illustrating the connection relationship of two pivoting portions of the table top of the table according to the above first preferred embodiment of the present invention.
Figure 4C:
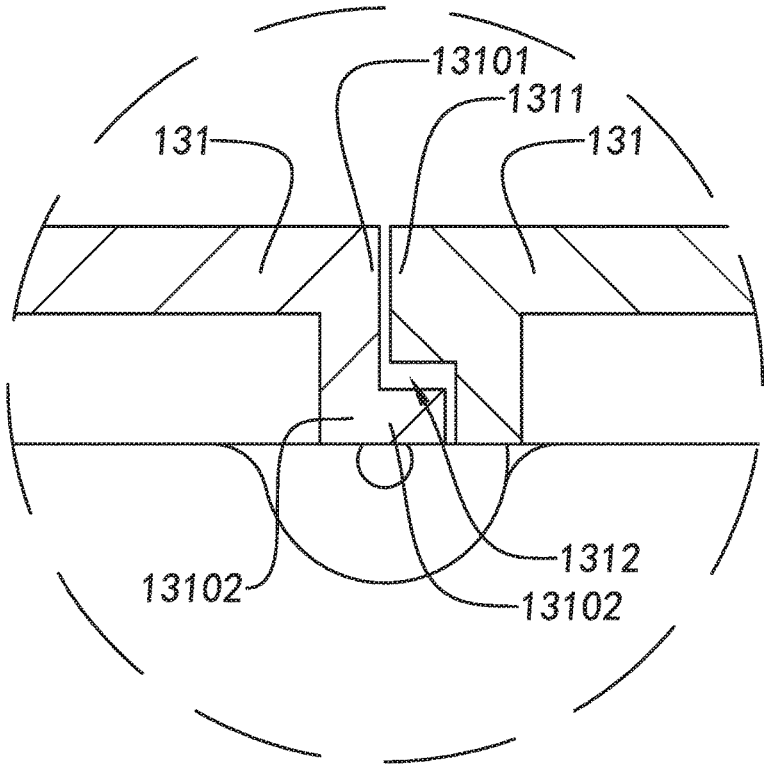
FIG. 4C is a partial sectional view of the table top of the table according to the above first preferred embodiment of the present invention.

As shown in FIGS. 4A to 4C, the table top 10 of the table, according to the above first preferred embodiment of the present invention, comprises two pivoting portions 13, wherein the two pivoting portions 13 of the table top 10 are arranged to be pivotally relatively movable, so that the table top 10 can be folded to occupy a smaller space and be unfolded to form the table surface 11 of the table top 10.

Figure 3A:
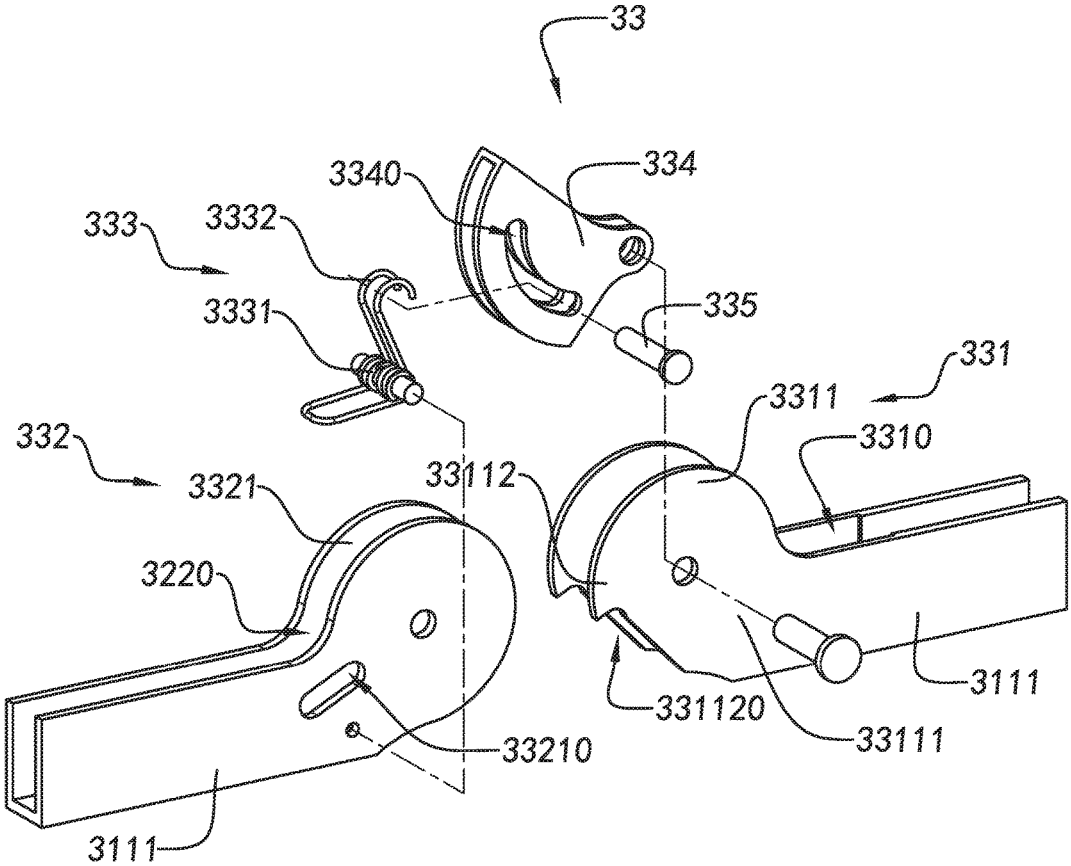
FIG. 3A is an exploded view of the locker of the table according to the above first preferred embodiment of the present invention.
Figure 3B:
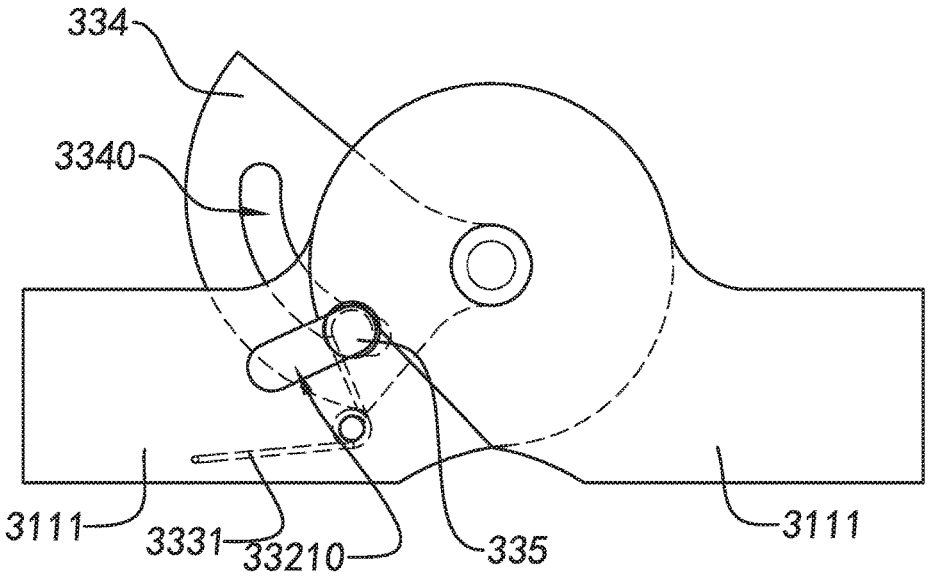
FIG. 3B illustrates the transverse member of the table according to the above first preferred embodiment of the present invention, which is kept unfolded by the locker.
Figure 3C:
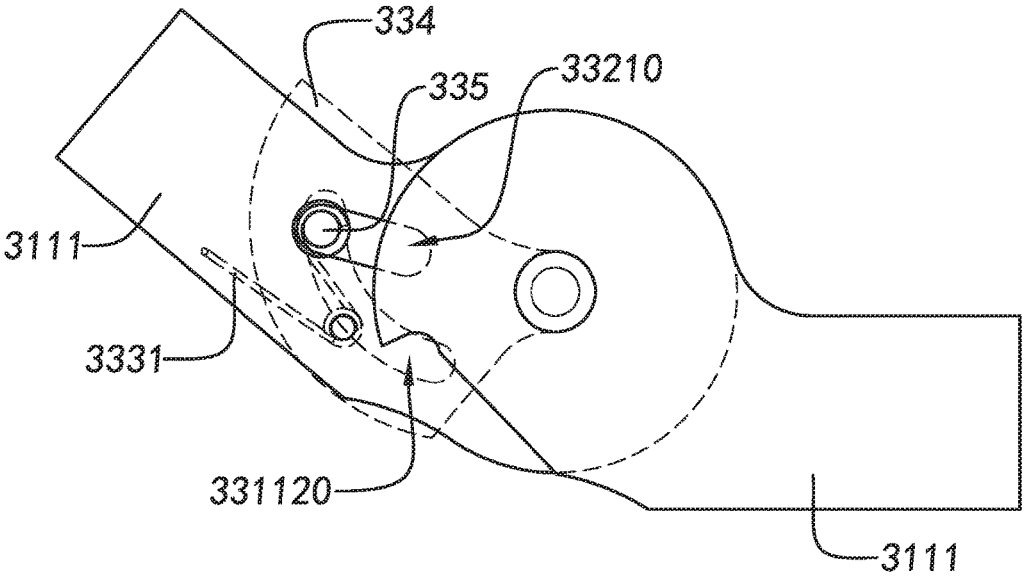
FIG. 3C illustrates the locker of the table according to the above first preferred embodiment of the present invention, which allows the transverse member of the supporter of the table to be folded.

As shown in FIGS. 3A to 3C, the supporter 30 further comprises two lockers 33. Each transverse member 311 of the supporting frame 31 of the supporter 30 comprises two supporting elements 3111. Each locker 33 is arranged between the two supporting elements 3111 of the transverse member 311 of the supporting frame 31 of the supporter 30. The locker 33 is arranged to allow the two supporting elements 3111 of the transverse member 311 of the supporting frame 31 to pivot with respect to each other.

As shown in FIGS. 3A to 3C, each locker 33 of the supporter 30 is arranged to have a locked state and an unlocked state. When the locker 33 is in the locked state, the locker 33 can prevent the two supporting elements 3111 of the transverse member 311 to pivot with respect to each other, and when the locker 33 is in the unlocked state, the locker 33 allows the two supporting elements 3111 to freely pivot with respect to each other. Person skilled in the art would understand that because the supporting frame 31 of the supporter 30 is arranged on the bottom surface 12 of the table top 10, when the locker 33 is set in the locked state, the two pivoting portions 13 of the table top 10 will be kept unfolded and opened to form the table surface 11. When the locker 33 is set in the unlocked state, the locker 33 will allow the two supporting elements 3111 of the transverse member 311 to pivot with respect to each other and allow the two pivoting portions 13 of the table top 10 to pivot with respect to each other.

As shown in FIGS. 3A to 3C, the locker 33 of the supporter 30 of the table according to the above first preferred embodiment of the present invention, comprises a first locking unit 331, a second locking unit 332, a holder 333, an operating portion 334, and a locking member 335.

As shown in FIGS. 3A to 3C of the drawings, the first locking unit 331 comprises two first walls 3311. The second locking unit 332 comprises two second walls 3321. The two first walls 3311 of the first locking unit 331 respectively extends outwardly from a supporting element 3111 of the transverse member 311. The two second walls 3321 of the second locking unit 332 respectively extends outwardly from another supporting element 3111 of the transverse member 311. The two first walls 3311 of the first locking unit 331 are separately arranged to form a first mounting groove 3310 therebetween. The two second wall 3321 of the second locking unit 332 are separately arranged to form a second mounting groove 3320 therebetween. Each of the first wall 3311 comprises an extending portion 33111 extended from the supporting element 3111 of the transverse member 311 and a locking portion 33112 extended from extending end 33111. The locking portion 33112 forms a locking groove 331120. Each second wall 3321 of the second locking unit 332 have a first guiding groove 33210 extended upwardly and outwardly. The operating portion 334 has a curvingly extended second guiding groove 3340. The second locking unit 332 is arranged at the first mounting groove 3310 of the first locking unit 331. The operating portion 334 is arranged at the second mounting groove 3320 of the second locking unit 332. The first guiding groove 33210 of the second wall 3321, the second guiding groove 3340 of the operating portion 334, and the locking groove 331120 of the first wall 3311 are coincided, so as to allow the locking member 335 to penetrate the first guiding groove 33210 of the second wall 3321, the second guiding groove 3340 of the operating portion 334, and the locking groove 331120 of the first wall 3311. The holder 333 is arranged in the second mounting groove 3320 and extended to the locking member 35. Besides, the holder 333 is allowed to keep the locking member 335 in the second guiding groove 2240. In other words, the locker 33 of the supporter 30 comprises a first locking unit 331, a second locking unit 332, a holder 333, an operating portion 334, and a locking member 335. The first locking unit 331 has a first mounting groove 3310 and a locking groove 331120. The two locking units 332 have a second mounting groove 3320 and a first guiding groove 33210. The operating portion 334 has a curvingly extended second guiding groove 3340. The second locking unit 332 is arranged at the first mounting groove 3310 of the first locking unit 331. The operating portion 334 is pivotally arranged at the second mounting groove 3320 of the second locking unit 332. The first guiding groove 33210 of the second wall 3321, the second guiding groove 3340 of the operating portion 334, and the locking groove 331120 of the first wall 3311 are coincided, so as to allow the locking member 335 to penetrate the first guiding groove 33210 of the second wall 3321, the second guiding groove 3340 of the operating portion 334, and the locking groove 331120 of the first wall 3311. The holder 333 is allowed to keep the locking member 335 in the locking groove 331120.

As shown in FIGS. 3A to 3C, the holder 333 of the locker 33 of the supporter 30 comprises a fixing end 3331 and a retaining end 3332 extended from the fixing end 3331. The retaining end 3332 is arranged at the locking member 335 of the locker 33 of the supporter 30 and is allowed to hold the locking member 335 at a proper position, such that the locking member 335 will still be kept at the second guiding groove 3340 of the operating portion 334. Preferably, the retaining end 3332 of the holder 333 is a resilient element, so as to provide a resilience to constantly keep the locking member 335 in the locking groove 331120 of the second locking unit 332 when the transverse member 31 is in an unfolded state.

Person skilled in the art would understand that the locker 33 of the supporter 30 is arranged for the following mechanism. On one hand, when the transverse member 311 of the supporter 30 is to be unfolded, the second locking unit 332 will be arranged in the first mounting groove 3310 of the first locking unit 331, the operating portion 334 will be arranged in the second mounting groove 3320 of the second locking unit 332, and the first guiding groove 33210 of the second wall 3321, the second guiding groove 3340 of the operating portion 334, and the locking groove 331120 of the first wall 3311 will be coincided. Thus, the locking member 335 can be arranged to penetrate the first guiding groove 33210 of the second wall 3321, the second guiding groove 3340 of the operating portion 334, and the locking groove 331120 of the first wall 3311 at the same time. Therefore, the locking member 335 will constantly be kept in the locking groove 331120 of the second locking unit 332. On the other hand, when the transverse member 311 of the supporter 30 is to be folded, the second locking unit 332 will drive the locking member 335 to move upwardly along the second guiding groove 3340 of the operating portion 334 and drive the operating portion 334 to pivot with respect to each other to the first locking unit 331, so as to make the transverse member 311 of the supporting frame 31 of the supporter 30 be folded. Person skilled in the art would understand that when the supporting frame 31 of the supporter 30 of the table is foldable, the foldable table top 10 of the table can be correspondingly folded as well.

As shown in FIGS. 4A to 4C, the table top 10 of the table, according to the above first preferred embodiment of the present invention, comprises two pivoting portions 13, wherein the two pivoting portions 13 of the table top 10 are arranged to be pivotally relatively movable, so that the table top 10 can be folded to occupy a smaller space and be unfolded to form the table surface 11 of the table top 10.

As shown in FIGS. 2A to 2C, the two pivoting portions 13 of the table top 10 is respectively arranged on the two supporting elements 3111 of each of the transverse members 311 of the supporting frame 31 of the supporter 30. The two supporting elements 3111 of each of the transverse members 311P of the supporting frame 31 of the supporter 30 are arranged to pivot with respect to each other, so that the two pivoting portions 13 of the table top 10 can be relatively pivotally moved.

As shown in FIGS. 4A to 4C, each of pivoting portions 13 of the table top 10 comprises an engaging end 131 and a lengthening portion 132 extended outwardly from the engaging end 131. The engaging end 131 of each of pivoting portions 13 of the table top 10 comprises a plurality of engaging teeth 1311 and has a plurality of engaging holes 1312. The engaging teeth 1311 and the engaging holes 1312 of the engaging end 131 are interlacedly arranged, so that when the table top 10 is unfolded, the engaging ends 131 of the two pivoting portions 13 of the table top 10 can mutually engage each other, so as to enhance the intensity and loading capacity of the table top 10.

As shown in FIGS. 4A to 4C, the engaging end 131 of the pivoting portion 13 of the table top 10 has an outer wall 1310. The outer wall 1310 has an upper end portion 13101 and a lower end portion 13102 extended downwardly from the upper end portion 13101. The engaging teeth 1311 and the engaging holes 1312 of the engaging end 131 are respectively interlacedly aligned on the upper end portion 13101 and the lower end portion 13102 of the outer wall 1310 of the engaging end 131. The engaging teeth 1311 and the engaging holes 1312 of the engaging ends 131 of the two pivoting portions 13 of the table top 10 are arranged to correspond to each other, such that the upper end portions 13101 of the outer walls 1310 of the engaging ends 131 of the two pivoting portions 13 of the table top 10 can mutually engage each other and the lower end portions 13102 of the outer walls 1310 of the engaging ends 131 of the two pivoting portions 13 of the table top 10 can also mutually engage each other, which enhances the intensity and loading capacity of the table top 10.

It should be noted that when the engaging ends 131 of the two pivoting portions 13 of the table top 10 are mutually engaged with each other, the two pivoting portions 13 of the table top 10 will form the table surface 11 of the table top 10 and the table surface 11 is a flat table surface.

As shown in FIGS. 6A to 9C of the drawings of the specification of the present invention, a table according to a second preferred embodiment of the present invention is illustrated. The table comprises a table top 10 made of plastic material, at least one receiving device 20F, and a supporter 30. The table top 10 has a table surface 11 and a bottom surface 12. The supporter 30 is arranged on the bottom surface 12 of the table top. The receiving device 20F is arranged at the supporter 30. The supporter 30 is arranged to be able to support the table top 10 and to keep the table surface 11 of the table top 10 in a horizontal condition. In other words, the supporter 30 supports the table top 10, so as to keep the table surface 11 of the table top 10 horizontal, so that objects can be stably placed on the table surface of the table top 10. Preferably, the table surface 11 of the table top 10 is flat. Person skilled in the art would understand that the table top 10 can be made by blow molding or injection molding. Preferably, the table top 10 is formed through blow molding.

As shown in FIGS. 6A to 6F, the table top 10 of the table according to a second preferred embodiment of the present invention, forms an upper space 101 and a lower space 102. The upper space 101 is formed above the table surface 11 of the table top 10, and the lower space 102 is formed below the bottom surface 12 of the table top 10. The receiving device 20F is arranged in the lower space 102. Person skilled in the art would understand that the receiving device 20F can be any structure that can be arranged on the supporter 30 of the table for receiving objects. Hence, the receiving device 20F herein comprises all mechanisms that were known by person skilled in the art that can be arranged on the supporter 30 of the table and can accommodate objects therein. Preferably, the receiving device 20F is detachably arranged on the supporter 30 of the table. More preferably, the receiving device 20F is solely and suspendingly arranged on the supporter 30. In other words, the receiving device 20F has an absolute structure that can be arranged on the supporter 30, so as to be solely and suspendingly arranged on the supporter 30. Therefore, when the receiving device 20F or a receiving body 21F of the receiving device 20F is removed or detached from the supporter 30, it will not affect the overall aesthetic of the table.

Figure 10A:
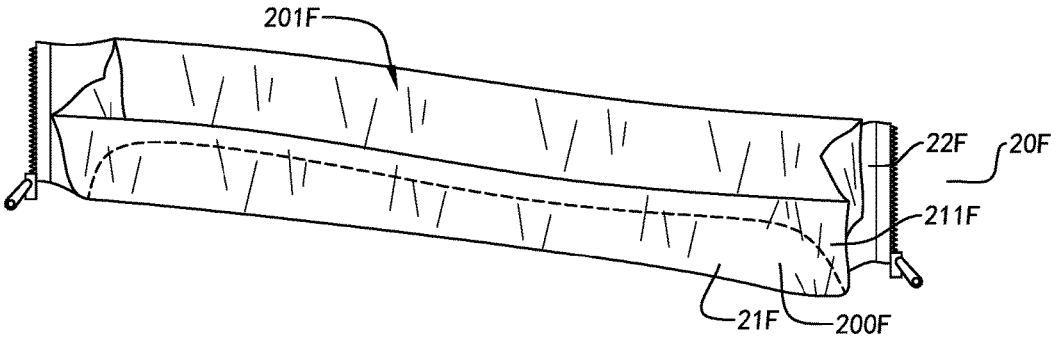
FIG. 10A illustrates the receiving device of table according to the above second preferred embodiment of the present invention in an open state.
Figure 10B:
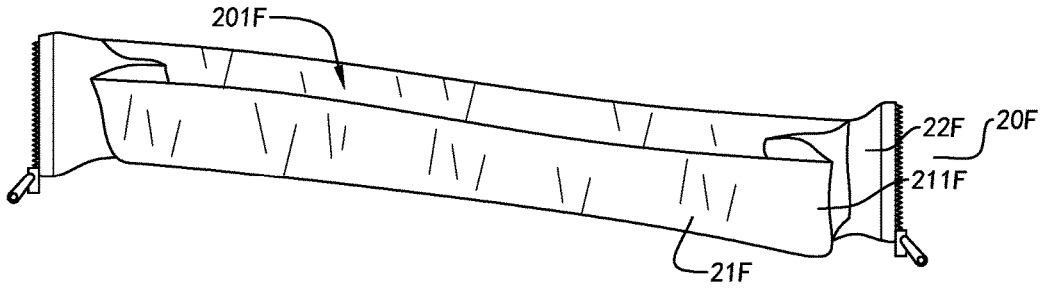
FIG. 10B illustrates the receiving device of table according to the above second preferred embodiment of the present invention in a folded state.

As shown in FIGS. 10A and 10B, wherein the receiving device 20F of the table according to the above second preferred embodiment of the present invention is further arranged to be openable and retractable. When the receiving device 20F is opened, the receiving device 20F forms a receiving cavity 200F, wherein the receiving cavity 200F has a receiving opening 201F. When the receiving device 20F is retracted, the receiving device 20F is folded so as to occupy a smaller space. Person skilled in the art would understand that the receiving device 20F can be arranged to allow a user to manually unfold and pack up the receiving device 20F. The receiving device 20F can also be arranged to remain open when it is arranged at the supporter 30 of the table. The receiving device 20F can also be arranged to be remained opened when the supporter 30 of the table is unfolded and to be folded and retracted when the supporter 20F (and/or table top 10) of the table is folded.

Figure 6A:
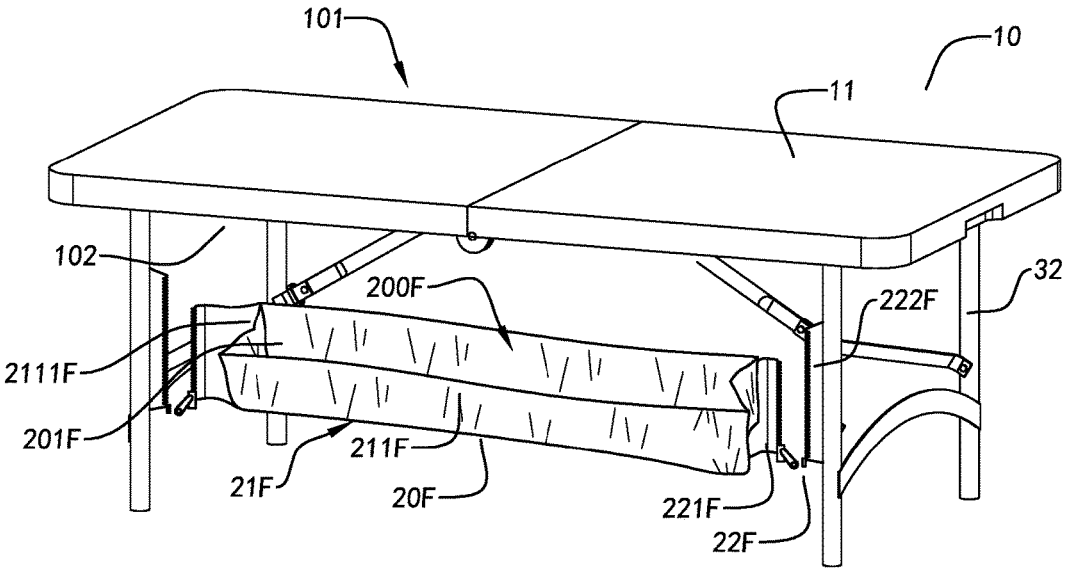
FIG. 6A is a perspective view of the table according to a second preferred embodiment of the present invention, illustrating the receiving device of the table being arranged on the supporter of the table.

As shown in FIG. 6A, the receiving device 20F of the table according to a second preferred embodiment of the present invention comprises a receiving body 21F and at least one connecting element 22F. The receiving body 21F forms the receiving cavity 200F. The connecting element 22F is respectively arranged on the receiving body 21F and the supporter 30 of the table.

It is understandable that the receiving body 21F of the receiving device 20F or the main structure of the receiving device 20F is made of soft material, so that when the receiving device 20F is arranged on the supporter 30, the receiving body 21F of the receiving device 20F will not affect the folding of the supporter 30 and/or the table top 10. Person skilled in the art would understand that the soft material is preferably soft material(s) of cotton, hemp, silk, wool, chemical fiber, etc. The soft material can also be other material suitable for producing the receiving body 21F of the receiving device 20F. Person skilled in the art would understand that the receiving device 20F further comprises a supporting shelf, wherein the receiving body 21F of the receiving device 20F is arranged on the supporting shelf and the supporting shelf is arranged to be able to keep the receiving body 21F in the open state. Preferably, the supporting shelf of the receiving device 20F is a foldable supporting shelf, so that the receiving device 20F can be folded into the folded state.

As shown in FIGS. 6A to 8C, the supporter 30 of the table according to a second preferred embodiment of the present invention, comprises a supporting frame 31 and at least one supporting leg 32. The supporting frame 31 of the supporter 30 is arranged on the bottom surface 12 of the table top 10. The supporting leg 32 of the supporter 30 is arranged on the supporting frame 31 of the supporter 30. As shown in FIGS. 6A to 8C, the supporter 30 further comprises at least two supporting legs 32.

As shown in FIG. 6A, the receiving device 20F of the table according to a second preferred embodiment of the present invention comprises a receiving body 21F and two connecting elements 22F. The receiving body 21F comprises two side walls 211F. Each of the connecting elements 22F comprises a first connector 221F and a second connector 222F. The two side walls 211F of the receiving body 21F are separately arranged and each side wall 211F has two ends 2111F. The first connectors 221F of the connecting elements 22F are respectively arranged on the two ends 2111F of one side wall 211F of the receiving body 21F. The second connector 222F of one connecting element 22F of the two connecting elements 22F of the receiving device 20F is arranged on one supporting leg 32 of the supporter 30, and the second connector 222F of another connecting element 22F is arranged on another supporting leg 32 of the supporter 30. In other words, the receiving device 20F is arranged between two supporting legs 32 of the supporter 30. Besides, when the receiving device 20F is arranged between the two supporting legs 32 of the supporter 30 because the two connecting elements 22F of the receiving device 20F are both arranged on the same side wall 211F of the receiving body 21F of the receiving device 20F, the two side walls 211F of the receiving body 21F of the receiving device 20F will be kept separated under the influence of gravity, so as to cause the receiving body 21F of the receiving device 20F remained opened.

As shown in FIG. 6A, the second connector 222F and the first connector 221F of the connecting element 22F are arranged to be able to detachably connected together, so that the receiving body 21F of the receiving device 20F can be detached or removed from the supporter 30. As shown in FIG. 6A, the connecting element 22F of the receiving device 20F preferably has a zipper structure, wherein the first connector 221F and the second connector 222F of the connecting element 22F can be zipped together. As shown in FIG. 6A, the first connector of the second connector 222F of each connecting element 22F respectively have a toothed chain 2211F or 2221F, such that the connecting element 22F has a zipper structure and the first connector 221F and the second connector 222F of each connecting element 22F can be zipped together. Hence, the connecting type between the first connector 221F and the second connector 222F of the connecting element 22F of the receiving device 20F is zipping type.

Alternatively, the connecting element 22F of the receiving device 20F has a hanger structure, so that the receiving device 20F can be hung on the supporter 30. In other words, the connecting element 22F can be a hanger, so that the receiving body 21F of the receiving device 20F can be detachably hung on the hanger.

Figure 6B:
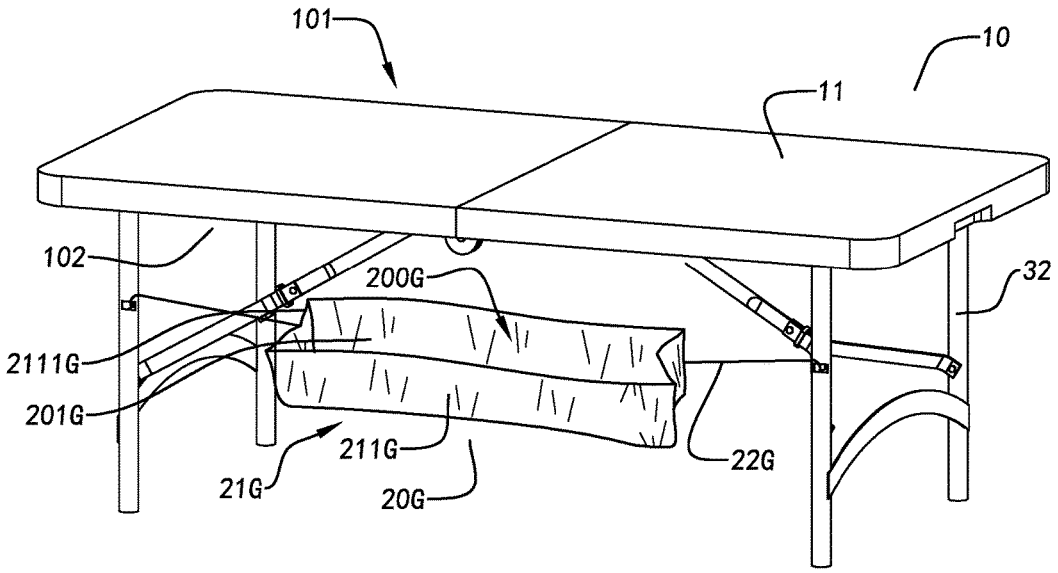
FIG. 6B illustrates an alternative of the receiving device of the table according to the above second preferred embodiment of the present invention.

FIG. 6B of the drawings illustrates an alternative of the receiving device 20F of the table according to the above second preferred embodiment of the present invention. A connecting element 22G of the two connecting elements 22G of the receiving device 20G is respectively arranged on an end portion 2111G of a side wall 211G of the receiving body 21G and a supporting leg 32 of the supporter 30. Another connecting element 22G is respectively arranged on another end portion 2111G of the side wall 211G of the receiving body 21G and another supporting leg 32 of the supporter 30. Therefore, the receiving device 20G is arranged between two supporting legs 32 of the supporter 30. Besides, when the receiving device 20G is arranged between the two supporting legs 32 of the supporter 30 because the two connecting elements 22G of the receiving device 20G are both arranged on the same side wall 211G of the receiving body 21G of the receiving device 20G, the two side walls 211G of the receiving body 21G of the receiving device 20G will be kept separated under the influence of gravity, so as to cause the receiving body 21G of the receiving device 20G remained opened. Preferably, the connecting element 22G of the receiving device 20G has a linear structure, so as to make the connecting element 22G of the receiving device 20G be respectively detachably tied on the two supporting legs 32 of the supporter 30. Alternatively, the first connector 221G and the second connector 222G of the connecting element 22G of the receiving device 20G are respectively band shaped. Therefore, the connecting type of the connecting element 22G of the receiving device 20G and the supporting leg(s) 32 of the supporter 30 is rope tying type.

Figure 6C:
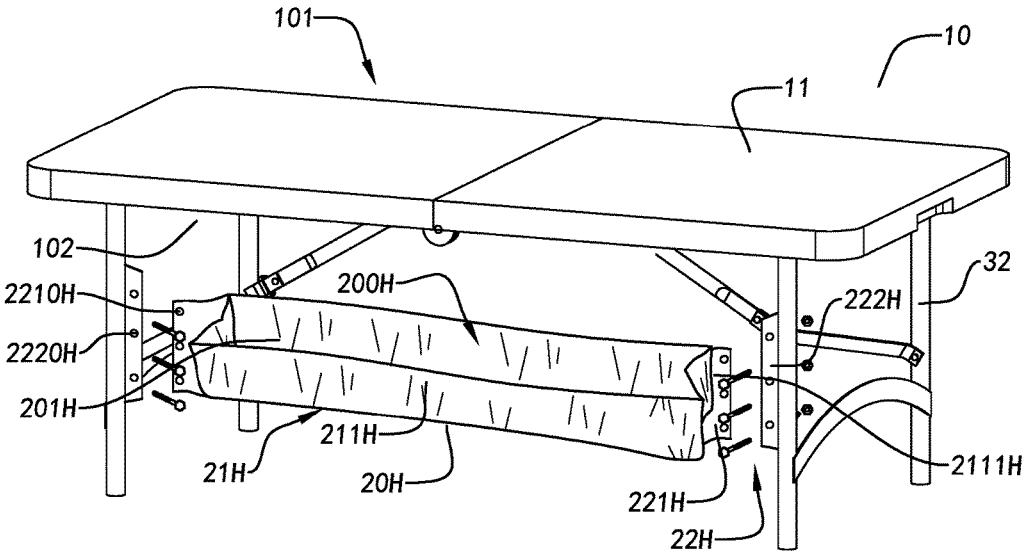
FIG. 6C illustrates another alternative of the receiving device of the table according to the above second preferred embodiment of the present invention.

FIG. 6C of the drawings refers to an alternative of the receiving device 20 of the table according to the above second preferred embodiment of the present invention, wherein the receiving device 20H comprises a receiving body 21H and two connecting elements 22H. The receiving body 21H comprises two side walls 211H. Each of the connecting elements 22H comprises a first connector 221H and a second connector 222H. The two side walls 211H of the receiving body 21H are separately arranged and each side wall 211H has two ends 2111H. The first connectors 221H of the connecting elements 22H are respectively arranged on the two ends 2111H of one side wall 211H of the receiving body 21H. The second connector 222H of one connecting element 22H of the two connecting elements 22H of the receiving device 20H is arranged on one supporting leg 32 of the supporter 30, and the second connector 222H of another connecting element 22H is arranged on another supporting leg 32 of the supporter 30. In other words, the receiving device 20H is arranged between two supporting legs 32 of the supporter 30. Besides, when the receiving device 20H is arranged between the two supporting legs 32 of the supporter 30 because the two connecting elements 22H of the receiving device 20H are both arranged on the same side wall 211H of the receiving body 21H of the receiving device 20H, the two side walls 211H of the receiving body 21H of the receiving device 20H will be kept separated under the influence of gravity, so as to cause the receiving body 21H of the receiving device 20H remained opened.

As shown in FIG. 6C, the second connector 222H and the first connector 221H of the connecting element 22H are arranged to respectively have at least one screw hole 2210H or 2220H, so that the first connector 221H and the second connector 222H can be detachably screwed with each other. Thus, the receiving body 21H of the receiving device 20H can be detached or removed from the supporter 30. As shown in FIG. 6C, the connecting element 22H of the receiving device 20H further comprises at least one screw 223H. The screw 223H can screw the first connector 221H and the second connector 222H through the screw holes 2210H and 2220H thereof. Hence, the connecting type between the first connector 221H and the second connector 222H of the connecting element 22H of the receiving device 20H is screwing connection.

Figure 6D:
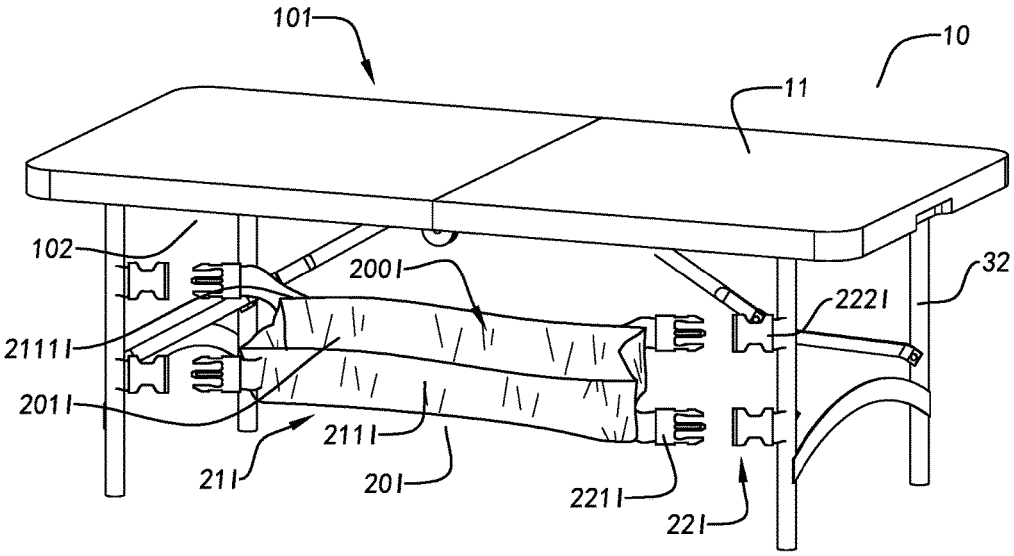
FIG. 6D illustrates another alternative of the receiving device of the table according to the above second preferred embodiment of the present invention.

FIG. 6D of the drawings refers to an alternative of the receiving device 20 of the table according to the above second preferred embodiment of the present invention, wherein the receiving device 20I comprises a receiving body 21I and two connecting elements 22I. The receiving body 21I comprises two side walls 211I. Each of the connecting elements 22I comprises a first connector 221I and a second connector 222I. The two side walls 211I of the receiving body 21I are separately arranged and each side wall 211I has two ends 2111I. The first connectors 221I of the connecting elements 22I are respectively arranged on the two ends 2111I of one side wall 211I of the receiving body 21I. The second connector 222I of one connecting element 22I of the two connecting elements 22I of the receiving device 20I is arranged on one supporting leg 32 of the supporter 30, and the second connector 222I of another connecting element 22I is arranged on another supporting leg 32 of the supporter 30. In other words, the receiving device 20I is arranged between two supporting legs 32 of the supporter 30. Besides, when the receiving device 20I is arranged between the two supporting legs 32 of the supporter 30 because the two connecting elements 22I of the receiving device 20I are both arranged on the same side wall 211I of the receiving body 21I of the receiving device 20I, the two side walls 211I of the receiving body 21I of the receiving device 20I will be kept separated under the influence of gravity, so as to cause the receiving body 21I of the receiving device 20I remained opened.

As shown in FIG. 6D, the second connector 222I and the first connector 221I of the connecting element 22I are arranged to be able to detachably connected together, so that the receiving body 21I of the receiving device 20I can be detached or removed from the supporter 30. As shown in FIG. 6D, the connecting element 22I of the receiving device 20I is a detachable buckle, so as allow the first connector 221I and the second connector 222I of the connecting element 22I to be detachably locked or buckled together. As shown in FIG. 6D, the first connector 221I of the connecting element 22I is arranged to have an engaging end structure of a detachable buckle, wherein the second connector 222I is arranged to have a locking end of a detachable buckle, such that the first connector 221I and the second connector 222I of the connecting element 22I can be locked or buckled together. Alternatively, the first connector 221I of the connecting element 22I is arranged to have a locking end structure of a detachable buckle, wherein the second connector 222I is arranged to have an engaging end of a detachable buckle, such that the first connector 221I and the second connector 222I of the connecting element 22I can be locked or buckled together. Hence, the connecting type between the first connector 221I and the second connector 222I of the connecting element 22I of the receiving device 20I is buckling type.

Figure 6E:
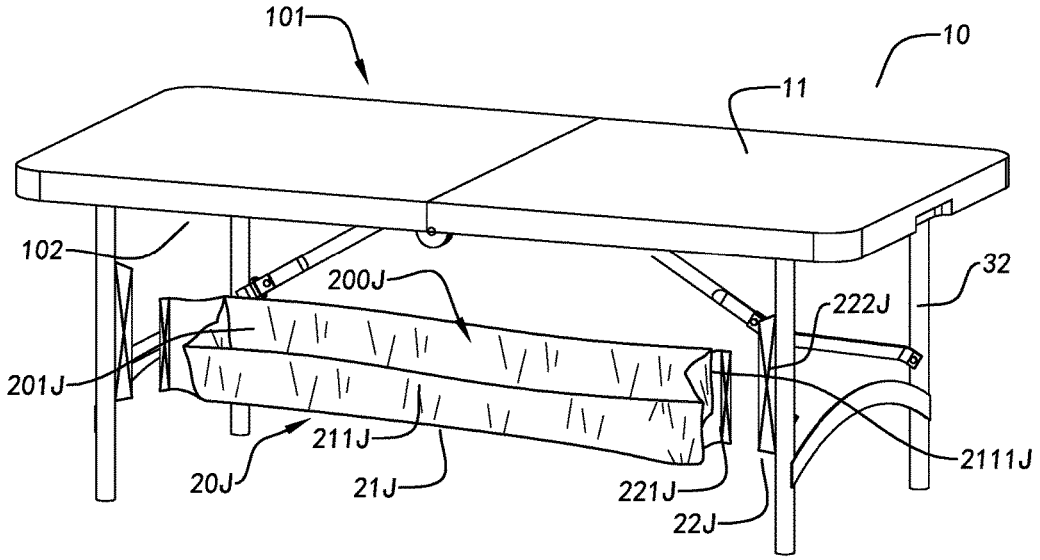
FIG. 6E illustrates another alternative of the receiving device of the table according to the above second preferred embodiment of the present invention.

FIG. 6E of the drawings refers to an alternative of the receiving device 20 of the table according to the above second preferred embodiment of the present invention, wherein the receiving device 20J comprises a receiving body 21J and two connecting elements 22J. The receiving body 21J comprises two side walls 211J. Each of the connecting elements 22J comprises a first connector 221J and a second connector 222J. The two side walls 211J of the receiving body 21J are separately arranged and each side wall 211J has two ends 2111J. The first connectors 221J of the connecting elements 22J are respectively arranged on the two ends 2111J of one side wall 211J of the receiving body 21J. The second connector 222J of one connecting element 22J of the two connecting elements 22J of the receiving device 20J is arranged on one supporting leg 32 of the supporter 30, and the second connector 222J of another connecting element 22J is arranged on another supporting leg 32 of the supporter 30. In other words, the receiving device 20J is arranged between two supporting legs 32 of the supporter 30. Besides, when the receiving device 20J is arranged between the two supporting legs 32 of the supporter 30 because the two connecting elements 22J of the receiving device 20J are both arranged on the same side wall 211J of the receiving body 21J of the receiving device 20J, the two side walls 211J of the receiving body 21J of the receiving device 20J will be kept separated under the influence of gravity, so as to cause the receiving body 21J of the receiving device 20J remained opened.

As shown in FIG. 6E, the second connector 222J and the first connector 221J of the connecting element 22J are arranged to be able to detachably connected together, so that the receiving body 21J of the receiving device 20J can be detached or removed from the supporter 30. As shown in FIG. 6E, the connecting element 22J of the receiving device 20J is a hook and loop fastener or magic tape so as allow the first connector 221J and the second connector 222J of the connecting element 22J to be detachably hook-loop fastened together. As shown in FIG. 6E, the first connector 221J of the connecting element 22J is arranged to have a hook structure of a hook and loop fastener, wherein the second connector 222J is arranged to have a loop structure of a hook and loop fastener, such that the first connector 221J and the second connector 222J of the connecting element 22J can be hook-loop fastened together. Alternatively, the first connector 221J of the connecting element 22J is arranged to have a loop structure of a hook and loop fastener, wherein the second connector 222J is arranged to have a hook structure of a hook and loop fastener, such that the first connector 221J and the second connector 222J of the connecting element 22J can be hook-loop fastened together. Hence, the connecting type between the first connector 221J and the second connector 222J of the connecting element 22J of the receiving device 20J is hook-loop fastening or bonding type.

Figure 6F:
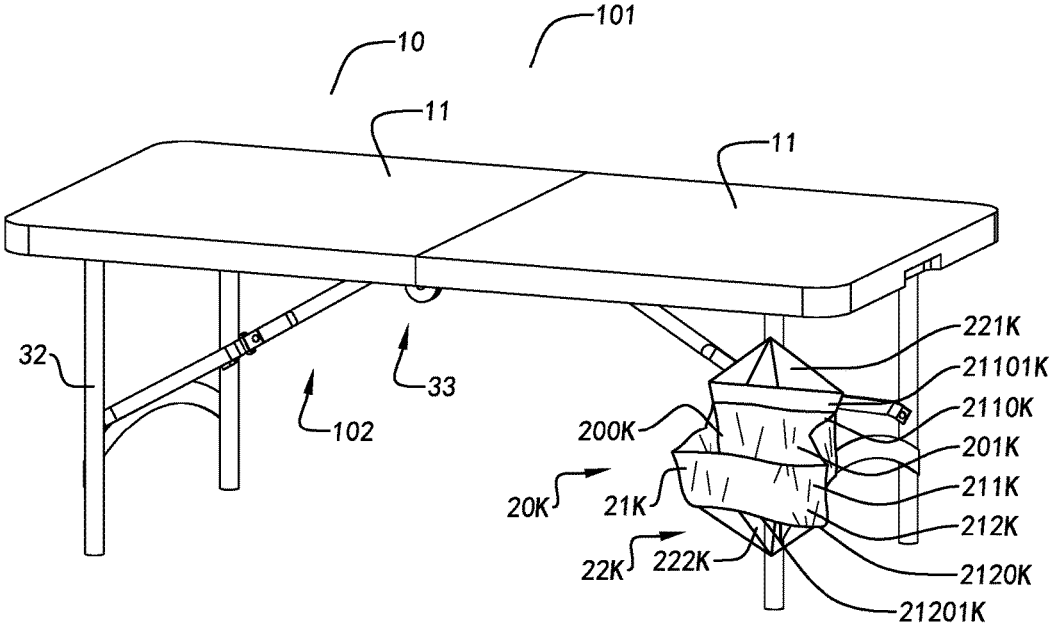
FIG. 6F illustrates another alternative of the receiving device of the table according to the above second preferred embodiment of the present invention.
Figure 7A:
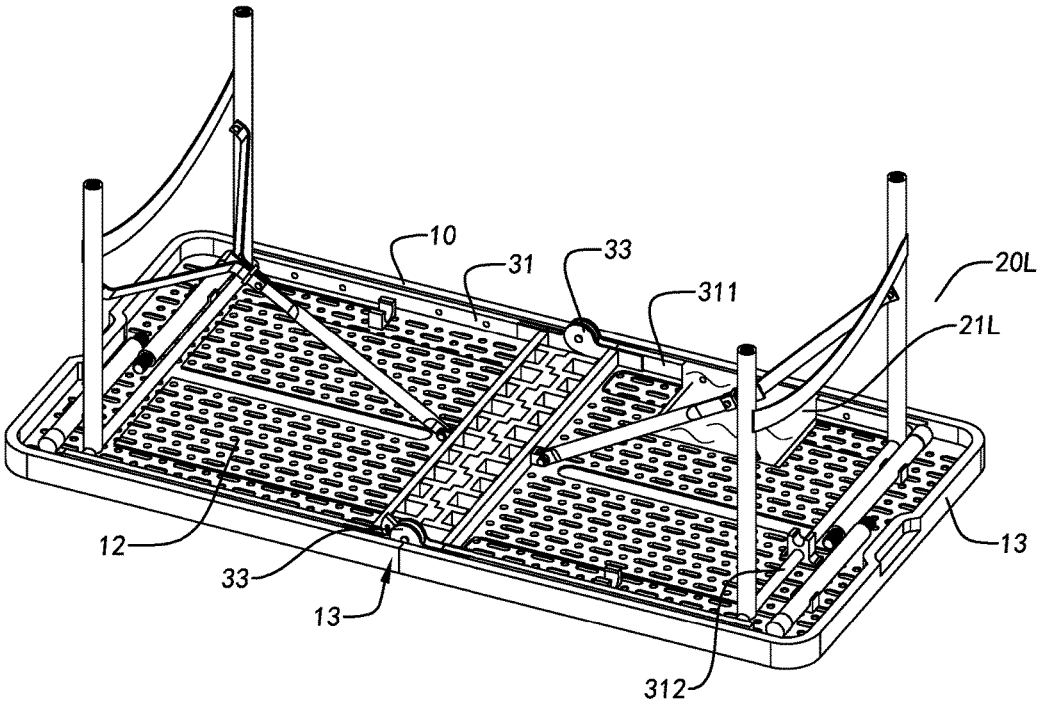
FIG. 7A is a perspective view of the table according to the above second preferred embodiment of the present invention, illustrating the supporter of the table being in an unfolded state and the receiving device of the table being arranged between the supporter of the table and the table top of the table.
Figure 7B:
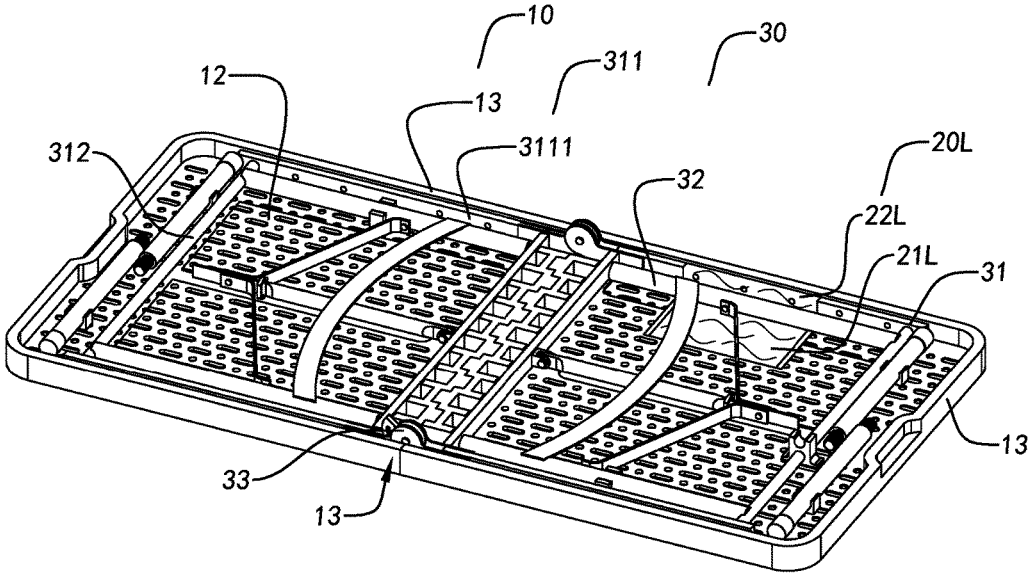
FIG. 7B is a perspective view of the table according to the above second preferred embodiment of the present invention, illustrating the supporter of the table being in a folded state.
Figure 7C:
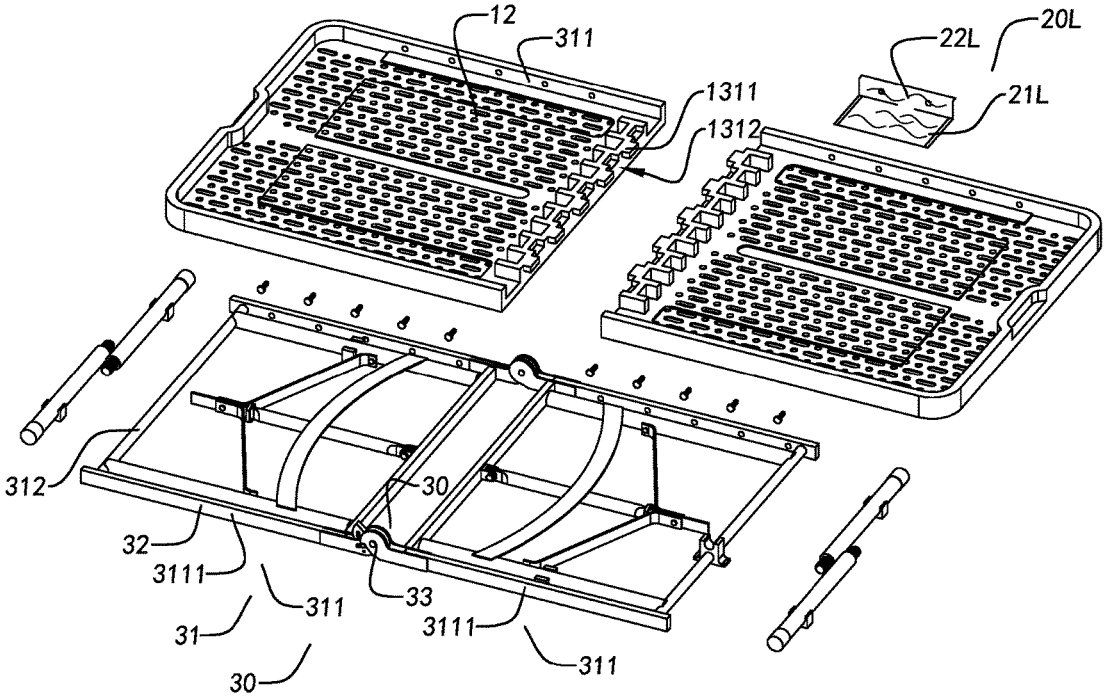
FIG. 7C is an exploded view of the table according to the above second preferred embodiment of the present invention.
Figure 7D:
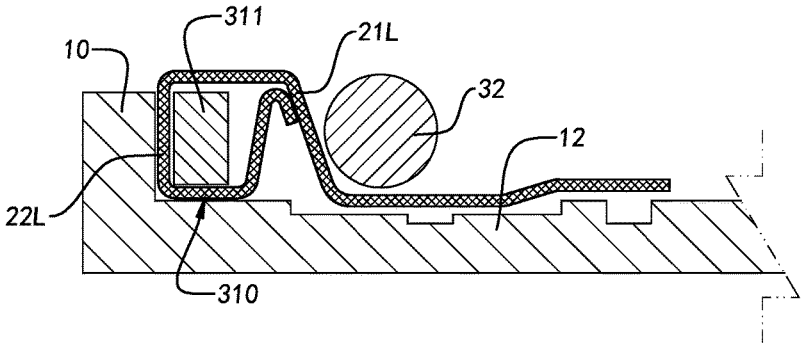
FIG. 7D is a partial sectional view of the table according to the above second preferred embodiment of the present invention.

FIG. 6F of the drawings illustrate an alternative of the receiving device 20 of the table according to the above second preferred embodiment of the present invention, wherein the receiving body 21K of the receiving device 20K comprises an upper end 211K and a lower end 212K extended downwardly from the upper end 211K. The upper end 211K forms an upper end periphery 2110E, and the lower end 212K forms a lower end periphery 2120E. The upper end periphery 2110E forms a receiving opening 201K. The connecting element 22K comprises at least one first connector 221K and at least one second connector 222K. The first connector 221K is arranged on the upper end periphery 2110E of the upper end 211K of the receiving device 20K and is slantly extended upwardly and inwardly from the upper end periphery 2110E to the supporter 30. The second connector 222K is arranged at the lower end periphery 2120E of the lower end 212K of the receiving device 20K and is slantly extended downwardly and inwardly from the lower end periphery 2120E to the supporter 30. Preferably, the first connector 221K is arranged on an inner side 21101K of the upper end periphery 2110E of the upper end 211K of the receiving device 20K, and the second connector 222K is arranged on an outer side 21201K of the lower end periphery 2120E of the lower end 212K of the receiving device 20K, so as to help to keep the receiving device 20K opened. More preferably, the first connector 221K and the second connector 222K of the connecting element 22K of the receiving device 20K are respectively detachably arranged on the upper end periphery 2110E of the upper end 211K of the receiving body 21K of the receiving device 20K and the lower end periphery 2120E of the lower end 212K of the receiving body 21K of the receiving device 20K. The first connector 221K and the second connector 222K of the connecting element 22K of the receiving device 20K can also be respectively and detachably arranged on the supporter 30. Most preferably, the first connector 221K and the second connector 222K of the connecting element 22K of the receiving device 20K are respectively linear. Alternatively, the first connector 221K and the second connector 222K of the connecting element 22K of the receiving device 20K are respectively band shaped.

As shown in FIGS. 6F to 8C, the supporter 30 comprises a supporting frame 31 and a plurality of supporting legs 32. The supporting frame 31 of the supporter 30 is arranged on the bottom surface 12 of the table top 10. Each of the supporting legs 32 is arranged on the supporting frame 31 of the supporter 30. The first connector 221K of the connecting element 22K of the receiving device 20K is respectively arranged on the upper end periphery 2110E of the upper end 211K of the receiving device 20K and one supporting leg 32 of the supporter 30. The second connector 222K is respectively arranged on the lower end periphery 2120E of the lower end 212K of the receiving device 20K and the supporting leg 32 of the supporter 30.

FIGS. 7A to 7D of the drawings illustrates an alternative of the receiving device 20 of the table according to the above second preferred embodiment of the present invention, wherein the receiving device 20L comprises a receiving body 21L and a connecting element 22L extended from the receiving body 21L. The table top 10 of the table and the supporting frame 31 of the supporter 30 form a housing space 310 therebetween. The receiving body 21L of the receiving device 20L is arranged to be foldable and after the receiving body 21L of the receiving device 20L is folded, it can pass the housing space 310, so as to allow the receiving body 21L to be kept in the housing space 310 by the supporting frame 31 of the supporter 30. In other words, the receiving body 21L of the receiving device 20L is arranged on the supporting frame 31 of the supporter 30 and the receiving body 21L can be arranged in the housing space 310 after folded.

As shown in FIGS. 7A to 7D, the connecting element 22L of the receiving device 20L is arranged on the supporting frame 31 of the supporter 30. Preferably, the connecting element 22L of the receiving device 20L is detachably screwed at the supporting frame 31 of the supporter 30. Alternatively, the connecting element 22L of the receiving device 20L is fixedly arranged on the supporting frame 31 of the supporter 30. More preferably, the receiving body 21L of the receiving device 20L can be detachably arranged through zipper zipping, roping, buckling, hook and loop fastening, etc.

As shown in FIGS. 7A to 7D, the supporter 30 of the table according to the above second preferred embodiment of the present invention, comprises a supporting frame 31 arranged on the bottom surface 12 of the table top 10 and at least two supporting legs 32 respectively arranged on the supporting frame 31 of the supporter 30. The supporting legs 32 are respectively arranged to pivot with respect to each other to the bottom surface 12 of the table top 10, so that the supporting legs 32 can be folded on the bottom surface 11 of the table top 10. In other words, the supporter 30 of the table is a foldable supporter.

As shown in FIGS. 7A to 7D, the supporting frame 31 of the supporter 30 comprises two transverse members 311 separately arranged on the bottom surface 12 of the table top 10 and two longitudinal members 312 separately arranged between the two transverse members, wherein each longitudinal member 312 is pivotally arranged between the transverse members 311 of the supporting frame 31, wherein the supporting leg(s) 32 of the supporter 30 is respectively arranged on the two longitudinal members 312 of the supporting frame 31, so as to allow the supporting leg(s) 32 of the supporter 30 be arranged to be pivotally with respect to the bottom surface 12 of the table top 10.

Figure 9A:
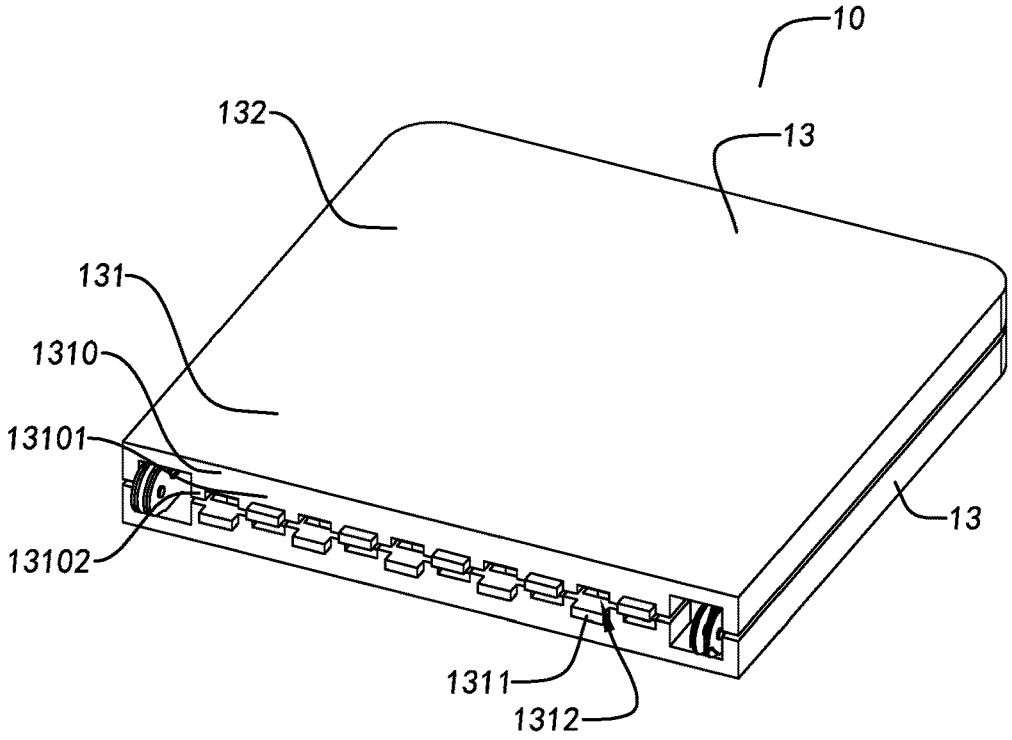
FIG. 9A is a perspective view of the table top of the table according to the above second preferred embodiment of the present invention, illustrating the table top of the table being in a folded state.
Figure 9B:
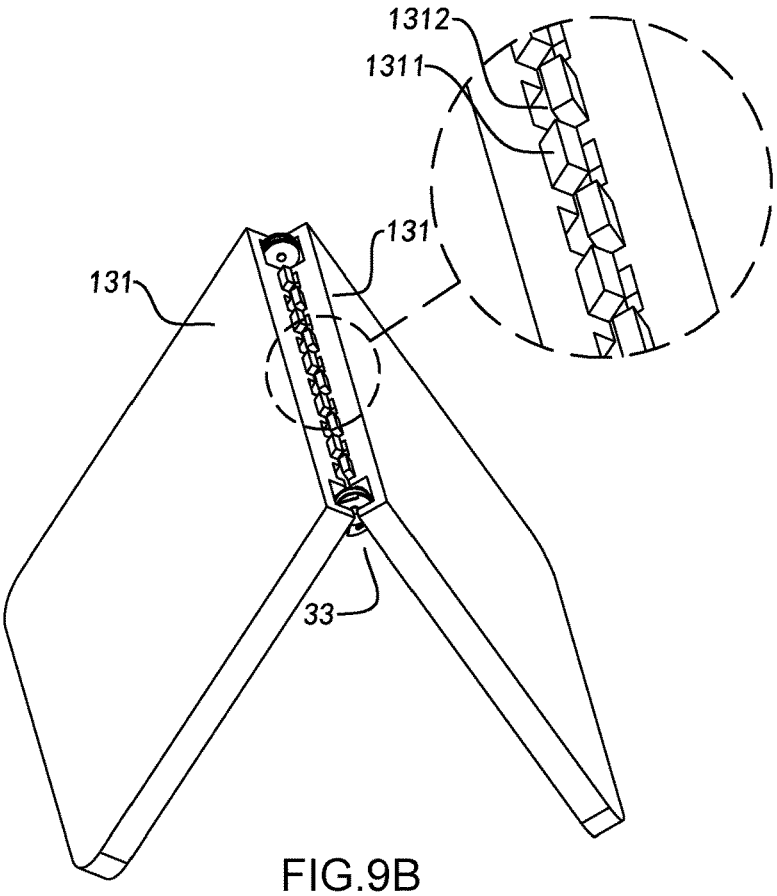
FIG. 9B is a perspective view illustrating the connection relationship of two pivoting portions of the table top of the table according to the above second preferred embodiment of the present invention.
Figure 9C:
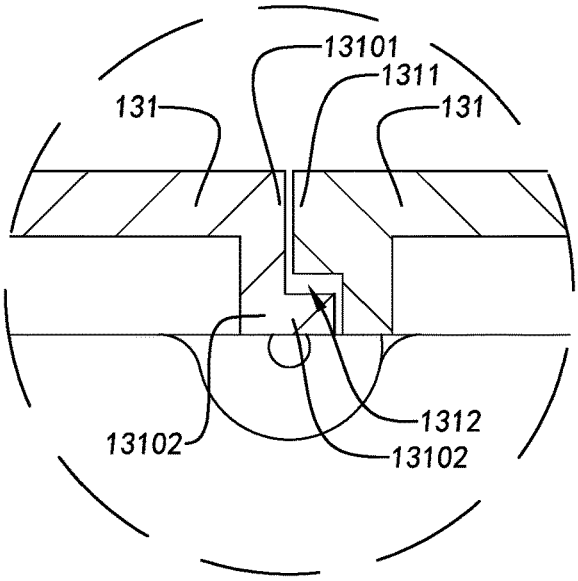
FIG. 9C is a partial sectional view of the table top of the table according to the above second preferred embodiment of the present invention.

As shown in FIGS. 9A to 9C, the table top 10 of the table, according to the above second preferred embodiment of the present invention, comprises two pivoting portions 13, wherein the two pivoting portions 13 of the table top 10 are arranged to be pivotally relatively movable, so that the table top 10 can be folded to occupy a smaller space and be unfolded to form the table surface 11 of the table top 10.

Figure 8A:
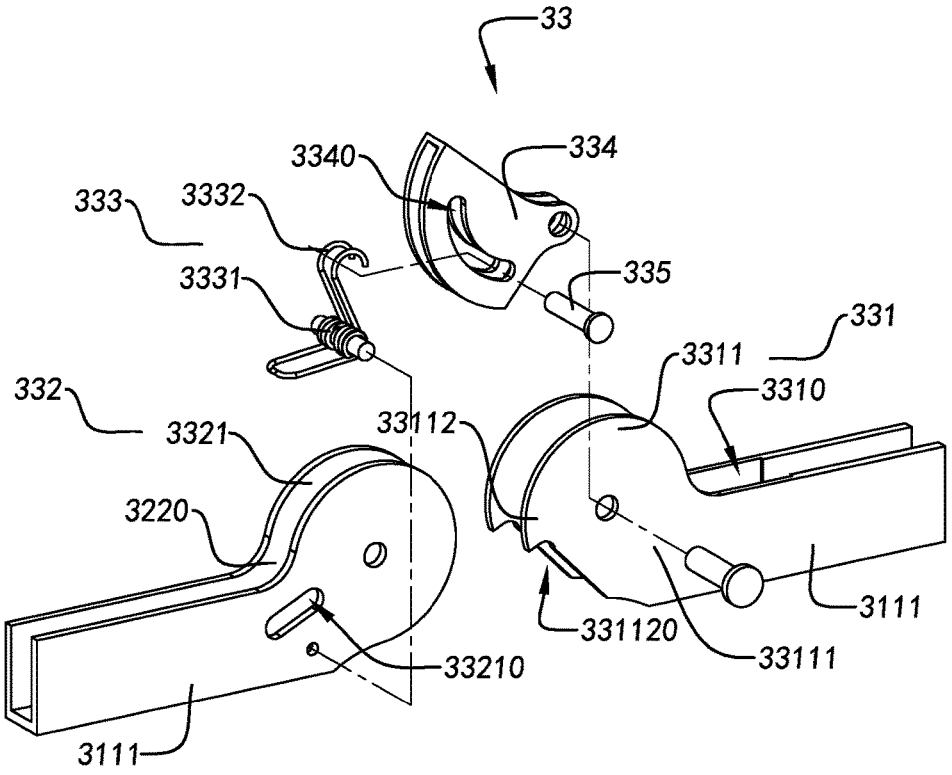
FIG. 8A is an exploded view of the locker of the table according to the above second preferred embodiment of the present invention.
Figure 8B:
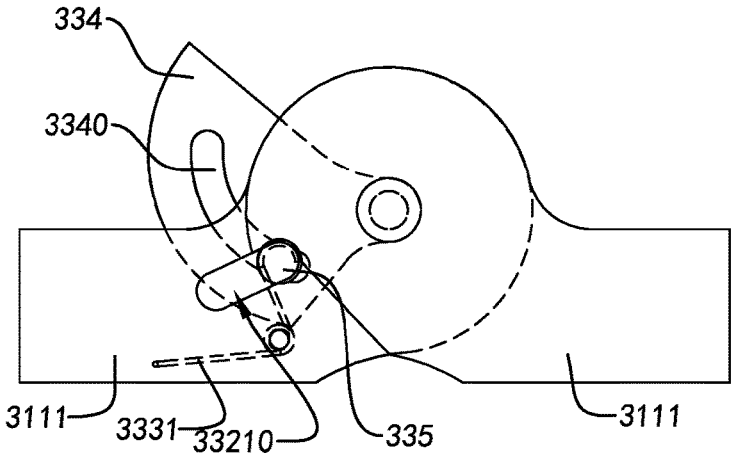
FIG. 8B illustrates the transverse member of the table according to the above second preferred embodiment of the present invention being kept unfolded by the locker.
Figure 8C:
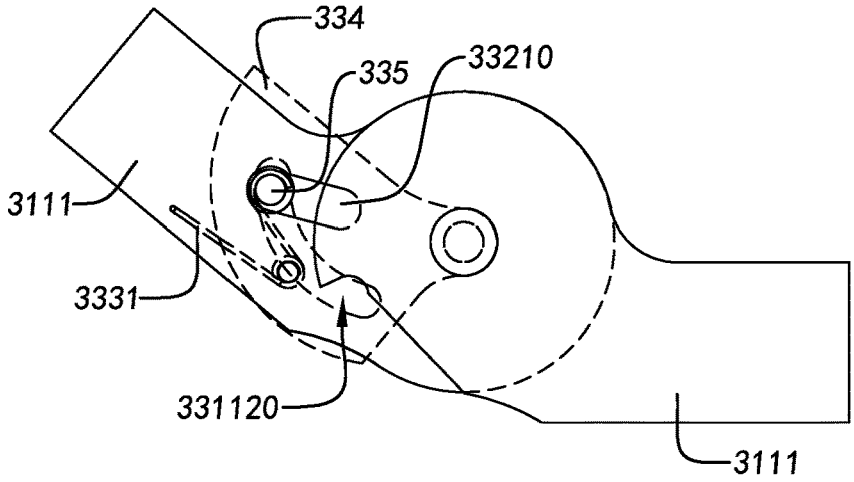
FIG. 8C illustrates the locker of the table allowing the transverse member of the supporter of the table to be folded according to the above second preferred embodiment of the present invention.

As shown in FIGS. 8A to 8C, the supporter 30 further comprises two lockers 33. Each transverse member 311 of the supporting frame 31 of the supporter 30 comprises two supporting elements 3111. Each locker 33 is arranged between the two supporting elements 3111 of the transverse member 311 of the supporting frame 31 of the supporter 30. The locker 33 is arranged to allow the two supporting elements 3111 of the transverse member 311 of the supporting frame 31 to pivot with respect to each other.

As shown in FIGS. 8A to 8C, each locker 33 of the supporter 30 is arranged to have a locked state and an unlocked state. When the locker 33 is in the locked state, the locker 33 can prevent the two supporting elements 3111 of the transverse member 311 to pivot with respect to each other, and when the locker 33 is in the unlocked state, the locker 33 allows the two supporting elements 3111 to freely pivot with respect to each other. Person skilled in the art would understand that because the supporting frame 31 of the supporter 30 is arranged on the bottom surface 12 of the table top 10, when the locker 33 is set in the locked state, the two pivoting portions 13 of the table top 10 will be kept unfolded and opened to form the table surface 11. When the locker 33 is set in the unlocked state, the locker 33 will allow the two supporting elements 3111 of the transverse member 311 to pivot with respect to each other and allow the two pivoting portions 13 of the table top 10 to pivot with respect to each other.

As shown in FIGS. 8A to 8C, the locker 33 of the supporter 30 of the table according to the above second preferred embodiment of the present invention, comprises a first locking unit 331, a second locking unit 332, a holder 333, an operating portion 334, and a locking member 335.

As shown in FIGS. 8A to 8C of the drawings, the first locking unit 331 comprises two first walls 3311. The second locking unit 332 comprises two second walls 3321. The two first walls 3311 of the first locking unit 331 respectively extends outwardly from a supporting element 3111 of the transverse member 311. The two second walls 3321 of the second locking unit 332 respectively extends outwardly from another supporting element 3111 of the transverse member 311. The two first walls 3311 of the first locking unit 331 are separately arranged to form a first mounting groove 3310 therebetween. The two second wall 3321 of the second locking unit 332 are separately arranged to form a second mounting groove 3320 therebetween. Each of the first wall 3311 comprises an extending portion 33111 extended from the supporting element 3111 of the transverse member 311 and a locking portion 33112 extended from extending end 33111. The locking portion 33112 forms a locking groove 331120. Each second wall 3321 of the second locking unit 332 have a first guiding groove 33210 extended upwardly and outwardly. The operating portion 334 has a curvingly extended second guiding groove 3340. The second locking unit 332 is arranged at the first mounting groove 3310 of the first locking unit 331. The operating portion 334 is arranged at the second mounting groove 3320 of the second locking unit 332. The first guiding groove 33210 of the second wall 3321, the second guiding groove 3340 of the operating portion 334, and the locking groove 331120 of the first wall 3311 are coincided, so as to allow the locking member 335 to penetrate the first guiding groove 33210 of the second wall 3321, the second guiding groove 3340 of the operating portion 334, and the locking groove 331120 of the first wall 3311. The holder 333 is arranged in the second mounting groove 3320 and extended to the locking member 35. Besides, the holder 333 is allowed to keep the locking member 335 in the second guiding groove 2240. In other words, the locker 33 of the supporter 30 comprises a first locking unit 331, a second locking unit 332, a holder 333, an operating portion 334, and a locking member 335. The first locking unit 331 has a first mounting groove 3310 and a locking groove 331120. The two locking units 332 have a second mounting groove 3320 and a first guiding groove 33210. The operating portion 334 has a curvingly extended second guiding groove 3340. The second locking unit 332 is arranged at the first mounting groove 3310 of the first locking unit 331. The operating portion 334 is pivotally arranged at the second mounting groove 3320 of the second locking unit 332. The first guiding groove 33210 of the second wall 3321, the second guiding groove 3340 of the operating portion 334, and the locking groove 331120 of the first wall 3311 are coincided, so as to allow the locking member 335 to penetrate the first guiding groove 33210 of the second wall 3321, the second guiding groove 3340 of the operating portion 334, and the locking groove 331120 of the first wall 3311. The holder 333 is allowed to keep the locking member 335 in the locking groove 331120.

As shown in FIGS. 8A to 8C, the holder 333 of the locker 33 of the supporter 30 comprises a fixing end 3331 and a retaining end 3332 extended from the fixing end 3331. The retaining end 3332 is arranged at the locking member 335 of the locker 33 of the supporter 30 and is allowed to hold the locking member 335 at a proper position, such that the locking member 335 will still be kept at the second guiding groove 3340 of the operating portion 334. Preferably, the retaining end 3332 of the holder 333 is a resilient element, so as to provide a resilience to constantly keep the locking member 335 in the locking groove 331120 of the second locking unit 332 when the transverse member 31 is in an unfolded state.

Person skilled in the art would understand that the locker 33 of the supporter 30 is arranged for the following mechanism. On one hand, when the transverse member 311 of the supporter 30 is to be unfolded, the second locking unit 332 will be arranged in the first mounting groove 3310 of the first locking unit 331, the operating portion 334 will be arranged in the second mounting groove 3320 of the second locking unit 332, and the first guiding groove 33210 of the second wall 3321, the second guiding groove 3340 of the operating portion 334, and the locking groove 331120 of the first wall 3311 will be coincided. Thus, the locking member 335 can be arranged to penetrate the first guiding groove 33210 of the second wall 3321, the second guiding groove 3340 of the operating portion 334, and the locking groove 331120 of the first wall 3311 at the same time. Therefore, the locking member 335 will constantly be kept in the locking groove 331120 of the second locking unit 332. On the other hand, when the transverse member 311 of the supporter 30 is to be folded, the second locking unit 332 will drive the locking member 335 to move upwardly along the second guiding groove 3340 of the operating portion 334 and drive the operating portion 334 to pivot with respect to each other to the first locking unit 331, so as to make the transverse member 311 of the supporting frame 31 of the supporter 30 be folded. Person skilled in the art would understand that when the supporting frame 31 of the supporter 30 of the table is foldable, the foldable table top 10 of the table can be correspondingly folded as well.

As shown in FIGS. 9A to 9C, the table top 10 of the table, according to the above second preferred embodiment of the present invention, comprises two pivoting portions 13, wherein the two pivoting portions 13 of the table top 10 are arranged to be pivotally relatively movable, so that the table top 10 can be folded to occupy a smaller space and be unfolded to form the table surface 11 of the table top 10.

As shown in FIGS. 7A to 7D, the two pivoting portions 13 of the table top 10 is respectively arranged on the two supporting elements 3111 of each of the transverse members 311 of the supporting frame 31 of the supporter 30. The two supporting elements 3111 of each of the transverse members 311P of the supporting frame 31 of the supporter 30 are arranged to pivot with respect to each other, so that the two pivoting portions 13 of the table top 10 can be relatively pivotally moved.

As shown in FIGS. 9A to 9C, each of pivoting portions 13 of the table top 10 comprises an engaging end 131 and a lengthening portion 132 extended outwardly from the engaging end 131. The engaging end 131 of each of pivoting portions 13 of the table top 10 comprises a plurality of engaging teeth 1311 and has a plurality of engaging holes 1312. The engaging teeth 1311 and the engaging holes 1312 of the engaging end 131 are interlacedly arranged, so that when the table top 10 is unfolded, the engaging ends 131 of the two pivoting portions 13 of the table top 10 can mutually engage each other, so as to enhance the intensity and loading capacity of the table top 10.

As shown in FIGS. 9A to 9C, the engaging end 131 of the pivoting portion 13 of the table top 10 has an outer wall 1310. The outer wall 1310 has an upper end portion 13101 and a lower end portion 13102 extended downwardly from the upper end portion 13101. The engaging teeth 1311 and the engaging holes 1312 of the engaging end 131 are respectively interlacedly aligned with each other on the upper end portion 13101 and the lower end portion 13102 of the outer wall 1310 of the engaging end 131. The engaging teeth 1311 and the engaging holes 1312 of the engaging ends 131 of the two pivoting portions 13 of the table top 10 are arranged to correspond to each other, such that the upper end portions 13101 of the outer walls 1310 of the engaging ends 131 of the two pivoting portions 13 of the table top 10 can mutually engage each other and the lower end portions 13102 of the outer walls 1310 of the engaging ends 131 of the two pivoting portions 13 of the table top 10 can also mutually engage each other, which enhances the intensity and loading capacity of the table top 10.

It should be noted that when the engaging ends 131 of the two pivoting portions 13 of the table top 10 are mutually engaged with each other, the two pivoting portions 13 of the table top 10 will form the table surface 11 of the table top 10 and the table surface 11 is a flat table surface.

As shown in FIGS. 11 to 14 of the drawings of the specification of the present invention, a table according to a third preferred embodiment of the present invention is illustrated. The table comprises two panel units 10 pivotally connected with each other, two leg units 20 respectively arranged on the panel units 10, and at least one receiving device 30M respectively arranged on the panel units 10. Each panel unit 10 comprises a panel body 11 and a supporter 12. The panel body 11 has a top surface 111 and a bottom surface 112. The supporter 12 is arranged on the bottom surface 112 of the panel body 11. The panel units 10 are arranged to allow the panel bodies 11 of the panel units 10 to form a table surface when the panel units 10 are both pivoted to the horizontal position. The leg units 20 are respectively arranged on the supporters 12 of the two panel units 10 and are arranged to be able to support the supporters 12 and allow the supporters 12 to support and keep the two panel units 10 of the table being horizontally placed, so as to form the horizontal table surface and allow objects to be stably placed on the table surface.

Figure 11:
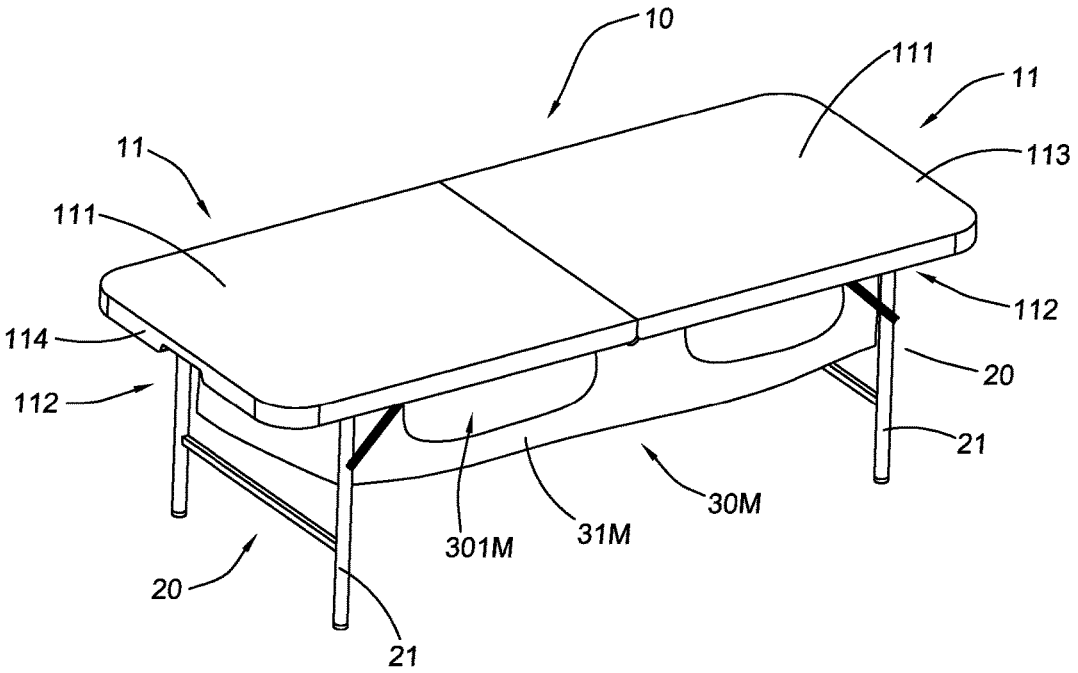
FIG. 11 is a perspective view of the table according to a third preferred embodiment of the present invention, wherein the table is in an unfolded state.
Figure 12:
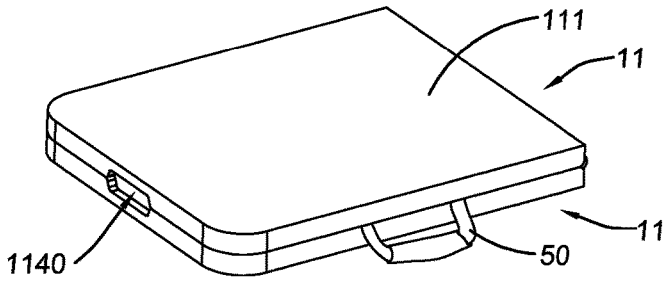
FIG. 12 is a perspective view of the table according to the above third preferred embodiment of the present invention, wherein the table is in a folded state.
Figure 13:
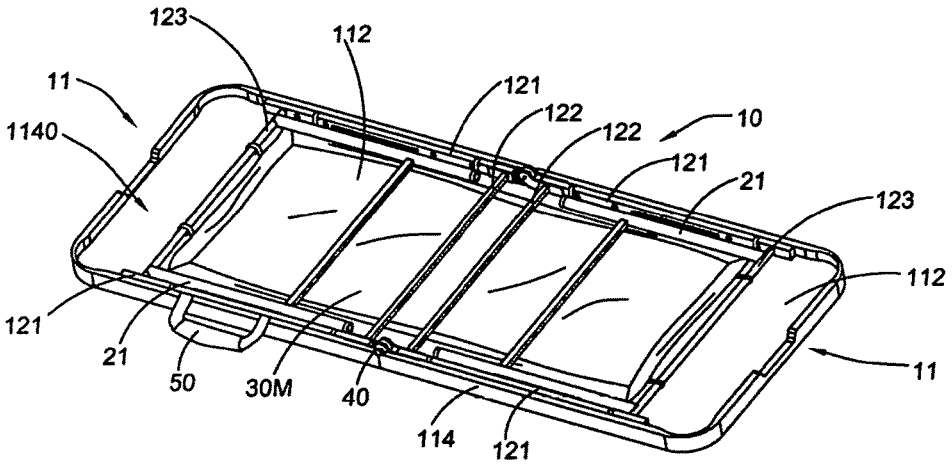
FIG. 13 is a bottom view of the table according to the above third preferred embodiment of the present invention, wherein the supporting legs of the table are folded onto the bottom of the table top of the table.

As shown in FIGS. 11 to 13 of the drawings, the panel bodies 11 of the two panel units 10 of the table according to the above third preferred embodiment of the present invention are pivotally connected with each other, such that when the two panel units 10 of the table are horizontally placed, the top surfaces 111 of the panel bodies 11 of the two panel units 10 can form the table surface of the table.

As shown in FIG. 13 of the drawings, the table according to the above third preferred embodiment of the present invention further comprises two pivoting portions 40. Each of pivoting portions 40 is respectively arranged on each panel body 11 of the panel unit 10, such that the two panel units 10 can be pivotally connected.

As shown in FIGS. 12 to 13 of the drawings, the table according to the above third preferred embodiment of the present invention further comprises a handle 50. The handle 50 is arranged on a lateral strut 121 of the supporter 12 of the panel unit 10 of the table and is extended outwardly from the lateral strut 121, such that when the two panel units 10 of the table are folded together, the handle 50 is adapted to be grasped by the user to lift the entire folded table.

Figure 14:
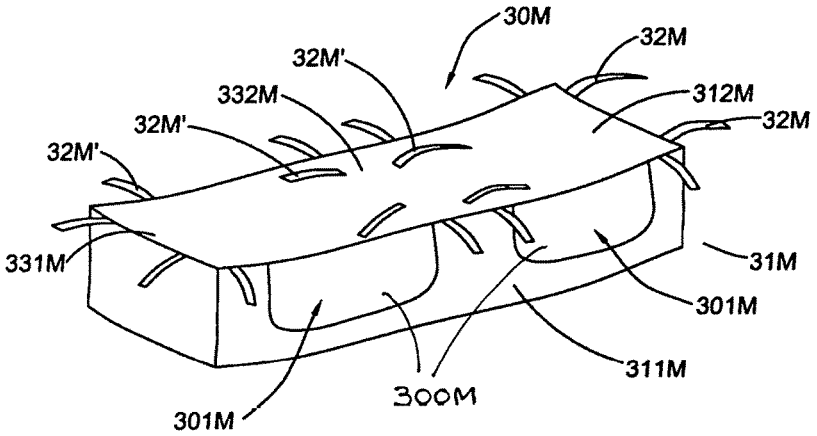
FIG. 14 illustrates a perspective view 14 a receiving device of the table according to the above third preferred embodiment of the present invention.

As shown in FIG. 14 of the drawings, the receiving device 30M of the table according to the above third preferred embodiment of the present invention comprises a receiving portion 31M and a plurality of connectors 32M respectively arranged on the receiving portion 31M. The receiving portion 31M of the receiving device 30M is made of soft material. The connectors 32M are respectively arranged on the supporters 12 of the two panel units 10, so as to fix the receiving device 30M on the supporters 12 of the panel units 10, such that when the two panel units 10 of the table are horizontally placed, the receiving portion 31M of the receiving device 30M can be stretched below the panel unit 10 to form a receiving cavity 300M for receiving objects. When the two panel units 10 of the table are folded, the receiving portion 31M of the receiving device 30M can be folded between the two panel units 10.

As shown in FIG. 13 of the drawings, the supporter 12 of each panel unit 10 of the table according to the above third preferred embodiment of the present invention comprises two lateral struts 121 separately and laterally arranged on the bottom surface 112 of the panel body 10 of the panel unit 10, a first longitudinal strut 122, and a second longitudinal strut 123. The first longitudinal strut 122 and the second longitudinal strut 123 are spacedly arranged between the lateral strut 121 of the supporter 12. The second longitudinal strut 123 is pivotally arranged on the lateral strut 121. The two supporting legs 21 of each leg unit 20 are respectively arranged on the second longitudinal strut 123 of the supporter 12 of the panel unit 10, such that the supporting legs 21 are respectively pivotally arranged on the supporter 12 of the panel unit 10 and the two supporting legs 21 of the leg unit 20 are allowed to be folded onto the bottom surface 112 of the panel body 11 of the panel unit 10. Preferably, each supporting leg 21 of the leg units 20 of the table is arranged to be able to be placed between the first longitudinal strut 122 and the second longitudinal strut 123 of the supporter 12 of the panel unit 10 thereof when the supporting leg 21 is folded onto the bottom surface 112 of the panel body 11 of the panel unit 10.

As shown in FIG. 14, the connectors 32M of the receiving device 30M of the table according to the above third preferred embodiment of the present invention are preferably magic tapes. Person skilled in the art would understand that each the connector 32M can be a zipper, a (strip of) rope, a buckle, or a hook and loop fastener, so as to detachably arrange the receiving portion 31M of the receiving device 30M on the supporter(s) 12 of the panel unit(s) 10. Alternatively, the connectors 32M of the receiving device 30M can be other connecting mechanisms that can detachably fix the receiving device 30M on the supporter(s) 12 of the panel unit(s) 10.

As shown in FIG. 14 of the drawings, when the receiving portion 31M of the receiving device 30M is stretched, the receiving portion 31M of the receiving device 30M can form the a receiving cavity 300M that has a receiving opening 301M to allow the user to put objects into the receiving cavity 300M through the receiving opening 301M. It is understandable that because the receiving portion 31M of the receiving device 30M is made of soft material, when the receiving device 30M is arranged below the table and the two panel units 10 of the table are horizontally placed, the user can stretch the receiving portion 31M of the receiving device 30M and make the receiving portion 31M stretched into the receiving cavity 300M without using any additional tool.

As shown in FIGS. 13 and 14 of the drawings, the receiving portion 31M of the receiving device 30M is in an unfolded state and forms the receiving cavity 300M. When the receiving portion 31M is unfolded, the receiving opening 301M of the receiving portion 31M will be opened as well, such that the user can place objects into the receiving cavity 300M of the receiving portion 31M of the receiving device 30M. When the receiving portion 31M of the receiving device 30M is in a folded state, the receiving portion 31M of the receiving device 30M can be folded on the bottom surface 112 of the panel body 11 of the panel unit 10 of the table.

As shown in FIG. 14 of the drawings, the receiving device 30M of the table according to the above third preferred embodiment of the present invention further comprises an upper cover 33. The upper cover 33 is made of soft material, so that the upper cover 33 can be folded along with the receiving portion 31M of the receiving device 30M onto the bottom surface 112 of the panel body 11 of the panel unit 10. Preferably, the receiving device 30M further comprises a plurality of connectors 32M' arranged on the upper cover 33. The connectors 32M' are respectively arranged on a periphery 331 of the upper cover 33 and a cover body 332 extended within the periphery 331, so as to allow the connectors 32M' of the receiving device 30M to be respectively fixed on the first longitudinal strut 122 and the second longitudinal strut 123 of the supporters 12 of the panel units 10. More preferably, the upper cover 33 and the receiving portion 31M of the receiving device 30M are fixedly connected, so as to allow the receiving portion 31M to be fixed on the supporter 12 of the panel unit 10 through the upper cover 33.

As shown in FIGS. 12 and 13 of the drawings, the panel body 11 of each panel unit 10 of the table according to the above third preferred embodiment of the present invention comprises a main portion 113 and a fixing portion 114 extended downwardly from the edge of the main portion 113, wherein when the panel units 10 are folded together, each lateral strut 121 of the supporters 12 of the panel units 10 is fixed at the fixing portion 114, so as to allow all the supporters 12 of the panel units 10 and the leg units 20 of the table to be hidden in the receiving groove 1140 formed by the fixing portion 114 of the panel body 11 of the panel unit 10 when the two panel unit 10 of the table are folded together. It is understandable that when the receiving portion 31M of the receiving device 30M is folded on the bottom surface 112 of the panel body 11 of the panel unit 10 of the table, the receiving portion 31M of the receiving device 30M of the bottom surface 112 of the panel body 11 that is folded does not affect the folding of the panel unit 10 and the hiding of the leg unit into the receiving groove 1140 formed by the panel unit 10. Preferably, the fixing portion 114 predeterminedly has mounting hole(s) or other mounting mechanisms, so as to allow the supporter 12 of the panel unit 10 of the table to be fixed on the fixing portion 114 of the panel body 11.

It should be noted that the panel bodies 11 of the panel units 10 of the table according to the above third preferred embodiment of the present invention can be made of plastic material. Therefore, the panel bodies 11 of the panel units 10 can be molded by blow molding or injection molding. Hence, the fixing portions 114 of the panel bodies 11 of the panel units 10 of the table and the main portions 113 of the panel bodies 11 of the panel units 10 of the table are formed together by blow molding or injection molding to form an integral structure. In other words, the fixing portion 114 can be considered as a part of the main portion 113 of the panel body 11 of the panel unit 10. Preferably, the panel body 11 of the panel unit 10 is formed through blow molding. Alternatively, the main portions 113 of the panel bodies 11 of the panel units 10 are hiddenly arranged on the bottom surfaces 112 of the panel bodies 11 of the panel units 10. As shown in FIGS. 11 to 14 of the drawings, when the leg units 20 are unfolded or opened, the leg units 20 can support the supporters 12 of the panel units 10 and allow the supporters 12 to support the panel units 10 and keep the panel bodies 11 of the panel units 10 in a horizontal condition. When the leg units 20 are folded, the leg units 20 can be received to the bottom surfaces 112 of the panel bodies 11 of the panel units 10. In other words, the supporters 12 are arranged to be able to support the panel bodies 11 of the panel units 10, so as to keep the panel bodies 11 of the panel units 10 horizontal. Preferably, the top surfaces 111 of the panel bodies 11 of the panel unit 10 is flat.

Figure 15:
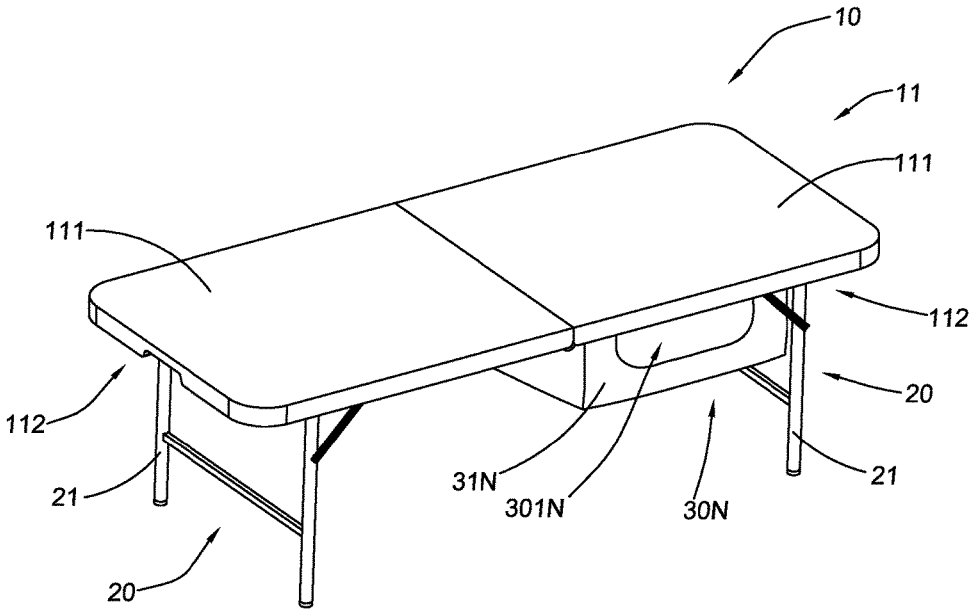
FIG. 15 illustrates a perspective view of the table according to an alternative of the above third preferred embodiment of the present invention.
Figure 16:
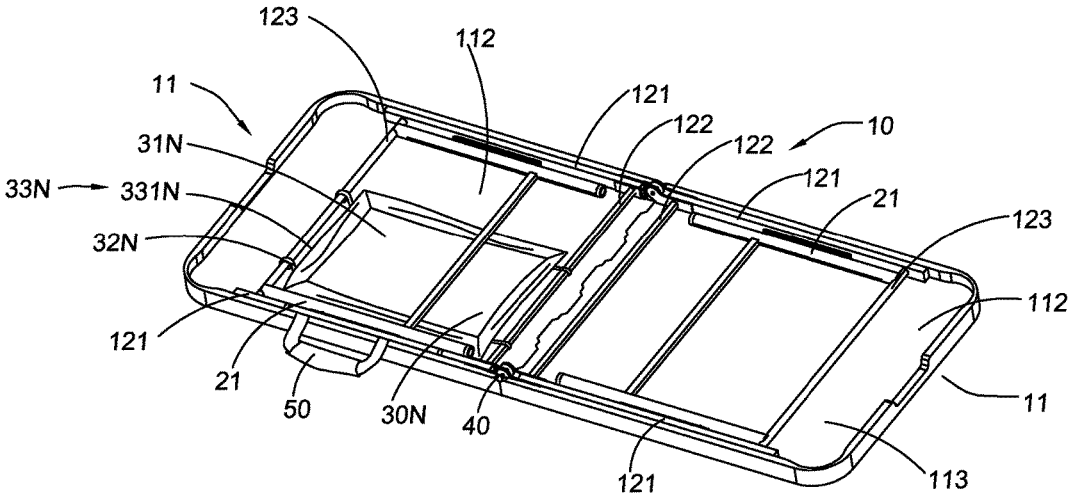
FIG. 16 is a bottom view of the table according to the above alternative of the above third preferred embodiment of the present invention, wherein the supporting legs of the table are folded onto the bottom of the table top of the table.

FIGS. 15 and 16 of the drawings illustrates an alternative of the receiving device 30M of the table according to the above third preferred embodiment of the present invention. The receiving device 30N is arranged on a panel unit 10 of the table. The connectors 32N of each receiving device 30N are respectively arranged on the first longitudinal strut 122 and the second longitudinal strut 123 of the supporter 12 of the corresponding panel unit 10 of the table. It is understandable that when the panel unit 10 of the table is horizontally placed, the receiving portion 31N of the receiving device 30N can be stretched below the panel body 11 of the panel unit 10. Further, the table comprises a plurality of receiving devices 30N respectively arranged on the bottom surface(s) 112 of the panel body(ies) 11 of the panel unit(s) 10 of the table. Each receiving device 30N is arranged and fixed on the supporter 12A of the panel unit 10 of the table.

Figure 17:
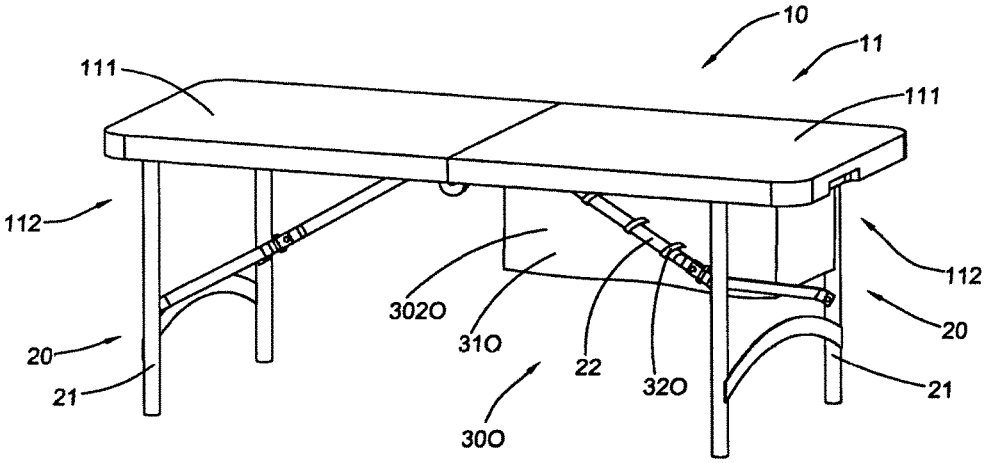
FIG. 17 illustrates another alternative of the table according to the above third preferred embodiment of the present invention.
Figure 18:
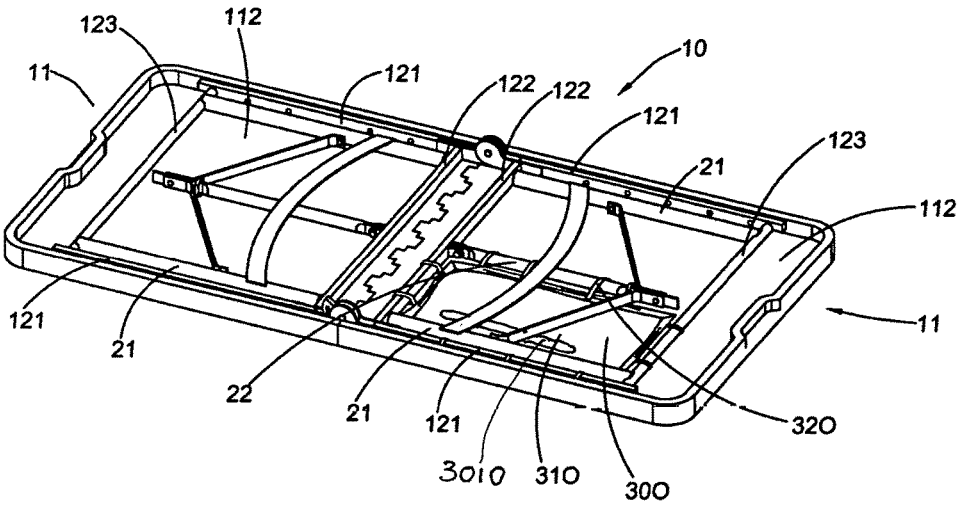
FIG. 18 is a bottom view of the table according to the above alternative of the above third preferred embodiment of the present invention, wherein the supporting legs of the table are folded onto the bottom of the table top of the table.

FIGS. 17 and 18 of the drawings illustrate an alternative of the receiving device 30M of the table according to the above third preferred embodiment of the present invention. The receiving device 300 comprises a receiving portion 310 and a plurality of connectors 320 arranged on the receiving portion 310. The receiving portion 310 has at least one receiving opening 3010 and a side wall 3020 opposite to the receiving opening 3010. The connectors 320 are arranged on the side wall 3020 of the receiving portion 310 and the connectors 320 are adapted to be detachably fixed on a holder 22 of a leg unit 20 of the table. It is understandable that the holder 22 of the leg unit 20 is arranged between the supporting leg 21 of the leg unit 20 and the supporter 12 of the panel unit 10. Preferably, the holder 22 of the leg unit 20 is arranged between the supporting leg 21 of the leg unit 20 and the second longitudinal strut 123 of the supporter 12 of the panel unit 10. Alternatively, the holder 22 of the leg unit 20 is arranged between the supporting leg 21 of the leg unit 20 and the bottom surface 112 of the panel body 11 of the panel unit 10. More preferably, the holder 22 is respectively pivotally arranged on the supporting leg 21 of the leg unit 20 and the supporter 12 of the panel unit 10.

Figure 19:
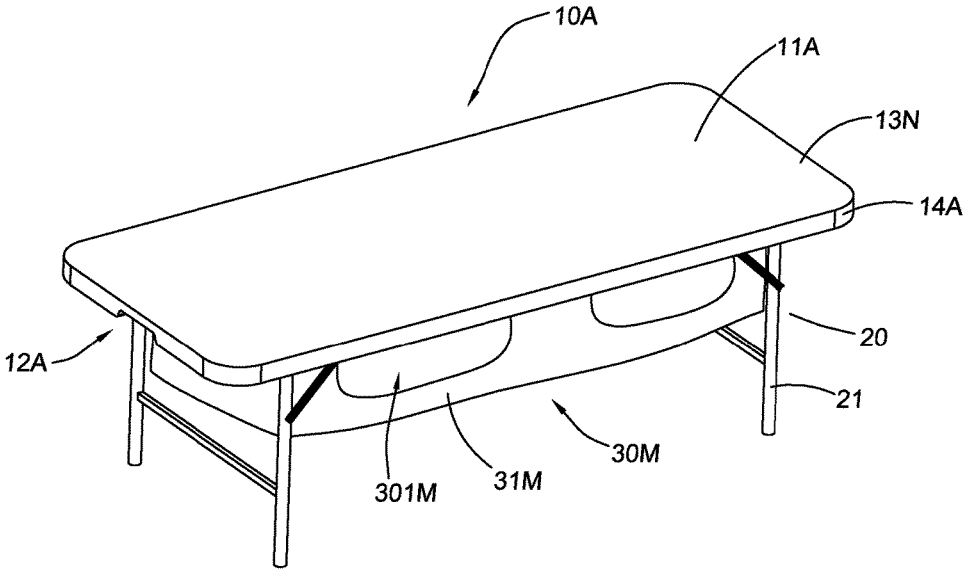
FIG. 19 illustrates another alternative of the table according to the above third preferred embodiment of the present invention.

FIG. 19 of the drawings illustrates an alternative of the table according to the above third preferred embodiment of the present invention. The table comprises a table top 10A, a supporter 20, at least one receiving device 30M, and a leg unit 40. The table top 10A has a table surface 11A and a bottom surface 12A. The supporter 20 is arranged on the bottom surface 12A of the table top 10A. The receiving device 30M is arranged on the supporter 20. The leg unit 40 is pivotally arranged on the supporter 20. When the leg unit 40 is opened or unfolded, the leg unit 40 can support the supporter 30 and allow the supporter 30 to support the table top 10A and keep the table surface 11A of the table top 10A in a horizontal condition. When the leg unit 40 is folded, the leg unit 40 can be received on the bottom surface 12A of the table top 10A. In other words, the supporter 30 is arranged to be able to support the table top 10A, so as to keep the table surface 11A of the table top 10A horizontal, so that objects can be stably placed on the table surface of the table top 10A. Preferably, the table surface 11A of the table top 10A is flat.

As shown in FIG. 19 of the drawings, the table top 10A comprises a panel body 13A and a fixing portion 14A extended downwardly from the edge of the panel body 13A. The fixing portion 14A predeterminedly has mounting holes, such that the supporter 30 of the table can be fixed on the fixing portion 14A of the table top 10A. Person skilled in the art would understand that the table top 10A of the table according to the above third preferred embodiment of the present invention is made of plastic material. Therefore, the table top 10A can be molded by blow molding or injection molding. Hence, the fixing portion 14A of the table and the panel body 13A of the table top 10A of the table are formed together by blow molding or injection molding to form an integral structure. In other words, the fixing portion 14A can be considered as a part of the panel body 13A the table top 10A. Preferably, the table top 10A is formed through blow molding. Alternatively, the fixing portion 14A is hiddenly arranged on the bottom surface 12A of the table top 10A.

As shown in FIGS. 20A to 23C of the drawings of the specification of the present invention, a bed according to a fourth preferred embodiment of the present invention is illustrated. The bed comprises a bed panel 10 made of plastic material, at least one receiving device 20P, a supporter 30P, and a mounting portion 40P made of plastic material. The bed panel 10P has a bed surface 11P and a bottom surface 12P. The mounting portion 40P and the bed panel 10P are integrated with each other. The supporter 30P is arranged on the bottom surface 12P of the bed panel 10P. The receiving device 20P is arranged at the mounting portion 40P. The supporter 30P is arranged to be able to support the bed panel 10P and to keep the bed surface 11P of the bed panel 10P in a horizontal condition. In other words, the supporter 30P supports the bed panel 10P, so as to keep the bed surface 11P of the bed panel 10P horizontal, so that objects can be stably placed on the bed surface of the bed panel 10P. Preferably, the bed surface 11P of the bed panel 10P is flat. Person skilled in the art would understand that the bed panel 10P can be made by blow molding or injection molding. Hence, the mounting portion 40P of the bed and the bed panel 10P of the bed are formed together by blow molding or injection molding to form an integral structure. In other words, the mounting portion 40P can be considered as a part of the bed panel 10P. Preferably, the bed panel 10P is formed through blow molding. Alternatively, the mounting portion 40P is hiddenly arranged on the bottom surface 12P of the bed panel 10P. Alternatively, the mounting portion 40P is arranged on a side wall 14P of the bed panel 10P, as FIG. 20F illustrates.

As shown in FIGS. 20A to 20F, the bed panel 10P of the bed according to a fourth preferred embodiment of the present invention, forms an upper space 101P and a lower space 102P. The upper space 101P is formed above the bed surface 11P of the bed panel 10P, and the lower space 102P is formed below the bottom surface 12P of the bed panel 10P. The receiving device 20P is arranged in the lower space 102P. Person skilled in the art would understand that the receiving device 20P can be any structure that can be arranged on the mounting portion 40P of the bed for receiving objects. Hence, the receiving device 20P herein comprises all mechanisms that were known by person skilled in the art that can be arranged on the mounting portion 40P of the bed and can accommodate objects therein. Preferably, the receiving device 20P is detachably arranged on the mounting portion 40P of the bed. More preferably, the receiving device 20P is respectively provided at the mounting portion 40P and hung at the air. In other words, the receiving device 20P has an absolute structure that can be arranged on the mounting portion 40P, so as to be respectively provided at the mounting portion 40P and hung at the air. Therefore, when the receiving device 20P or a receiving body 21P of the receiving device 20P is removed or detached from the mounting portion 40P, it will not affect the overall aesthetic of the bed.

Figure 24A:
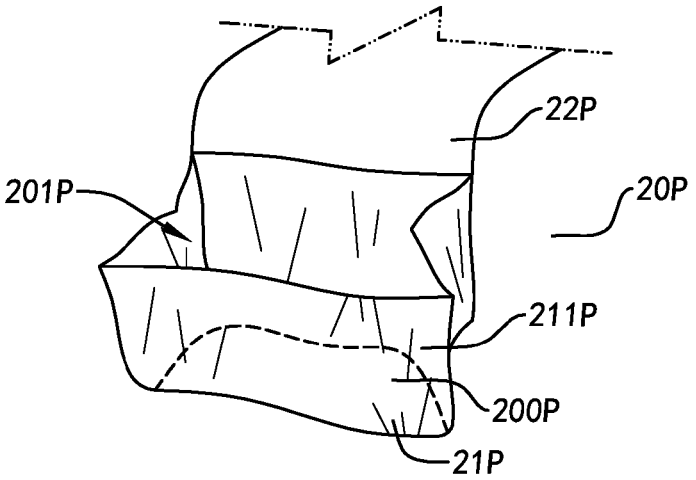
FIG. 24A illustrates the receiving device of bed according to the above fourth preferred embodiment of the present invention in an open state.
Figure 24B:
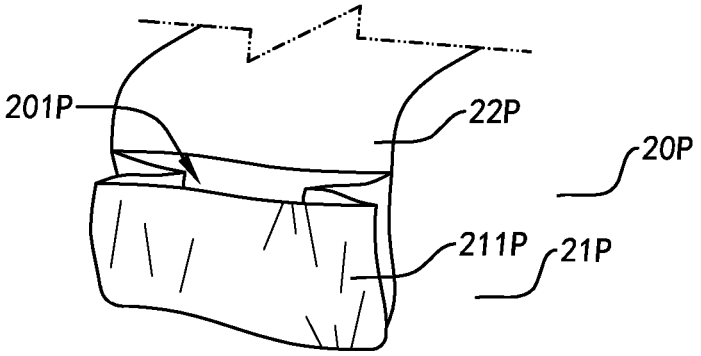
FIG. 24B illustrates the receiving device of bed according to the above fourth preferred embodiment of the present invention in a folded state.

As shown in FIGS. 24A and 24B, wherein the receiving device 20P of the bed according to the above fourth preferred embodiment of the present invention is further arranged to be openable and retractable. When the receiving device 20P is opened, the receiving device 20P forms a receiving cavity 200P, wherein the receiving cavity 200P has a receiving opening 201P. When the receiving device 20P is retracted, the receiving device 20P is folded so as to occupy a smaller space. Person skilled in the art would understand that the receiving device 20P can be arranged to allow a user to manually unfold and pack up the receiving device 20P. The receiving device 20P can also be arranged to remain open when it is arranged at the mounting portion 40P of the bed. The receiving device 20P can also be arranged to be remained opened when the supporter 30P of the bed is unfolded and to be folded and retracted when the supporter 20 (and/or bed panel 10P) of the bed is folded.

It is understandable that the receiving body 21P of the receiving device 20P or the main structure of the receiving device 20P is made of soft material, so that when the receiving device 20P is arranged on the mounting portion 40P, the receiving body 21P of the receiving device 20P will not affect the folding of the supporter 30P and/or the bed panel 10P. Person skilled in the art would understand that the soft material is preferably soft material(s) of cotton, hemp, silk, wool, chemical fiber, etc. The soft material can also be other material suitable for producing the receiving body 21P of the receiving device 20P. Person skilled in the art would understand that the receiving device 20P further comprises a supporting shelf, wherein the receiving body 21P of the receiving device 20P is arranged on the supporting shelf and the supporting shelf is arranged to be able to keep the receiving body 21P in the open state. Preferably, the supporting shelf of the receiving device 20P is a foldable supporting shelf, so that the receiving device 20P can be folded into the folded state.

As shown in FIGS. 20A to 22C, the supporter 30P of the bed according to a fourth preferred embodiment of the present invention, comprises a supporting frame 31P and at least one supporting leg 32P. The supporting frame 31P of the supporter 30P is arranged on the bottom surface 12P of the bed panel 10P. The supporting leg 32P of the supporter 30P is arranged on the supporting frame 31P of the supporter 30P. As shown in FIGS. 20A to 22C, the supporter 30P further comprises at least two supporting legs 32P.

Figure 20A:
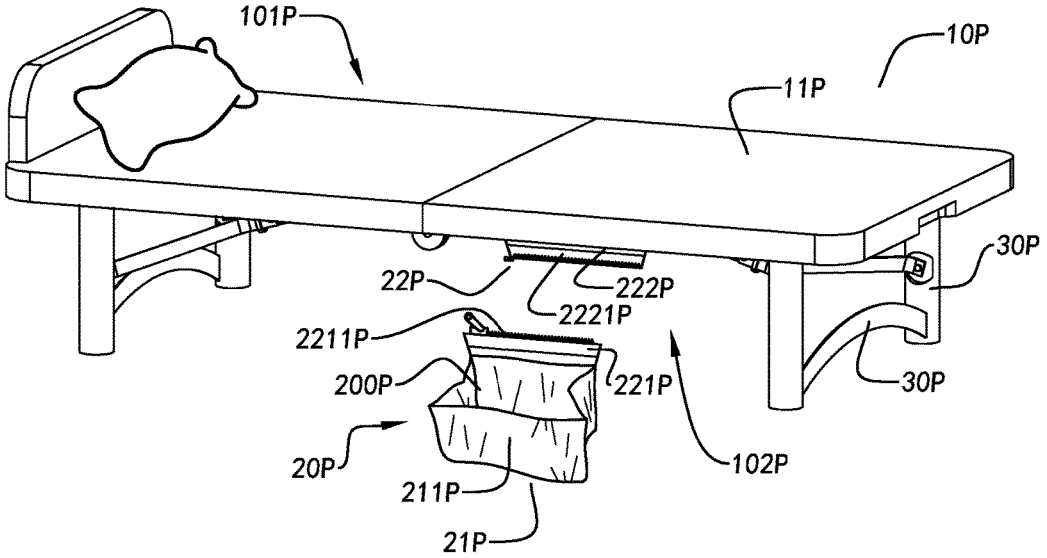
FIG. 20A is a perspective view of the bed according to a fourth preferred embodiment of the present invention, illustrating the receiving device of the bed being arranged on the bed panel of the bed.

As shown in FIG. 20A, the receiving device 20P of the bed according to a fourth preferred embodiment of the present invention comprises a receiving body 21P and at least one connecting element 22P. The receiving body 21P forms the receiving cavity 200P. The connecting element 22P is arranged on the receiving body 21P and the mounting portion 40P of the bed.

Figure 21A:
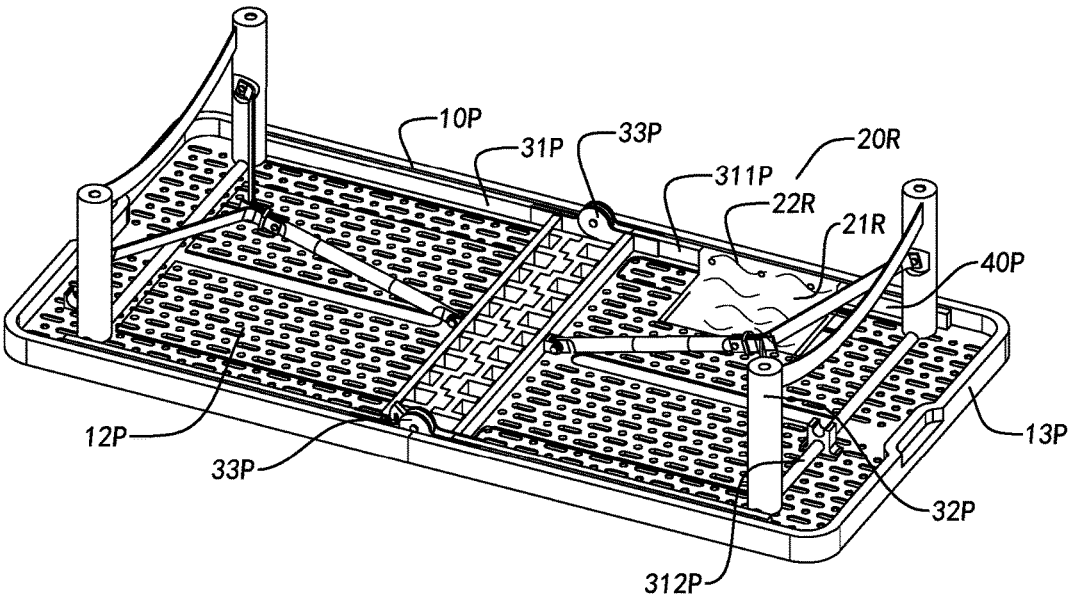
FIG. 21A is a perspective view of the bed according to the above fourth preferred embodiment of the present invention, illustrating the supporter of the bed being in an unfolded state and the receiving device of the bed being arranged between the bed panel of the bed.
Figure 21B:
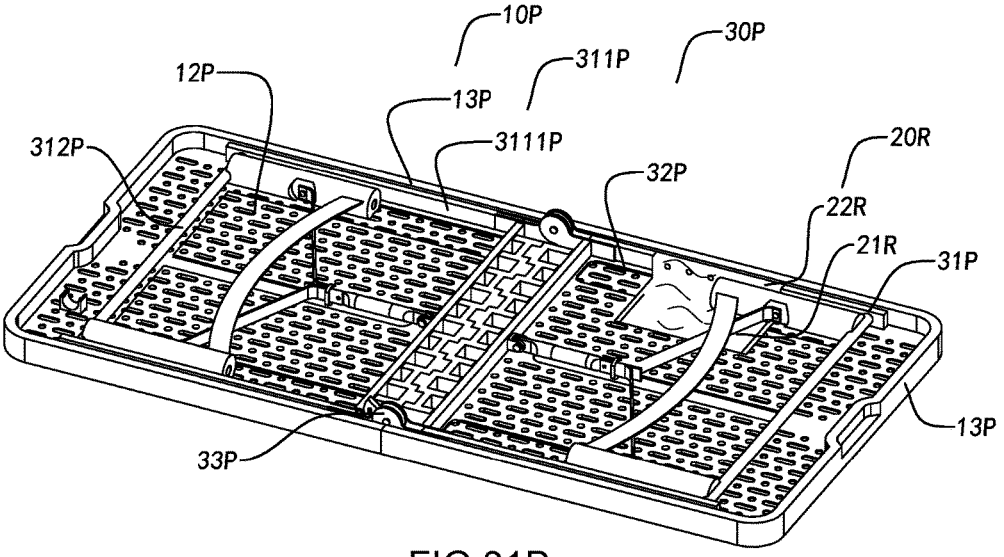
FIG. 21B is a perspective view of the bed according to the above fourth preferred embodiment of the present invention, illustrating the supporter of the bed being in a folded state.
Figure 21C:
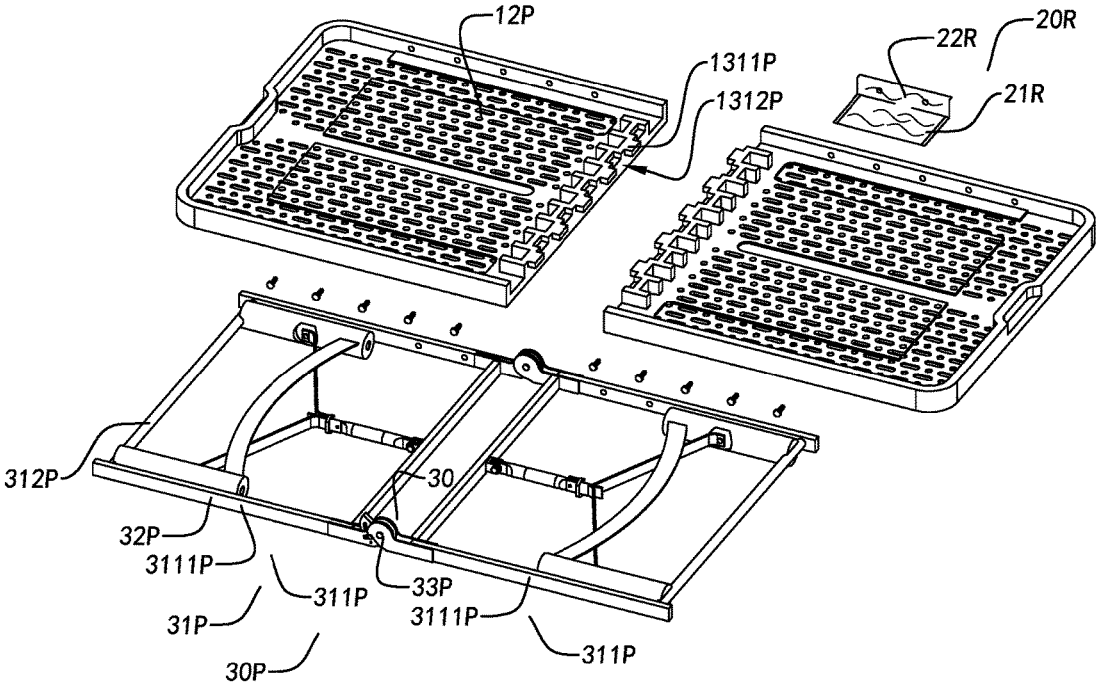
FIG. 21C is an exploded view of the bed according to the above fourth preferred embodiment of the present invention.

As shown in FIGS. 21A to 21C, according to the above fourth preferred embodiment of the present invention, the bed panel 10P and the mounting portion 40P of the bed are integrated with each other. The mounting portion 40P has at least one screw hole, such that the connecting element 22P of the receiving device 20P can be screwed at the mounting portion 40P. Person skilled in the art would understand that the connecting element 22P of the receiving device 20P and the mounting portion 40P can also be connected through other connecting types. For example, the mounting portion 40P can be arranged to have a hanger structure and the connecting element 22P of the receiving device 20P is hung on the mounting portion 40P.

As shown in FIG. 20A, the receiving device 20P of the bed according to a fourth preferred embodiment of the present invention comprises a receiving body 21P and a connecting element 22P. The receiving body 21P comprises two side walls 211P. The connecting element 22P comprises a first connector 221P and a second connector 222P. The two side walls 211P of the receiving body 21P are separately arranged. The first connector 221P of the connecting element 22P is arranged on one side wall 211P of the receiving body 21P. The second connector 222P of the connecting element 22P of the receiving device 20P is arranged on the mounting portion 40P. In other words, the second connector 222P of the connecting element 22P of the receiving device 20P is arranged on the mounting portion 40P. Besides, when the receiving device 20P is arranged on the mounting portion 40P because the second connector 222P of the connecting elements 22P of the receiving device 20P is arranged on a side wall 211P of the receiving body 21P of the receiving device 20P, the two side walls 211P of the receiving body 21P of the receiving device 20P will be kept separated under the influence of gravity, so as to cause the receiving body 21P of the receiving device 20P remained opened.

As shown in FIG. 20A, the second connector 222P and the first connector 221P of the connecting element 22P are arranged to be able to detachably connected together, so that the receiving body 21P of the receiving device 20P can be detached or removed from the supporter 30P. As shown in FIG. 20A, the connecting element 22P of the receiving device 20P preferably has a zipper structure, wherein the first connector 221P and the second connector 222P of the connecting element 22P can be zipped together. As shown in FIG. 20A, the first connector of the second connector 222P of the connecting element 22P have a toothed chain 2211P or 2221P, such that the connecting element 22P has a zipper structure and the first connector 221P and the second connector 222P of the connecting element 22P can be zipped together. Hence, the connecting type between the first connector 221P and the second connector 222P of the connecting element 22P of the receiving device 20P is zipping type.

Alternatively, the connecting element 22P of the receiving device 20P has a hanger structure, so that the receiving device 20P can be hung on the supporter 30P. In other words, the connecting element 22P can be a hanger, so that the receiving body 21P of the receiving device 20P can be detachably hung on the hanger.

Figure 20B:
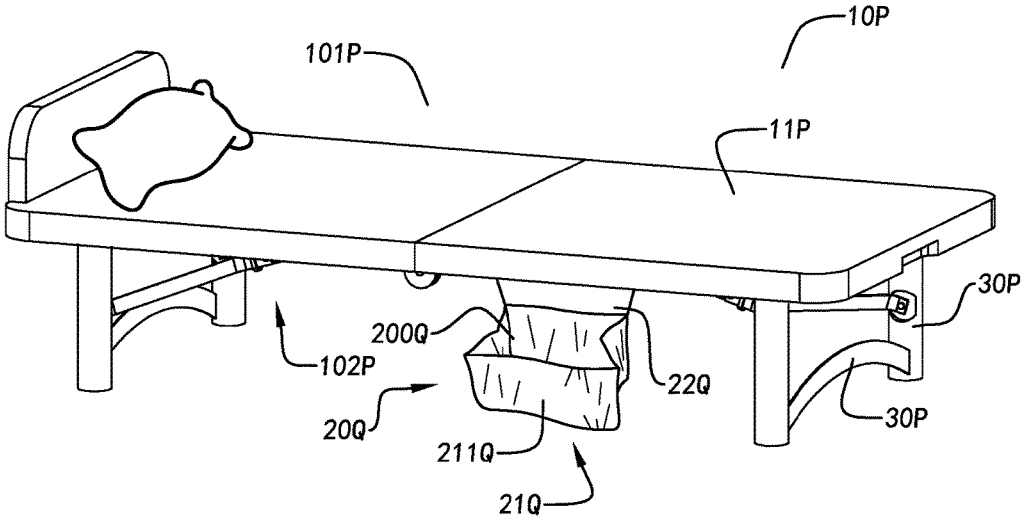
FIG. 20B illustrates an alternative of the receiving device of the bed according to the above fourth preferred embodiment of the present invention.

FIG. 20B of the drawings illustrates an alternative of the receiving device 20P of the bed according to the above fourth preferred embodiment of the present invention, wherein the receiving device 20Q comprises a receiving body 21Q and two connecting elements 22Q. The receiving body 21Q comprises two side walls 211Q. The two side walls 211Q of the receiving body 21Q are separately arranged. The two connecting elements 22Q of the receiving device 20Q are respectively arranged on the same side wall 211Q of the receiving body 21Q and the mounting portion 40P. Therefore, the receiving device 20Q is arranged on the mounting portion 40P. Besides, when the receiving device 20Q is arranged on the mounting portion 40P because the two connecting elements 22Q of the receiving device 20Q are both arranged on the same side wall 211Q of the receiving body 21Q of the receiving device 20Q, the two side walls 211Q of the receiving body 21Q of the receiving device 20Q will be kept separated under the influence of gravity, so as to cause the receiving body 21Q of the receiving device 20Q remained opened. Preferably, the connecting element 22Q of the receiving device 20Q has a linear structure, so as to make the connecting element 22Q of the receiving device 20Q be respectively detachably tied on the mounting portion 40P. Alternatively, the connecting element 22Q of the receiving device 20Q is band shaped. Therefore, the connecting type between the connecting element 22Q of the receiving device 20Q and the mounting portion 40P is rope tying type.

Figure 20C:
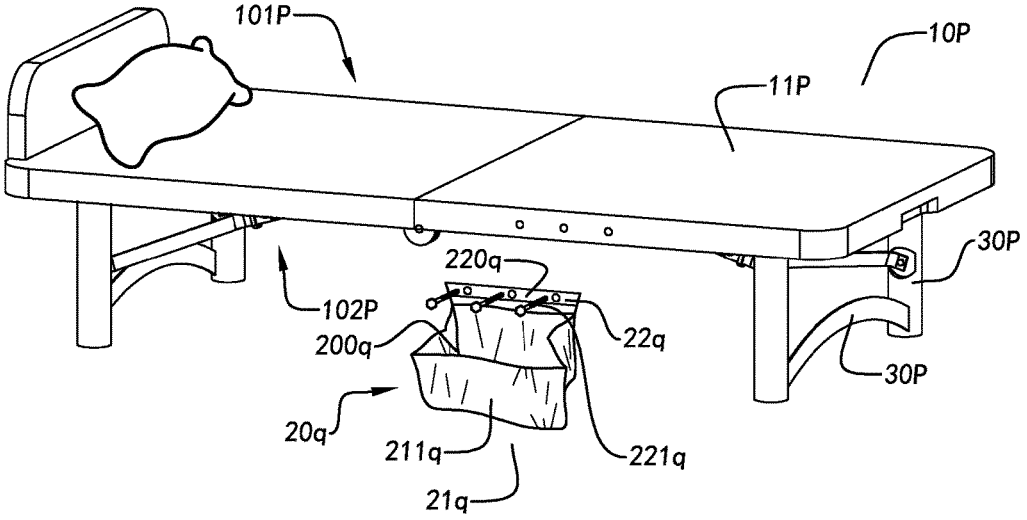
FIG. 20C illustrates another alternative of the receiving device of the bed according to the above fourth preferred embodiment of the present invention.

FIG. 20C of the drawings illustrates the receiving device 20P of the bed according to the above fourth preferred embodiment of the present invention, wherein the receiving device 20*q* comprises a receiving body 21*q* and a connecting element 22*q*. The receiving body 21*q* comprises two side walls 211*q*. The two side walls 211*q* of the receiving body 21*q* are separately arranged. The connecting element 22*q* is arranged on one side wall 211*q* of the receiving body 21*q*.

The connecting element 22$q$ of the receiving device is arranged at the mounting portion 40P. In other words, the receiving device 20$q$ is arranged on the mounting portion 40P. Besides, when the receiving device 20$q$ is arranged on the mounting portion 40P because the connecting element 22$q$ of the receiving device 20$q$ is arranged on a side wall 211$q$ of the receiving body 21$q$ of the receiving device 20$q$, the two side walls 211$q$ of the receiving body 21$q$ of the receiving device 20$q$ will be kept separated under the influence of gravity, so as to cause the receiving body 21$q$ of the receiving device 20$q$ remained opened.

As shown in FIG. 20C, the connecting element 22$q$ and the mounting portion 40P are arranged to respectively have at least one screw hole 220$q$ or 1000$q$, so that the connecting element 22$q$ and the mounting portion 40P can be detachably screwed together and the receiving body 21$q$ of the receiving device 20$q$ can be removed from the mounting portion 40P. As shown in FIG. 20C, the connecting element 22$q$ of the receiving device 20$q$ further comprises at least one screw 221$q$. The screw 221$q$ can screw through the screw hole 220$q$ and 1000$q$. Therefore, the connecting type between the connecting element 22$q$ of the receiving device 20$q$ and the mounting portion 40P is screwing type.

Figure 20D:
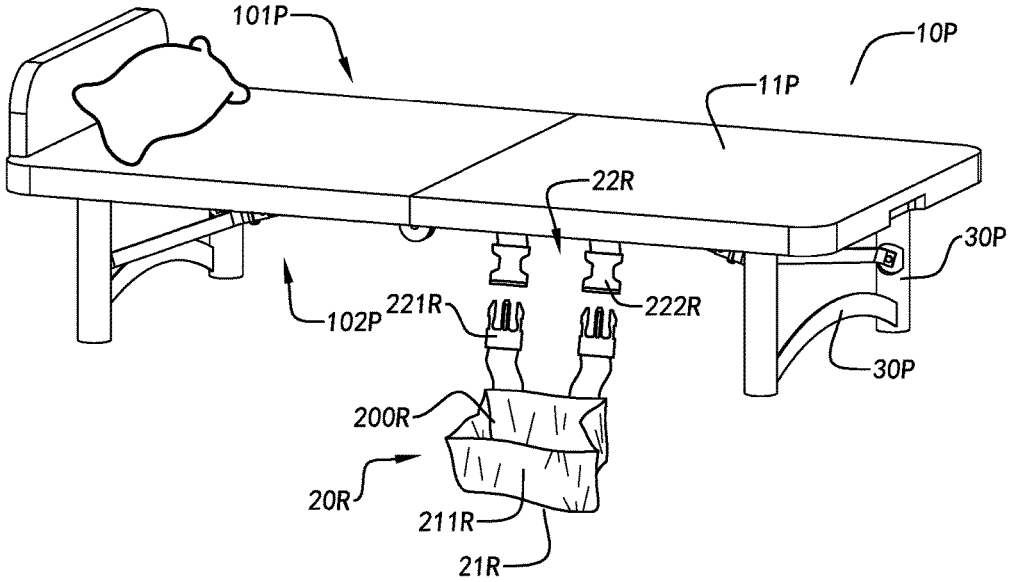
FIG. 20D illustrates another alternative of the receiving device of the bed according to the above fourth preferred embodiment of the present invention.

FIG. 20D of the drawings refers to an alternative of the receiving device 20P of the bed according to the above fourth preferred embodiment of the present invention, wherein the receiving device 20R comprises a receiving body 21R and two connecting elements 22R. The receiving body 21R comprises two side walls 211R. Each of the connecting element 22R comprises a first connector 221R and a second connector 222R. The two side walls 211R of the receiving body 21R are separately arranged. The first connectors 221R of the connecting elements 22R are respectively arranged on the same side wall 211R of the receiving body 21R. The second connectors 222R of the two connecting elements 22R of the receiving device 20R are respectively arranged on the mounting portion 40P. In other words, the receiving device 20R is arranged on the mounting portion 40P. Besides, when the receiving device 20R is arranged on the mounting portion 40P because the two connecting elements 22R of the receiving device 20R are both arranged on the same side wall 211R of the receiving body 21R of the receiving device 20R, the two side walls 211R of the receiving body 21R of the receiving device 20R will be kept separated under the influence of gravity, so as to cause the receiving body 21R of the receiving device 20R remained opened.

As shown in FIGS. 20D and 21A to 21C, the second connector 222R and the first connector 221R of the connecting element 22R are arranged to be able to detachably connected together, so that the receiving body 21R of the receiving device 20R can be detached or removed from the supporter 30P. As shown in FIG. 20D, the connecting element 22R of the receiving device 20R is a detachable buckle, so as allow the first connector 221R and the second connector 222R of the connecting element 22R to be detachably locked or buckled together. As shown in FIG. 20D, the first connector 221R of the connecting element 22R is arranged to have an engaging end structure of a detachable buckle, wherein the second connector 222R is arranged to have a locking end of a detachable buckle, such that the first connector 221R and the second connector 222R of the connecting element 22R can be locked or buckled together. Alternatively, the first connector 221R of the connecting element 22R is arranged to have a locking end structure of a detachable buckle, wherein the second connector 222R is arranged to have an engaging end of a detachable buckle, such that the first connector 221R and the second connector 222R of the connecting element 22R can be locked or buckled together. Hence, the connecting type between the first connector 221R and the second connector 222R of the connecting element 22R of the receiving device 20R is buckling type.

Figure 20E:
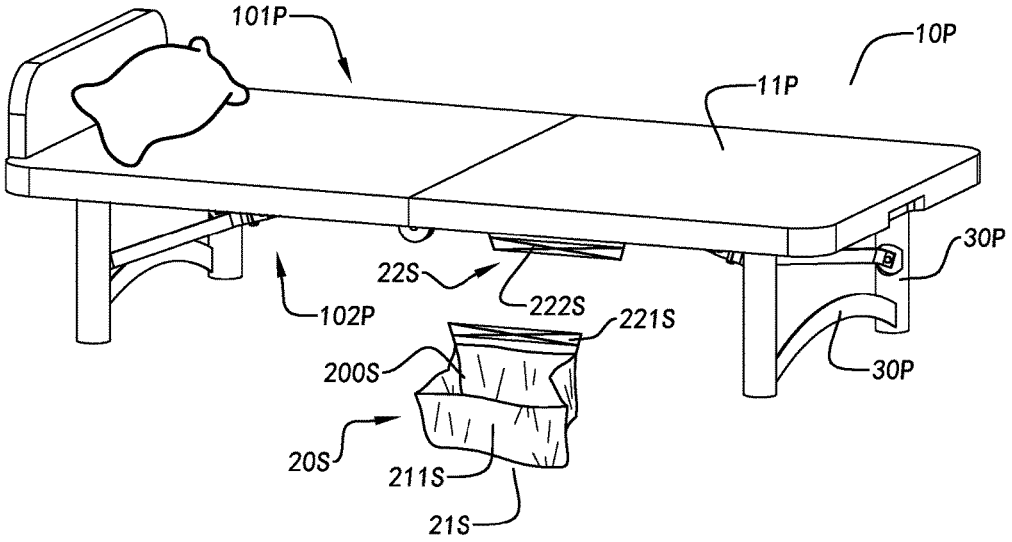
FIG. 20E illustrates another alternative of the receiving device of the bed according to the above fourth preferred embodiment of the present invention.

FIG. 20E of the drawings refers to an alternative of the receiving device 20P of the bed according to the above fourth preferred embodiment of the present invention, wherein the receiving device 20S comprises a receiving body 21S and two connecting elements 22S. The receiving body 21S comprises two side walls 211S. Each of the connecting elements 22S comprises a first connector 221S and a second connector 222S. The two side walls 211S of the receiving body 21S are separately arranged. The first connectors 221S of the two connecting elements 22S of the receiving device 20S are respectively arranged on the same side wall 211S of the receiving body 21S. The second connectors 222S of the two connecting elements 22S of the receiving device 20S are respectively arranged on the mounting portion 40P. In other words, the receiving device 20S is arranged between two supporting legs 32P of the supporter 30P. Besides, when the receiving device 20S is arranged between the two supporting legs 32P of the supporter 30P because the two connecting elements 22S of the receiving device 20S are both arranged on the same side wall 211S of the receiving body 21S of the receiving device 20S, the two side walls 211S of the receiving body 21S of the receiving device 20S will be kept separated under the influence of gravity, so as to cause the receiving body 21S of the receiving device 20S remained opened.

As shown in FIG. 20E, the second connector 222S and the first connector 221S of the connecting element 22S are arranged to be able to detachably connected together, so that the receiving body 21S of the receiving device 20S can be detached or removed from the supporter 30P. As shown in FIG. 20E, the connecting element 22S of the receiving device 20S is a hook and loop fastener or magic tape so as allow the first connector 221S and the second connector 222S of the connecting element 22S to be detachably hook-loop fastened together. As shown in FIG. 20E, the first connector 221S of the connecting element 22S is arranged to have a hook structure of a hook and loop fastener, wherein the second connector 222S is arranged to have a loop structure of a hook and loop fastener, such that the first connector 221S and the second connector 222S of the connecting element 22S can be hook-loop fastened together. Alternatively, the first connector 221S of the connecting element 22S is arranged to have a loop structure of a hook and loop fastener, wherein the second connector 222S is arranged to have a hook structure of a hook and loop fastener, such that the first connector 221S and the second connector 222S of the connecting element 22S can be hook-loop fastened together. Hence, the connecting type between the first connector 221S and the second connector 222S of the connecting element 22S of the receiving device 20S is hook-loop fastening or bonding type.

Figure 20F:
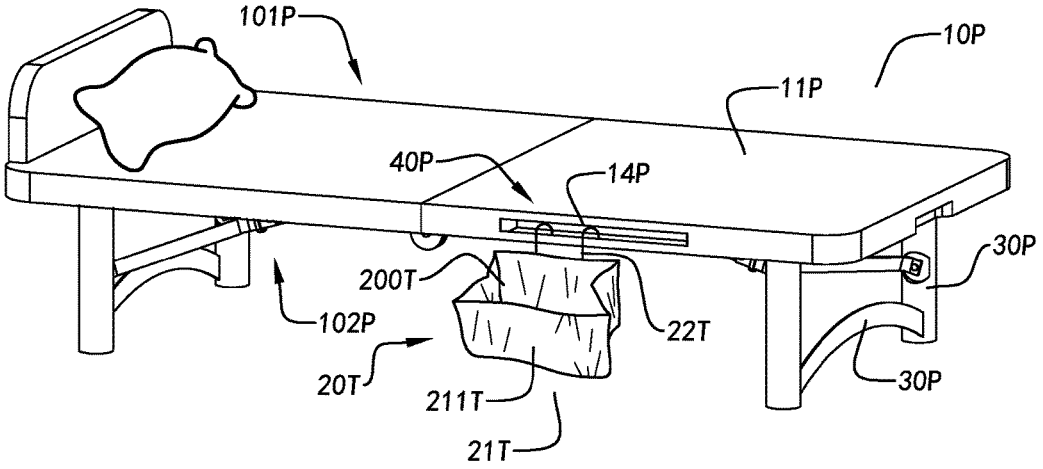
FIG. 20F illustrates another alternative of the receiving device of the bed according to the above fourth preferred embodiment of the present invention.

FIG. 20F of the drawings illustrates an alternative of the receiving device 20P of the bed according to the above fourth preferred embodiment of the present invention, wherein the receiving device 20T comprises a receiving body 21T and two connecting elements 22T. The receiving body 21T comprises two side walls 211T. The two side walls 211T of the receiving body 21T are separately arranged. The two connecting elements 22T of the receiving device 20T are respectively arranged on the same side wall 211T of the receiving body 21T and the mounting portion 40P. Therefore, the receiving device 20T is arranged on the mounting portion 40P. Besides, when the receiving device 20T is arranged on the mounting portion 40P because the two connecting elements 22T of the receiving device 20T are both arranged on the same side wall 211T of the receiving body 21T of the receiving device 20T, the two side walls 211T of the receiving body 21T of the receiving device 20T will be kept separated under the influence of gravity, so as to cause the receiving body 21T of the receiving device 20T remained opened. Preferably, the connecting element 22T of the receiving device 20T has a hanger structure, so as to make the connecting element 22T of the receiving device 20T be respectively detachably hung on the mounting portion 40P. Therefore, the connecting type between the connecting element 22T of the receiving device 20T and the mounting portion 40P is wall mounting type. As shown in FIG. 20F, the mounting portion 40P of the bed according to the above fourth preferred embodiment of the present invention is arranged on a side wall 14P of the bed panel 10P and the mounting portion 40P is arranged to have a rod-shaped structure, so that the connecting element 22T of the receiving device 20T can hook on the mounting portion 40P.

As shown in FIGS. 21A to 21C, the supporter 30P of the bed according to the above fourth preferred embodiment of the present invention is illustrated, comprises a supporting frame 31P arranged on the bottom surface 12P of the bed panel 10P and at least two supporting legs 32P respectively arranged on the supporting frame 31P of the supporter 30P. The supporting legs 32P are respectively arranged to pivot with respect to each other to the bottom surface 12P of the bed panel 10P, so that the supporting legs 32P can be folded on the bottom surface 11 of the bed panel 10P. In other words, the supporter 30P of the bed is a foldable supporter.

As shown in FIGS. 21A to 21C, the supporting frame 31P of the supporter 30P comprises two transverse members 311P separately arranged on the bottom surface 12P of the bed panel 10P and two longitudinal members 312P separately arranged between the two transverse members, wherein each longitudinal member 312P is pivotally arranged between the transverse members 311P of the supporting frame 31P, wherein the supporting leg(s) 32P of the supporter 30P is respectively arranged on the two longitudinal members 312P of the supporting frame 31P, so as to allow the supporting leg(s) 32P of the supporter 30P be arranged to be pivotally with respect to the bottom surface 12P of the bed panel 10P.

Figure 23A:
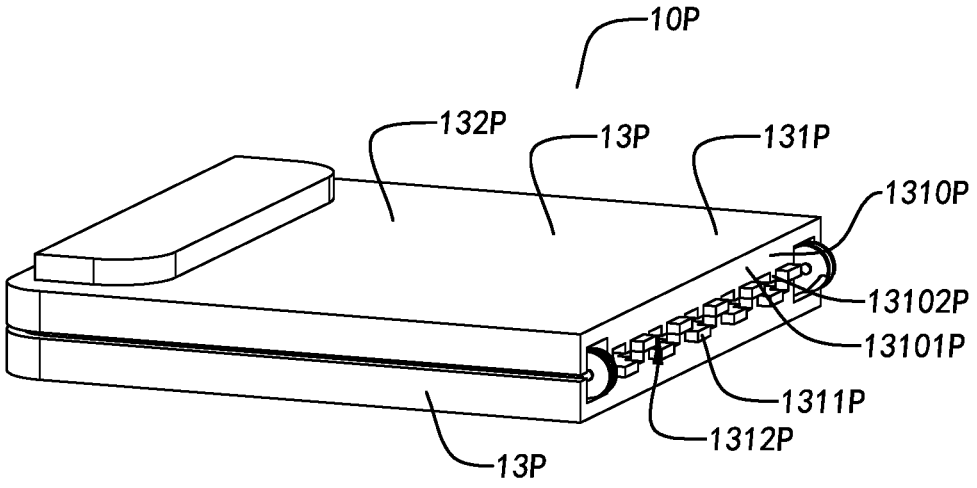
FIG. 23A is a perspective view of the bed panel of the bed according to the above fourth preferred embodiment of the present invention, illustrating the bed panel of the bed being in a folded state.
Figure 23B:
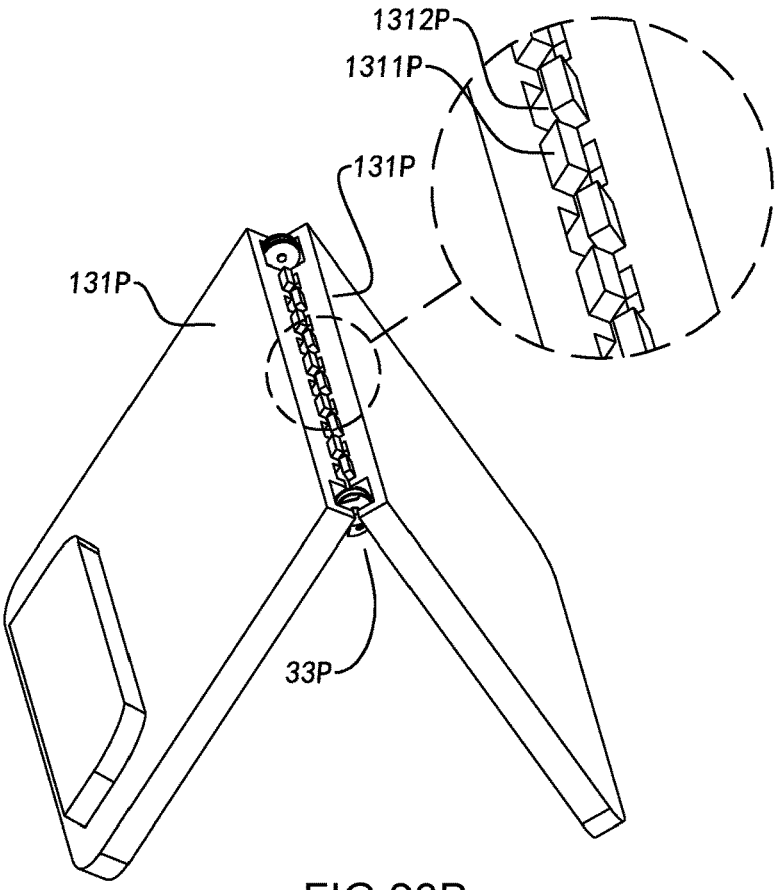
FIG. 23B is a perspective view illustrating the connection relationship of two pivoting portions of the bed panel of the bed according to the above fourth preferred embodiment of the present invention.
Figure 23C:
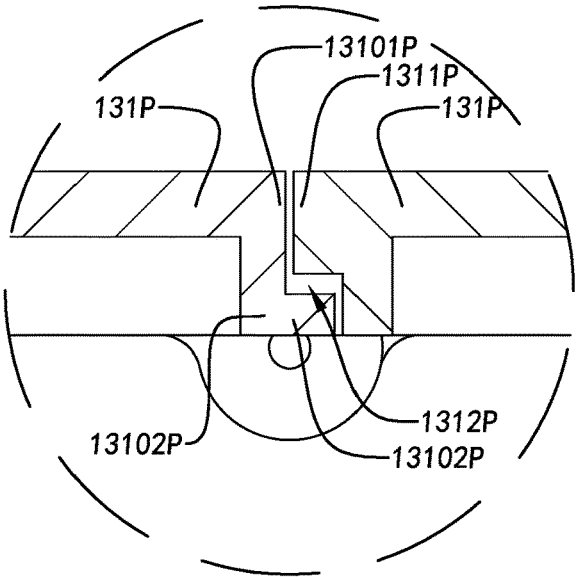
FIG. 23C is a partial sectional view of the bed panel of the bed according to the above fourth preferred embodiment of the present invention.

As shown in FIGS. 23A to 23C, the bed panel 10P of the bed, according to the above fourth preferred embodiment of the present invention, comprises two pivoting portions 13P, wherein the two pivoting portions 13P of the bed panel 10P are arranged to be pivotally relatively movable, so that the bed panel 10P can be folded to occupy a smaller space and be unfolded to form the bed surface 11P of the bed panel 10P.

Figure 22A:
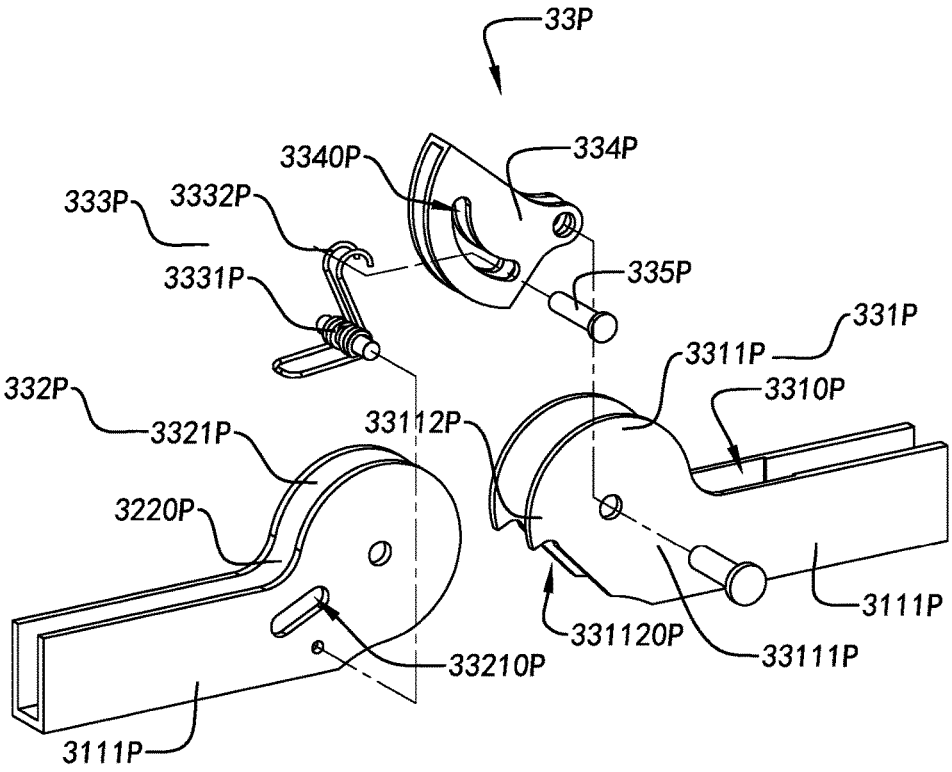
FIG. 22A is an exploded view of the locker of the bed according to the above fourth preferred embodiment of the present invention.
Figure 22B:
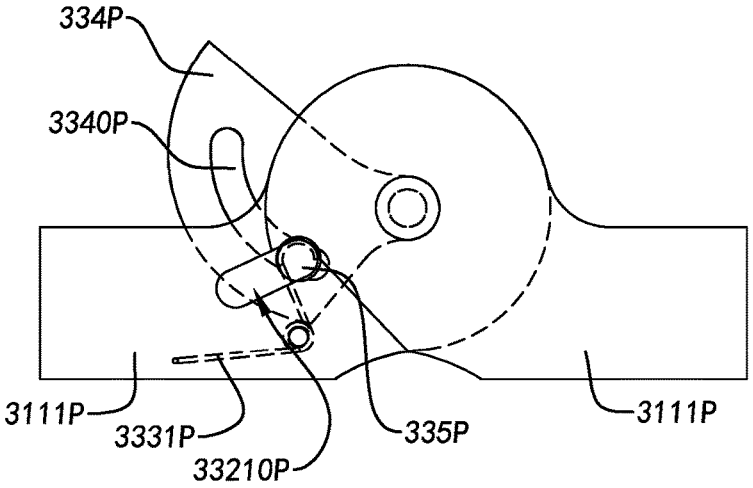
FIG. 22B illustrates the transverse member of the bed according to the above fourth preferred embodiment of the present invention being kept unfolded by the locker.
Figure 22C:
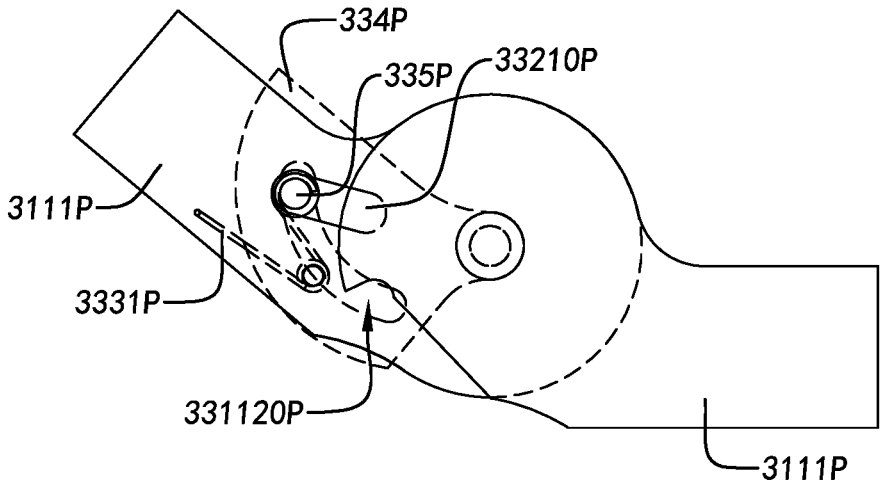
FIG. 22C illustrates the locker of the bed allowing the transverse member of the supporter of the bed to be folded according to the above fourth preferred embodiment of the present invention.

As shown in FIGS. 22A to 22C, the supporter 30P further comprises two lockers 33P. Each transverse member 311P of the supporting frame 31P of the supporter 30P comprises two supporting elements 3111P. Each locker 33P is arranged between the two supporting elements 3111P of the transverse member 311P of the supporting frame 31P of the supporter 30P. The locker 33P is arranged to allow the two supporting elements 3111P of the transverse member 311P of the supporting frame 31P to pivot with respect to each other.

As shown in FIGS. 22A to 22C, each locker 33P of the supporter 30P is arranged to have a locked state and an unlocked state. When the locker 33P is in the locked state, the locker 33P can prevent the two supporting elements 3111P of the transverse member 311P to pivot with respect to each other, and when the locker 33P is in the unlocked state, the locker 33P allows the two supporting elements 3111P to freely pivot with respect to each other. Person skilled in the art would understand that because the supporting frame 31P of the supporter 30P is arranged on the bottom surface 12P of the bed panel 10P, when the locker 33P is set in the locked state, the two pivoting portions 13P of the bed panel 10P will be kept unfolded and opened to form the bed surface 11P. When the locker 33P is set in the unlocked state, the locker 33P will allow the two supporting elements 3111P of the transverse member 311P to pivot with respect to each other and allow the two pivoting portions 13P of the bed panel 10P to pivot with respect to each other.

As shown in FIGS. 22A to 22C, the locker 33P of the supporter 30P of the bed according to the above fourth preferred embodiment of the present invention, comprises a first locking unit 331P, a second locking unit 332P, a holder 333P, an operating portion 334P, and a locking member 335P.

As shown in FIGS. 22A to 22C of the drawings, the first locking unit 331P comprises two first walls 3311P. The second locking unit 332P comprises two second walls 3321P. The two first walls 3311P of the first locking unit 331P respectively extends outwardly from a supporting element 3111P of the transverse member 311P. The two second walls 3321P of the second locking unit 332P respectively extends outwardly from another supporting element 3111P of the transverse member 311P. The two first walls 3311P of the first locking unit 331P are separately arranged to form a first mounting groove 3310P therebetween. The two second wall 3321P of the second locking unit 332P are separately arranged to form a second mounting groove 3320P therebetween. Each of the first wall 3311P comprises an extending portion 33111P extended from the supporting element 3111P of the transverse member 311P and a locking portion 33112P extended from extending end 33111P. The locking portion 33112P forms a locking groove 331120P. Each second wall 3321P of the second locking unit 332P have a first guiding groove 33210P extended upwardly and outwardly. The operating portion 334P has a curvingly extended second guiding groove 3340P. The second locking unit 332P is arranged at the first mounting groove 3310P of the first locking unit 331P. The operating portion 334P is arranged at the second mounting groove 3320P of the second locking unit 332P. The first guiding groove 33210P of the second wall 3321P, the second guiding groove 3340P of the operating portion 334P, and the locking groove 331120P of the first wall 3311P are coincided, so as to allow the locking member 335P to penetrate the first guiding groove 33210P of the second wall 3321P, the second guiding groove 3340P of the operating portion 334P, and the locking groove 331120P of the first wall 3311P. The holder 333P is arranged in the second mounting groove 3320P and extended to the locking member 35P. Besides, the holder 333P is allowed to keep the locking member 335P in the second guiding groove 3340P. In other words, the locker 33P of the supporter 30P comprises a first locking unit 331P, a second locking unit 332P, a holder 333P, an operating portion 334P, and a locking member 335P. The first locking unit 331P has a first mounting groove 3310P and a locking groove 331120P. The two locking units 332P have a second mounting groove 3320P and a first guiding groove 33210P. The operating portion 334P has a curvingly extended second guiding groove 3340P. The second locking unit 332P is arranged at the first mounting groove 3310P of the first locking unit 331P. The operating portion 334P is pivotally arranged at the second mounting groove 3320P of the second locking unit 332P. The first guiding groove 33210P of the second wall 3321P, the second guiding groove 3340P of the operating portion 334P, and the locking groove 331120P of the first wall 3311P are coincided, so as to allow the locking member 335P to penetrate the first guiding groove 33210P of the second wall 3321P, the second guiding groove 3340P of the operating portion 334P, and the locking groove 331120P of the first wall 3311P. The holder 333P is allowed to keep the locking member 335P in the locking groove 331120P.

As shown in FIGS. 22A to 22C, the holder 333P of the locker 33P of the supporter 30P comprises a fixing end 3331P and a retaining end 3332P extended from the fixing end 3331P. The retaining end 3332P is arranged at the locking member 335P of the locker 33P of the supporter 30P and is allowed to hold the locking member 335P at a proper position, such that the locking member 335P will still be kept at the second guiding groove 3340P of the operating portion 334P. Preferably, the retaining end 3332P of the holder 333P is a resilient element, so as to provide a resilience to constantly keep the locking member 335P in the locking groove 331120P of the second locking unit 332P when the transverse member 31 is in an unfolded state.

Person skilled in the art would understand that the locker 33P of the supporter 30P is arranged for the following mechanism. On one hand, when the transverse member 311P of the supporter 30P is to be unfolded, the second locking unit 332P will be arranged in the first mounting groove 3310P of the first locking unit 331P, the operating portion 334P will be arranged in the second mounting groove 3320P of the second locking unit 332P, and the first guiding groove 33210P of the second wall 3321P, the second guiding groove 3340P of the operating portion 334P, and the locking groove 331120P of the first wall 3311P will be coincided. Thus, the locking member 335P can be arranged to penetrate the first guiding groove 33210P of the second wall 3321P, the second guiding groove 3340P of the operating portion 334P, and the locking groove 331120P of the first wall 3311P at the same time. Therefore, the locking member 335P will constantly be kept in the locking groove 331120P of the second locking unit 332P. On the other hand, when the transverse member 311P of the supporter 30P is to be folded, the second locking unit 332P will drive the locking member 335P to move upwardly along the second guiding groove 3340P of the operating portion 334P and drive the operating portion 334P to pivot with respect to each other to the first locking unit 331P, so as to make the transverse member 311P of the supporting frame 31P of the supporter 30P be folded. Person skilled in the art would understand that when the supporting frame 31P of the supporter 30P of the bed is foldable, the foldable bed panel 10P of the bed can be correspondingly folded as well.

As shown in FIGS. 23A to 23C, the bed panel 10P of the bed, according to the above fourth preferred embodiment of the present invention, comprises two pivoting portions 13P, wherein the two pivoting portions 13P of the bed panel 10P are arranged to be pivotally relatively movable, so that the bed panel 10P can be folded to occupy a smaller space and be unfolded to form the bed surface 11P of the bed panel 10P.

As shown in FIGS. 21A to 21C, the two pivoting portions 13P of the bed panel 10P is respectively arranged on the two supporting elements 3111P of each of the transverse members 311P of the supporting frame 31P of the supporter 30P. The two supporting elements 3111P of each of the transverse members 311P of the supporting frame 31P of the supporter 30P are arranged to pivot with respect to each other, so that the two pivoting portions 13P of the bed panel 10P can be relatively pivotally moved.

As shown in FIGS. 23A to 23C, each of pivoting portions 13P of the bed panel 10P comprises an engaging end 131P and a lengthening portion 132P extended outwardly from the engaging end 131P. The engaging end 131P of each of pivoting portions 13P of the bed panel 10P comprises a plurality of engaging teeth 1311P and has a plurality of engaging holes 1312P. The engaging teeth 1311P and the engaging holes 1312P of the engaging end 131P are interlacedly arranged, so that when the bed panel 10P is unfolded, the engaging ends 131P of the two pivoting portions 13P of the bed panel 10P can mutually engage each other, so as to enhance the intensity and loading capacity of the bed panel 10P.

As shown in FIGS. 23A to 23C, the engaging end 131P of the pivoting portion 13P of the bed panel 10P has an outer wall 1310P. The outer wall 1310P has an upper end portion 13101P and a lower end portion 13102P extended downwardly from the upper end portion 13101P. The engaging teeth 1311P and the engaging holes 1312P of the engaging end 131P are respectively interlacedly aligned on the upper end portion 13101P and the lower end portion 13102P of the outer wall 1310P of the engaging end 131P. The engaging teeth 1311P and the engaging holes 1312P of the engaging ends 131P of the two pivoting portions 13P of the bed panel 10P are arranged to correspond to each other, such that the upper end portions 13101P of the outer walls 1310P of the engaging ends 131P of the two pivoting portions 13P of the bed panel 10P can mutually engage each other and the lower end portions 13102P of the outer walls 1310P of the engaging ends 131P of the two pivoting portions 13P of the bed panel 10P can also mutually engage each other, which enhances the intensity and loading capacity of the bed panel 10P.

It should be noted that when the engaging ends 131P of the two pivoting portions 13P of the bed panel 10P are mutually engaged with each other, the two pivoting portions 13P of the bed panel 10P will form the bed surface 11P of the bed panel 10P and the bed surface 11P is a flat bed surface.

As shown in FIGS. 25A to 28C of the drawings of the specification of the present invention, a bed according to a fifth preferred embodiment of the present invention is illustrated. The bed comprises a bed panel 10P made of plastic material, at least one receiving device 20U, and a supporter 30P. The bed panel 10P has a bed surface 11P and a bottom surface 12. The supporter 30P is arranged on the bottom surface 12P of the bed panel 10P. The receiving device 20U is arranged at the supporter 30. The supporter 30P is arranged to be able to support the bed panel 10P and to keep the bed surface 11P of the bed panel 10P in a horizontal condition. In other words, the supporter 30P supports the bed panel 10P, so as to keep the bed surface 11P of the bed panel 10P horizontal, so that objects can be stably placed on the bed surface of the bed panel 10P. Preferably, the bed surface 11P of the bed panel 10P is flat. Person skilled in the art would understand that the bed panel 10P can be made by blow molding or injection molding. Preferably, the bed panel 10 is formed through blow molding.

As shown in FIGS. 25A to 25F, the bed panel 10P of the bed according to a fifth preferred embodiment of the present invention, forms an upper space 101P and a lower space 102P. The upper space 101P is formed above the bed surface 11P of the bed panel 10P, and the lower space 102P is formed below the bottom surface 12P of the bed panel 10P. The receiving device 20U is arranged in the lower space 102P. Person skilled in the art would understand that the receiving device 20U can be any structure that can be arranged on the supporter 30P of the bed for receiving objects. Hence, the receiving device 20U herein comprises all mechanisms that were known by person skilled in the art that can be arranged on the supporter 30P of the bed and can accommodate objects therein. Preferably, the receiving device 20U is detachably arranged on the supporter 30P of the bed. More preferably, the receiving device 20U is solely and suspendingly arranged on the supporter 30P. In other words, the receiving device 20U has an absolute structure that can be arranged on the supporter 30P, so as to be solely and suspendingly arranged on the supporter 30P. Therefore, when the receiving device 20U or a receiving body 21U of the receiving device 20U is removed or detached from the supporter 30P, it will not affect the overall aesthetic of the bed.

Figure 29A:
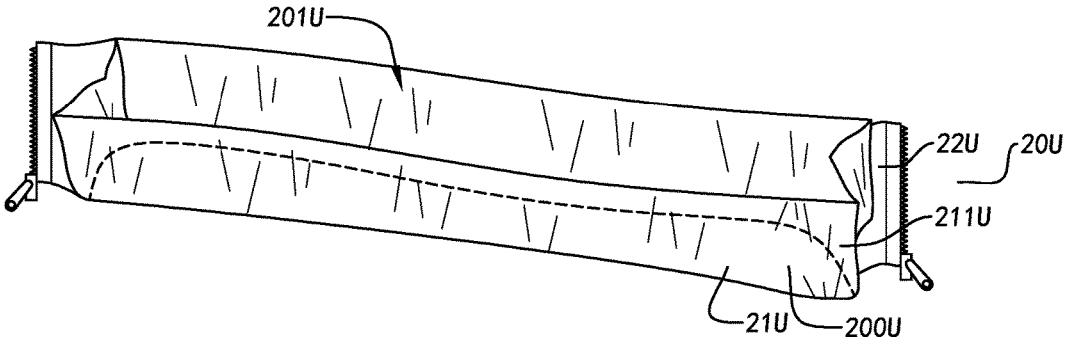
FIG. 29A illustrates an alternative of the receiving device of bed according to the above fifth preferred embodiment of the present invention.
Figure 29B:
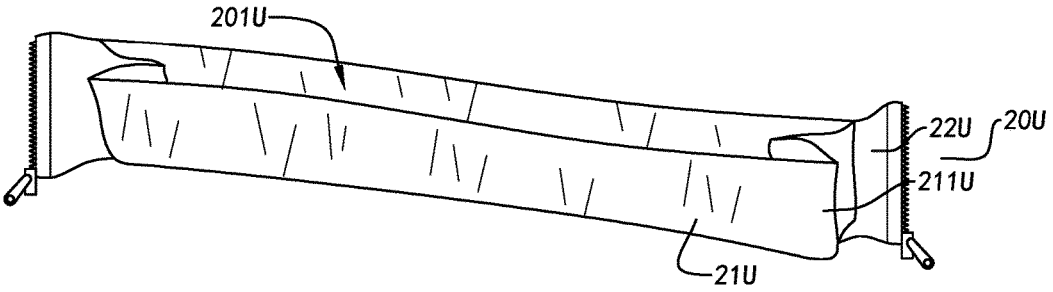
FIG. 29B illustrates another alternative of the receiving device of bed according to the above fifth preferred embodiment of the present invention.

As shown in FIGS. 29A and 29B, wherein the receiving device 20U of the bed according to the above fifth preferred embodiment of the present invention is further arranged to be openable and retractable. When the receiving device 20U is opened, the receiving device 20U forms a receiving cavity 200U, wherein the receiving cavity 200U has a receiving opening 201P. When the receiving device 20U is retracted, the receiving device 20U is folded so as to occupy a smaller space. Person skilled in the art would understand that the receiving device 20U can be arranged to allow a user to manually unfold and pack up the receiving device 20U. The receiving device 20U can also be arranged to remain open when it is arranged at the supporter 30P of the bed. The receiving device 20U can also be arranged to be remained opened when the receiving device 20U is arranged on the supporter 30P of the bed. When the supporter 30P and/or the bed panel 10P of the bed is folded, the receiving device 20U will be folded and retracted as well.

Figure 25A:
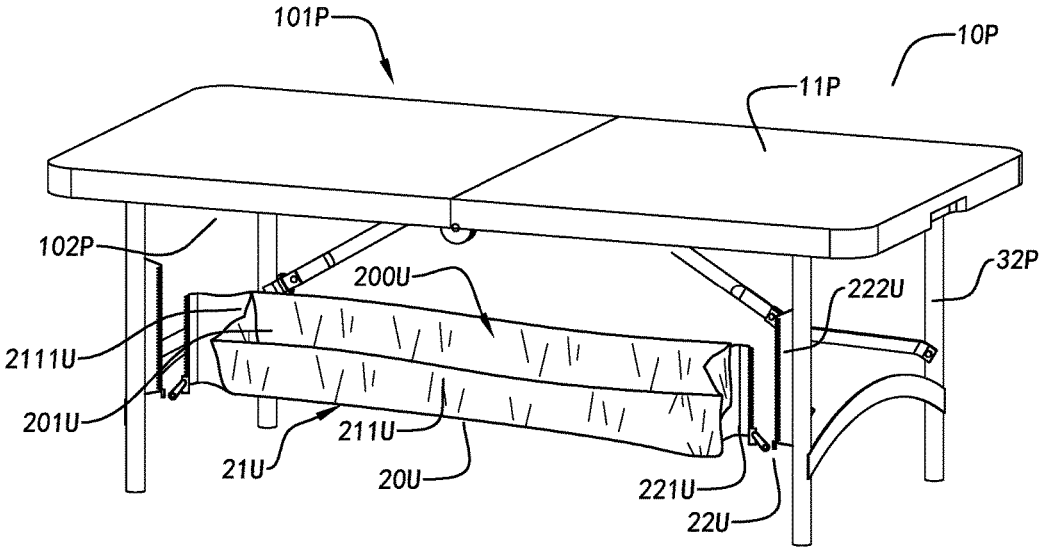
FIG. 25A is a perspective view of the bed according to a fifth preferred embodiment of the present invention, illustrating the receiving device of the bed being arranged on the supporter of the bed.

As shown in FIG. 25A, the receiving device 20U of the bed according to a fifth preferred embodiment of the present invention comprises a receiving body 21U and at least one connecting element 22U. The receiving body 21U forms the receiving cavity 200U. The connecting element 22U is respectively arranged on the receiving body 21U and the supporter 30P of the bed.

It is understandable that the receiving body 21U of the receiving device 20U or the main structure of the receiving device 20U is made of soft material, so that when the receiving device 20U is arranged on the supporter 30P, the receiving body 21U of the receiving device 20U will not affect the folding of the supporter 30P and/or the bed panel 10P. Person skilled in the art would understand that the soft material is preferably soft material(s) of cotton, hemp, silk, wool, chemical fiber, etc. The soft material can also be other material suitable for producing the receiving body 21U of the receiving device 20U. Person skilled in the art would understand that the receiving device 20U further comprises a supporting shelf, wherein the receiving body 21U of the receiving device 20U is arranged on the supporting shelf and the supporting shelf is arranged to be able to keep the receiving body 21U in the open state. Preferably, the supporting shelf of the receiving device 20U is a foldable supporting shelf, so that the receiving device 20U can be folded into the folded state.

As shown in FIGS. 25A to 27C, the supporter 30P of the bed according to a fifth preferred embodiment of the present invention, comprises a supporting frame 31P and at least one supporting leg 32P. The supporting frame 31P of the supporter 30P is arranged on the bottom surface 12P of the bed panel 10P. The supporting leg 32P of the supporter 30P is arranged on the supporting frame 31P of the supporter 30P. As shown in FIGS. 25A to 27C, the supporter 30P further comprises at least two supporting legs 32P.

As shown in FIG. 25A, the receiving device 20U of the bed according to a fifth preferred embodiment of the present invention comprises a receiving body 21U and two connecting elements 22U. The receiving body 21U comprises two side walls 211P. Each of the connecting elements 22U comprises a first connector 221P and a second connector 222P. The two side walls 211P of the receiving body 21U are separately arranged and each side wall 211P has two ends 2111P. The first connectors 221P of the connecting elements 22U are respectively arranged on the two ends 2111P of one side wall 211P of the receiving body 21U. The second connector 222P of one connecting element 22U of the two connecting elements 22U of the receiving device 20U is arranged on one supporting leg 32P of the supporter 30P, and the second connector 222P of another connecting element 22U is arranged on another supporting leg 32P of the supporter 30P. In other words, the receiving device 20U is arranged between two supporting legs 32P of the supporter 30P. Besides, when the receiving device 20U is arranged between the two supporting legs 32P of the supporter 30P because the two connecting elements 22U of the receiving device 20U are both arranged on the same side wall 211P of the receiving body 21U of the receiving device 20U, the two side walls 211P of the receiving body 21U of the receiving device 20U will be kept separated under the influence of gravity, so as to cause the receiving body 21U of the receiving device 20U remained opened.

As shown in FIG. 25A, the second connector 222P and the first connector 221P of the connecting element 22U are arranged to be able to detachably connected together, so that the receiving body 21U of the receiving device 20U can be detached from the supporter 30P. As shown in FIG. 25A, the connecting element 22U of the receiving device 20U preferably has a zipper structure, wherein the first connector 221P and the second connector 222P of the connecting element 22U can be zipped together. As shown in FIG. 25A, the first connector of the second connector 222P of the connecting element 22U have a toothed chain 2211P or 2221P, such that the connecting element 22U has a zipper structure and the first connector 221P and the second connector 222P of each connecting element 22U can be zipped together. Hence, the connecting type between the first connector 221P and the second connector 222P of the connecting element 22U of the receiving device 20U is zipping type.

Alternatively, the connecting element 22U of the receiving device 20U has a hanger structure, so that the receiving device 20U can be hung on the supporter 30P. In other words, the connecting element 22U can be a hanger, so that the receiving body 21U of the receiving device 20U can be detachably hung on the hanger.

Figure 25B:
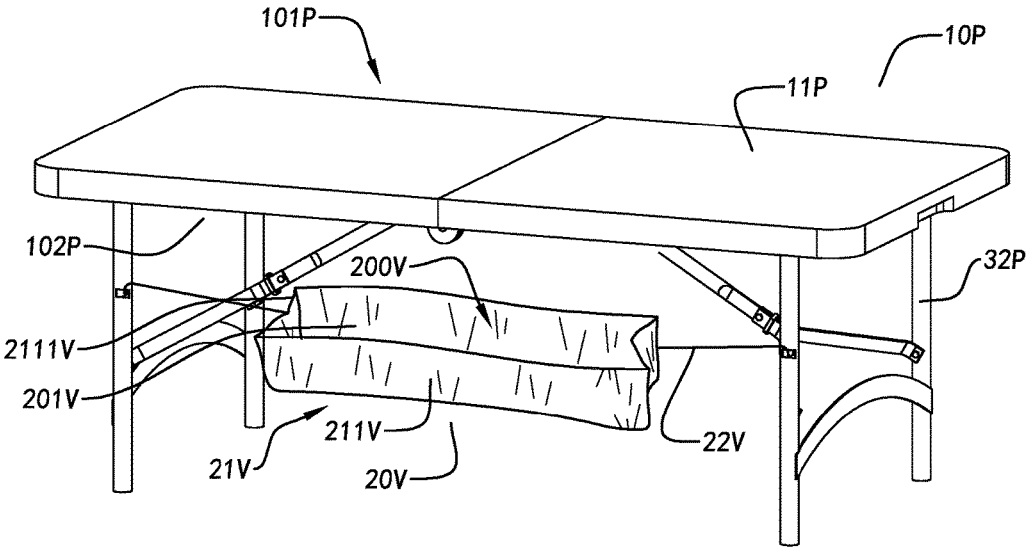
FIG. 25B illustrates an alternative of the receiving device of the bed according to the above fifth preferred embodiment of the present invention.

FIG. 25B of the drawings illustrates an alternative of the receiving device 20U of the bed according to the above fifth preferred embodiment of the present invention. A connecting element 22V of the two connecting elements 22V of the receiving device 20V is respectively arranged on an end portion 2111V of a side wall 211V of the receiving body 21V and a supporting leg 32P of the supporter 30P. Another connecting element 22V is respectively arranged on another end portion 2111V of the side wall 211V of the receiving body 21V and another supporting leg 32P of the supporter 30P. Therefore, the receiving device 20V is arranged between two supporting legs 32P of the supporter 30P. Besides, when the receiving device 20V is arranged between the two supporting legs 32P of the supporter 30P because the two connecting elements 22V of the receiving device 20V are both arranged on the same side wall 211V of the receiving body 21V of the receiving device 20V, the two side walls 211V of the receiving body 21V of the receiving device 20V will be kept separated under the influence of gravity, so as to cause the receiving body 21V of the receiving device 20V remained opened. Preferably, the connecting element 22V of the receiving device 20V has a linear structure, so as to make the connecting element 22V of the receiving device 20V be respectively detachably tied on the two supporting legs 32P of the supporter 30P. Therefore, the connecting type of the connecting element 22V of the receiving device 20V and the supporting leg(s) 32P of the supporter 30P is rope tying type.

Figure 25C:
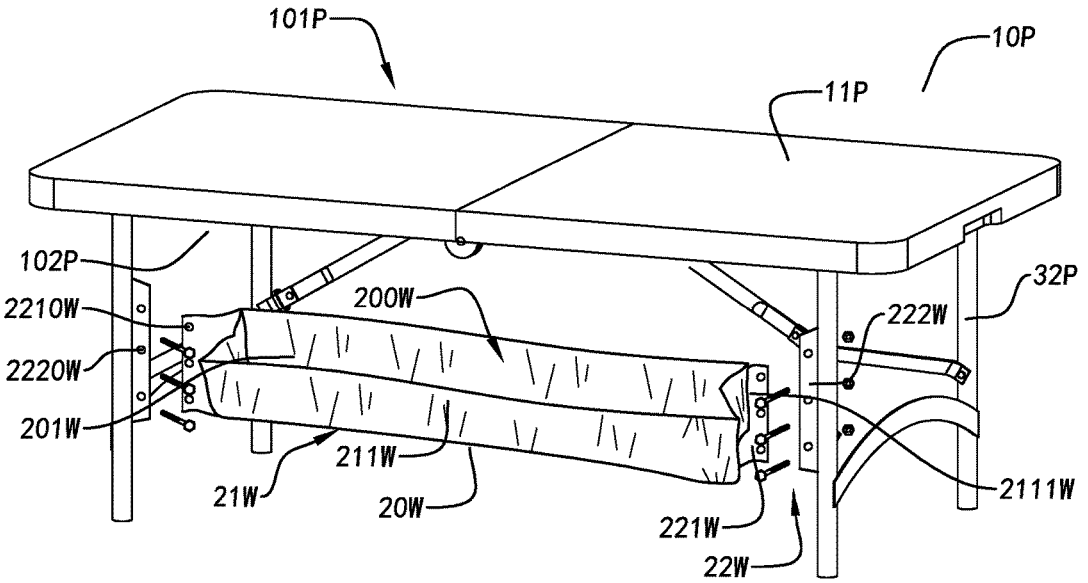
FIG. 25C illustrates another alternative of the receiving device of the bed according to the above fifth preferred embodiment of the present invention.

FIG. 25C of the drawings refers to an alternative of the receiving device 20U of the bed according to the above fifth preferred embodiment of the present invention, wherein the receiving device 20W comprises a receiving body 21W and two connecting elements 22W. The receiving body 21W comprises two side walls 211W. Each of the connecting elements 22W comprises a first connector 221W and a second connector 222W. The two side walls 211W of the receiving body 21W are separately arranged and each side wall 211W has two ends 2111W. The first connectors 221W of the connecting elements 22W are respectively arranged on the two ends 2111W of one side wall 211W of the receiving body 21W. The second connector 222W of one connecting element 22W of the two connecting elements 22W of the receiving device 20W is arranged on one supporting leg 32P of the supporter 30P, and the second connector 222W of another connecting element 22W is arranged on another supporting leg 32P of the supporter 30P. In other words, the receiving device 20W is arranged between two supporting legs 32P of the supporter 30P. Besides, when the receiving device 20W is arranged between the two supporting legs 32P of the supporter 30P because the two connecting elements 22W of the receiving device 20W are both arranged on the same side wall 211W of the receiving body 21W of the receiving device 20W, the two side walls 211W of the receiving body 21W of the receiving device 20W will be kept separated under the influence of gravity, so as to cause the receiving body 21W of the receiving device 20W remained opened.

As shown in FIG. 25C, the second connector 222W and the first connector 221W of the connecting element 22W are arranged to respectively have at least one screw hole 2210W or 2220W, so that the first connector 221W and the second connector 222W can be detachably screwed with each other. Thus, the receiving body 21W of the receiving device 20W can be detached or removed from the supporter 30P. As shown in FIG. 25C, the connecting element 22W of the receiving device 20W further comprises at least one screw 223W. The screw 223W can screw the first connector 221W and the second connector 222W through the screw holes 2210W and 2220W thereof. Therefore, the connecting type of the connecting element 22W of the receiving device 20W and the supporting leg(s) 32P of the supporter 30P is screwing type.

Figure 25D:
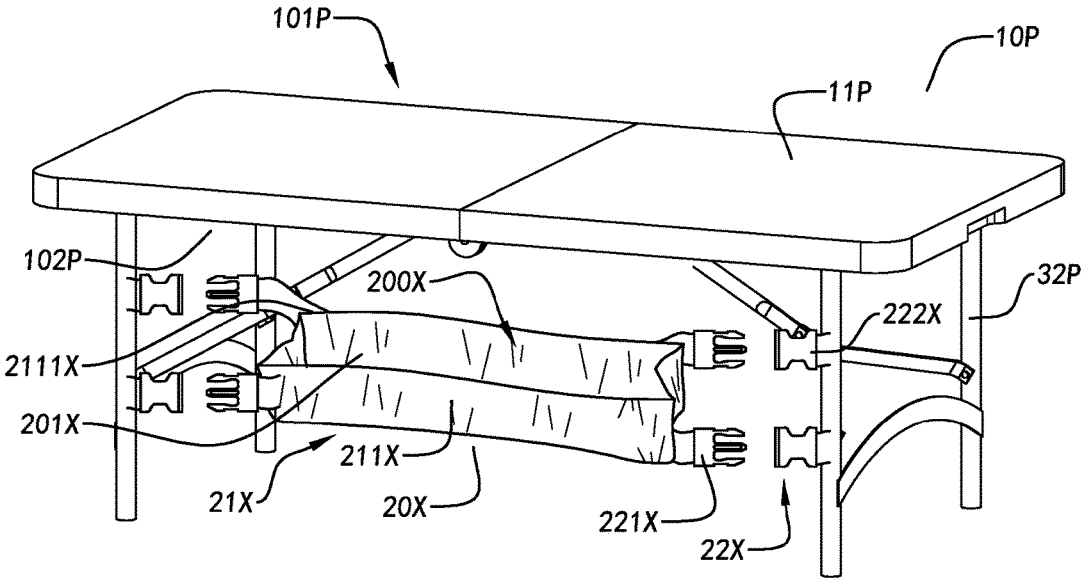
FIG. 25D illustrates another alternative of the receiving device of the bed according to the above fifth preferred embodiment of the present invention.

FIG. 25D of the drawings refers to an alternative of the receiving device 20P of the bed according to the above fifth preferred embodiment of the present invention, wherein the receiving device 20X comprises a receiving body 21X and two connecting elements 22X. The receiving body 21X comprises two side walls 211X. Each of the connecting elements 22X comprises a first connector 221X and a second connector 222X. The two side walls 211X of the receiving body 21X are separately arranged and each side wall 211X has two ends 2111X. The first connectors 221X of the connecting elements 22X are respectively arranged on the two ends 2111X of one side wall 211X of the receiving body 21X. The second connector 222X of one connecting element 22X of the two connecting elements 22X of the receiving device 20X is arranged on one supporting leg 32P of the supporter 30P, and the second connector 222X of another connecting element 22X is arranged on another supporting leg 32P of the supporter 30P. In other words, the receiving device 20X is arranged between two supporting legs 32P of the supporter 30P. Besides, when the receiving device 20X is arranged between the two supporting legs 32P of the supporter 30P because the two connecting elements 22X of the receiving device 20X are both arranged on the same side wall 211X of the receiving body 21X of the receiving device 20X, the two side walls 211X of the receiving body 21X of the receiving device 20X will be kept separated under the influence of gravity, so as to cause the receiving body 21X of the receiving device 20X remained opened.

As shown in FIG. 25D, the second connector 222X and the first connector 221X of the connecting element 22X are arranged to be able to detachably connected together, so that the receiving body 21X of the receiving device 20X can be detached or removed from the supporter 30P. As shown in FIG. 25D, the connecting element 22X of the receiving device 20X is a detachable buckle, so as allow the first connector 221X and the second connector 222X of the connecting element 22X to be detachably locked or buckled together. As shown in FIG. 25D, the first connector 221X of the connecting element 22X is arranged to have an engaging end structure of a detachable buckle, wherein the second connector 222X is arranged to have a locking end of a detachable buckle, such that the first connector 221X and the second connector 222X of the connecting element 22X can be locked or buckled together. Alternatively, the first connector 221X of the connecting element 22X is arranged to have a locking end structure of a detachable buckle, wherein the second connector 222X is arranged to have an engaging end of a detachable buckle, such that the first connector 221X and the second connector 222X of the connecting element 22X can be locked or buckled together. Therefore, the connecting type of the connecting element 22X of the receiving device 20X and the supporting leg(s) 32P of the supporter 30 is buckling type.

Figure 25E:
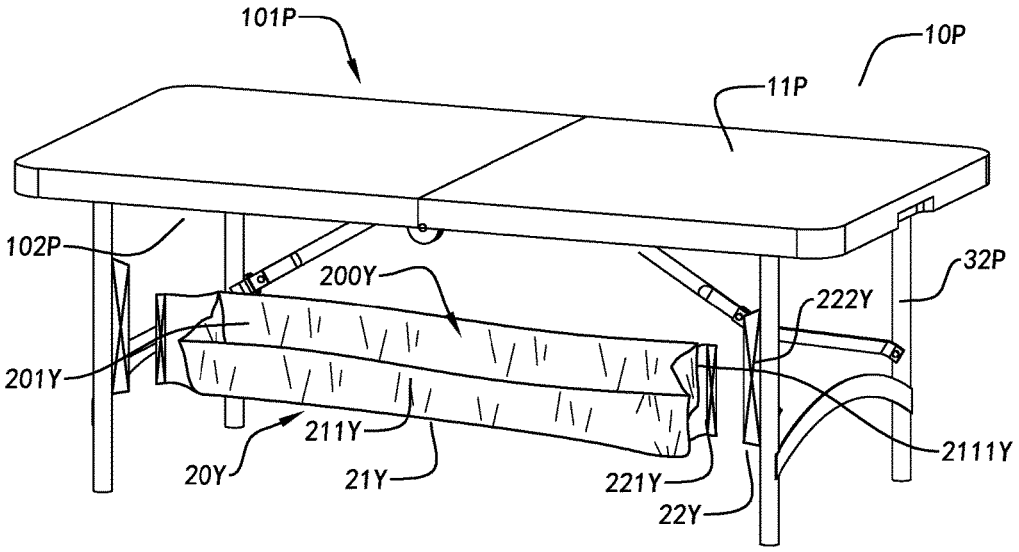
FIG. 25E illustrates another alternative of the receiving device of the bed according to the above fifth preferred embodiment of the present invention.

FIG. 25E of the drawings refers to an alternative of the receiving device 20U of the bed according to the above fifth preferred embodiment of the present invention, wherein the receiving device 20Y comprises a receiving body 21Y and two connecting elements 22Y. The receiving body 21Y comprises two side walls 211Y. Each of the connecting elements 22Y comprises a first connector 221Y and a second connector 222Y. The two side walls 211Y of the receiving body 21Y are separately arranged and each side wall 211Y has two ends 2111Y. The first connectors 221Y of the connecting elements 22Y are respectively arranged on the two ends 2111Y of one side wall 211Y of the receiving body 21Y. The second connector 222Y of one connecting element 22Y of the two connecting elements 22Y of the receiving device 20Y is arranged on one supporting leg 32P of the supporter 30P, and the second connector 222Y of another connecting element 22Y is arranged on another supporting leg 32P of the supporter 30P. In other words, the receiving device 20Y is arranged between two supporting legs 32P of the supporter 30P. Besides, when the receiving device 20Y is arranged between the two supporting legs 32P of the supporter 30P because the two connecting elements 22Y of the receiving device 20Y are both arranged on the same side wall 211Y of the receiving body 21Y of the receiving device 20Y, the two side walls 211Y of the receiving body 21Y of the receiving device 20Y will be kept separated under the influence of gravity, so as to cause the receiving body 21Y of the receiving device 20Y remained opened.

As shown in FIG. 25E, the second connector 222Y and the first connector 221Y of the connecting element 22Y are arranged to be able to detachably connected together, so that the receiving body 21Y of the receiving device 20Y can be detached or removed from the supporter 30P. As shown in FIG. 25E, the connecting element 22Y of the receiving device 20Y is a hook and loop fastener or magic tape so as allow the first connector 221Y and the second connector 222Y of the connecting element 22Y to be detachably hook-loop fastened together. As shown in FIG. 25E, the first connector 221Y of the connecting element 22Y is arranged to have a hook structure of a hook and loop fastener, wherein the second connector 222Y is arranged to have a loop structure of a hook and loop fastener, such that the first connector 221Y and the second connector 222Y of the connecting element 22Y can be hook-loop fastened together. Alternatively, the first connector 221Y of the connecting element 22Y is arranged to have a loop structure of a hook and loop fastener, wherein the second connector 222Y is arranged to have a hook structure of a hook and loop fastener, such that the first connector 221Y and the second connector 222Y of the connecting element 22Y can be hook-loop fastened together. Therefore, the connecting type of the connecting elements 22Y of the receiving device 20Y and the supporting legs 32P of the supporter 30P is hook-loop fastening or bonding type.

Figure 25F:
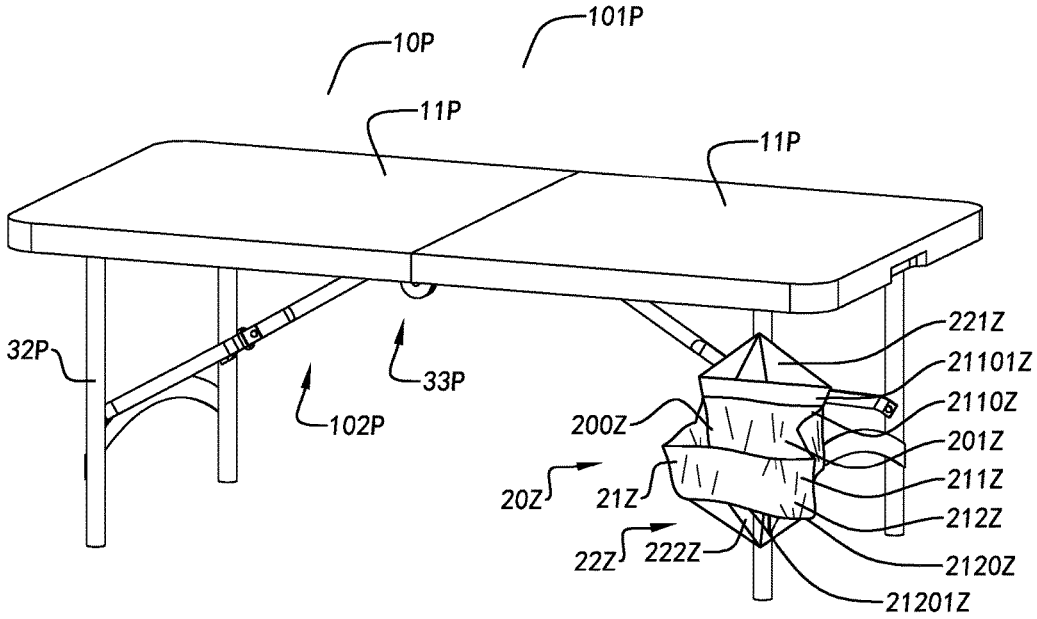
FIG. 25F illustrates another alternative of the receiving device of the bed according to the above fifth preferred embodiment of the present invention.

FIG. 25F of the drawings illustrate an alternative of the receiving device 20U of the bed according to the above fifth preferred embodiment of the present invention, wherein the receiving body 21Z of the receiving device 20Z comprises an upper end 211Z and a lower end 212Z extended downwardly from the upper end 211Z. The upper end 211Z forms an upper end periphery 2110Z, and the lower end 212Z forms a lower end periphery 2120Z. The upper end periphery 2110Z forms a receiving opening 201Z. The connecting element 22Z comprises at least one first connector 221Z and at least one second connector 222Z. The first connector 221Z is arranged on the upper end periphery 2110Z of the upper end 211Z of the receiving device 20Z and is slantly extended upwardly and inwardly from the upper end periphery 2110Z to the supporter 30. The second connector 222Z is arranged at the lower end periphery 2120Z of the lower end 212Z of the receiving device 20Z and is slantly extended downwardly and inwardly from the lower end periphery 2120Z to the supporter 30P. Preferably, the first connector 221Z is arranged on an inner side 21101Z of the upper end periphery 2110Z of the upper end 211Z of the receiving device 20Z, and the second connector 222Z is arranged on an outer side 21201Z of the lower end periphery 2120Z of the lower end 212Z of the receiving device 20Z, so as to help to keep the receiving device 20Z opened. More preferably, the first connector 221Z and the second connector 222Z of the connecting element 22Z of the receiving device 20Z are respectively detachably arranged on the upper end periphery 2110Z of the upper end 211Z of the receiving body 21Z of the receiving device 20Z and the lower end periphery 2120Z of the lower end 212Z of the receiving body 21Z of the receiving device 20Z. The first connector 221Z and the second connector 222Z of the connecting element 22Z of the receiving device 20Z can also be respectively and detachably arranged on the supporter 30P. Most preferably, the first connector 221Z and the second connector 222Z of the connecting element 22Z of the receiving device 20Z are respectively linear. Alternatively, the first connector 221Z and the second connector 222Z of the connecting element 22Z of the receiving device 20Z are respectively band shaped.

As shown in FIGS. 25F to 27C, the supporter 30P comprises a supporting frame 31P and a plurality of supporting legs 32P. The supporting frame 31P of the supporter 30P is arranged on the bottom surface 12P of the bed panel 10P. Each of the supporting legs 32P is arranged on the supporting frame 31P of the supporter 30P. The first connector 221Z of the connecting element 22Z of the receiving device 20Z is respectively arranged on the upper end periphery 2110Z of the upper end 211Z of the receiving device 20Z and one supporting leg 32P of the supporter 30P. The second connector 222Z is respectively arranged on the lower end periphery 2120Z of the lower end 212Z of the receiving device 20Z and the supporting leg 32P of the supporter 30P.

FIGS. 26A to 26D of the drawings illustrates an alternative of the receiving device 20U of the bed according to the above fifth preferred embodiment of the present invention, wherein the receiving device 20*a* comprises a receiving body 21*a* and a connecting element 22*a* extended from the receiving body 21*a*. The bed panel 10 of the bed and the supporting frame 31P of the supporter 30 form a housing space 310P therebetween. The receiving body 21*a* of the receiving device 20*a* is arranged to be foldable and after the receiving body 21*a* of the receiving device 20*a* is folded, it can pass the housing space 310P, so as to allow the receiving body 21*a* to be kept in the housing space 310P by the supporting frame 31P of the supporter 30P. In other words, the receiving body 21*a* of the receiving device 20*a* is arranged on the supporting frame 31P of the supporter 30P and the receiving body 21*a* can be arranged in the housing space 310P after folded.

As shown in FIGS. 26A to 26D, the connecting element 22*a* of the receiving device 20*a* is arranged on the supporting frame 31P of the supporter 30P. Preferably, the connecting element 22*a* of the receiving device 20*a* is detachably screwed at the supporting frame 31P of the supporter 30P. Alternatively, the connecting element 22*a* of the receiving device 20*a* is fixedly arranged on the supporting frame 31P of the supporter 30P. More preferably, the receiving body 21*a* of the receiving device 20*a* can be detachably arranged through zipper zipping, roping, budding, hook and loop fastening, etc.

As shown in FIGS. 26A to 26D, the supporter 30P of the bed according to the above fifth preferred embodiment of the present invention, comprises a supporting frame 31P arranged on the bottom surface 12P of the bed panel 10P and at least two supporting legs 32P respectively arranged on the supporting frame 31P of the supporter 30P. The supporting legs 32P are respectively arranged to pivot with respect to each other to the bottom surface 12P of the bed panel 10P, so that the supporting legs 32P can be folded on the bottom surface 11P of the bed panel 10P. In other words, the supporter 30P of the bed is a foldable supporter.

Figure 26A:
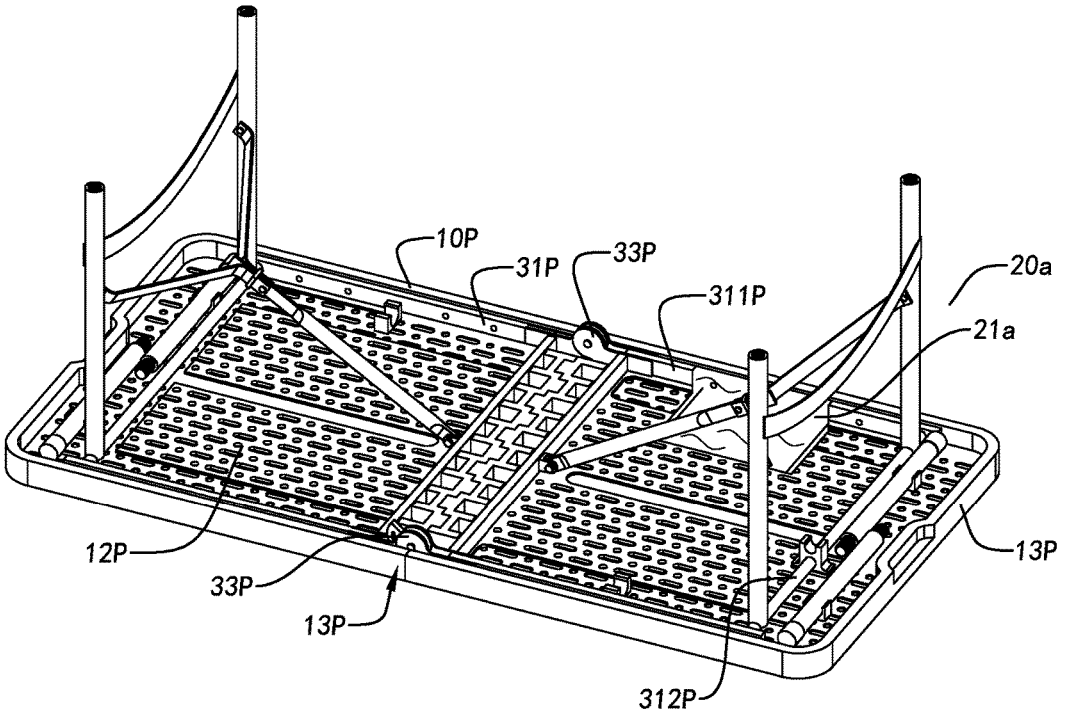
FIG. 26A is a perspective view of the bed according to the above fifth preferred embodiment of the present invention, illustrating the supporter of the bed being in an unfolded state and the receiving device of the bed being arranged between the supporter of the bed and the bed panel of the bed.
Figure 26B:
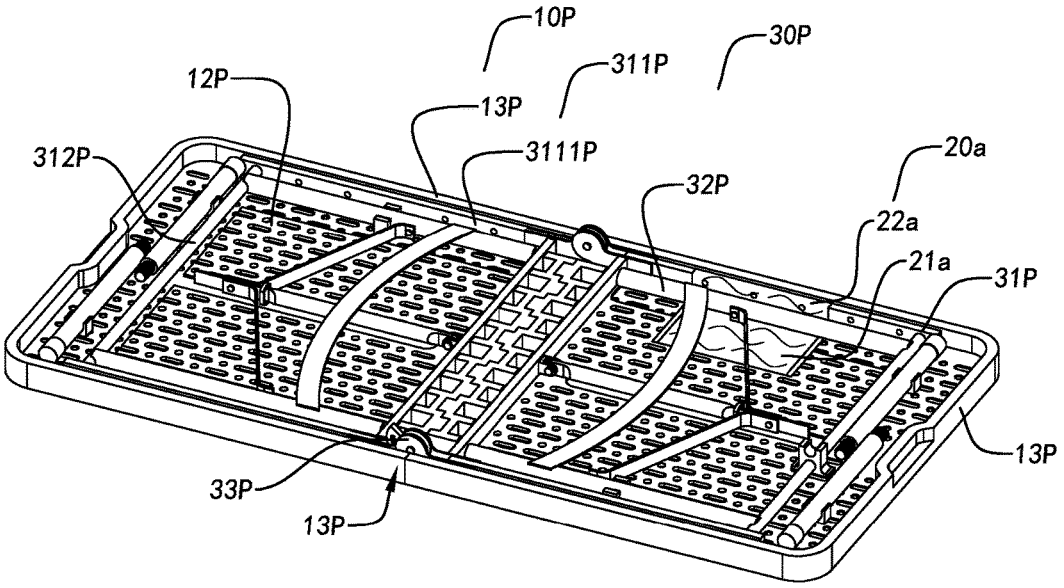
FIG. 26B is a perspective view of the bed according to the above fifth preferred embodiment of the present invention, illustrating the supporter of the bed being in a folded state.
Figure 26C:
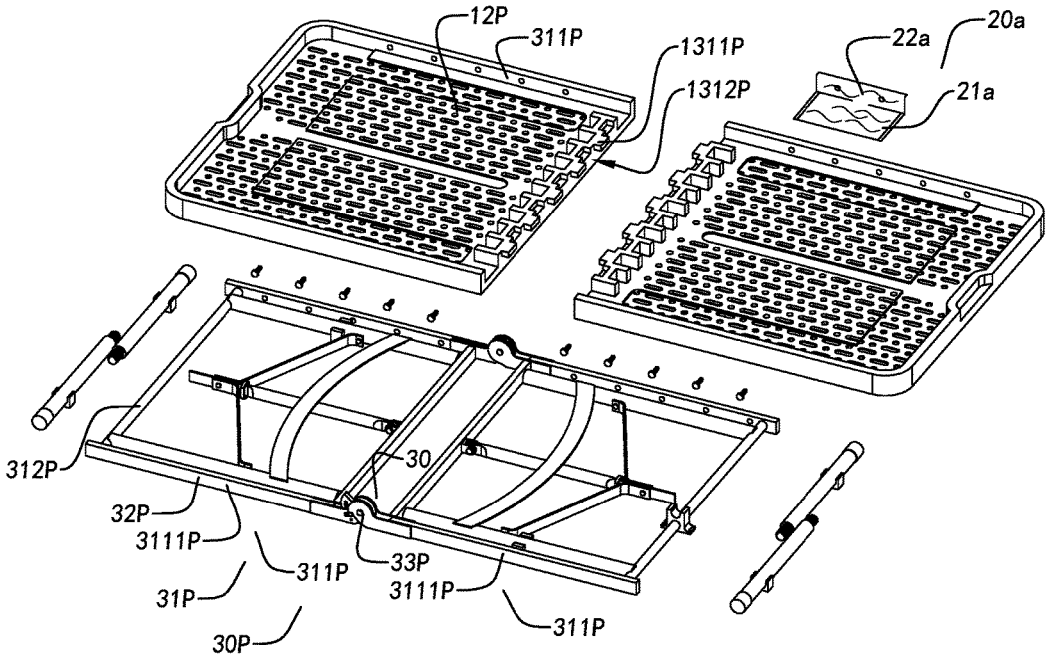
FIG. 26C is an exploded view of the bed according to the above fifth preferred embodiment of the present invention.
Figure 26D:
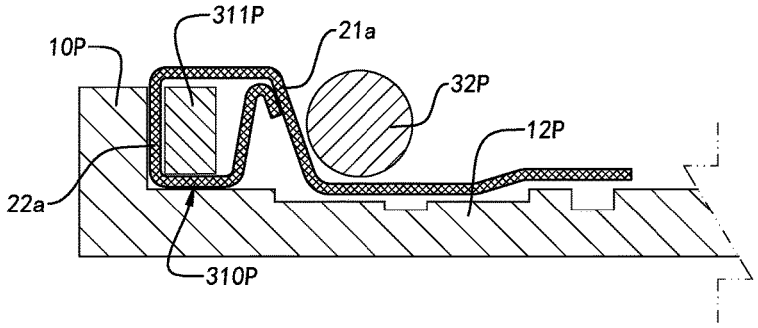
FIG. 26D is a partial sectional view of the bed according to the above fifth preferred embodiment of the present invention.

As shown in FIGS. 26A to 26C, the supporting frame 31P of the supporter 30P comprises two transverse members 311P separately arranged on the bottom surface 12P of the bed panel 10P and two longitudinal members 312P separately arranged between the two transverse members, wherein each longitudinal member 312P is pivotally arranged between the transverse members 311P of the supporting frame 31P, wherein the supporting leg(s) 32P of the supporter 30P is respectively arranged on the two longitudinal members 312P of the supporting frame 31P, so as to allow the supporting leg(s) 32P of the supporter 30P be arranged to be pivotally with respect to the bottom surface 12P of the bed panel 10P.

Figure 28A:
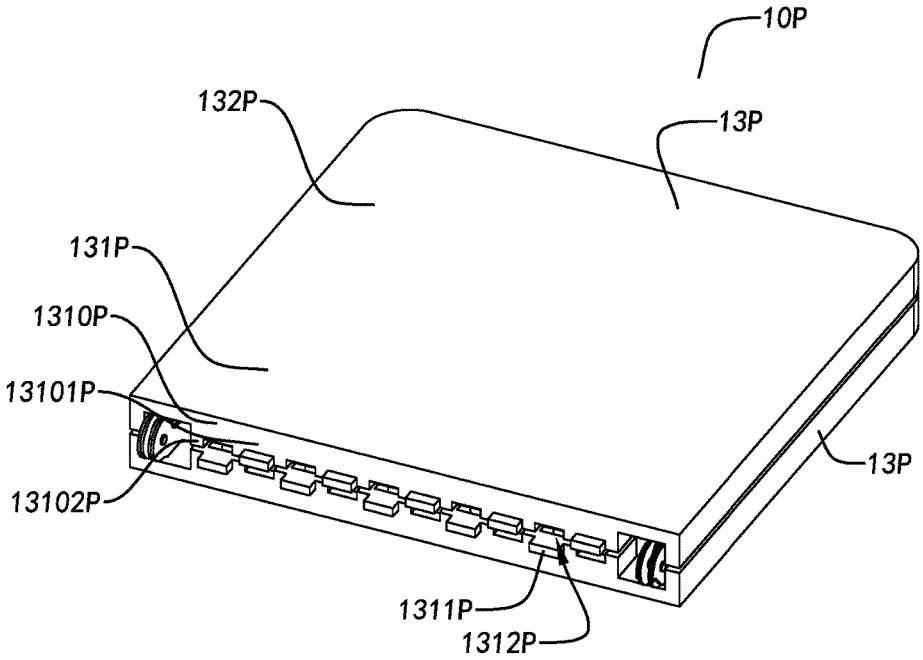
FIG. 28A is a perspective view of the bed panel of the bed according to the above fifth preferred embodiment of the present invention, illustrating the bed panel of the bed being in a folded state.
Figure 28B:
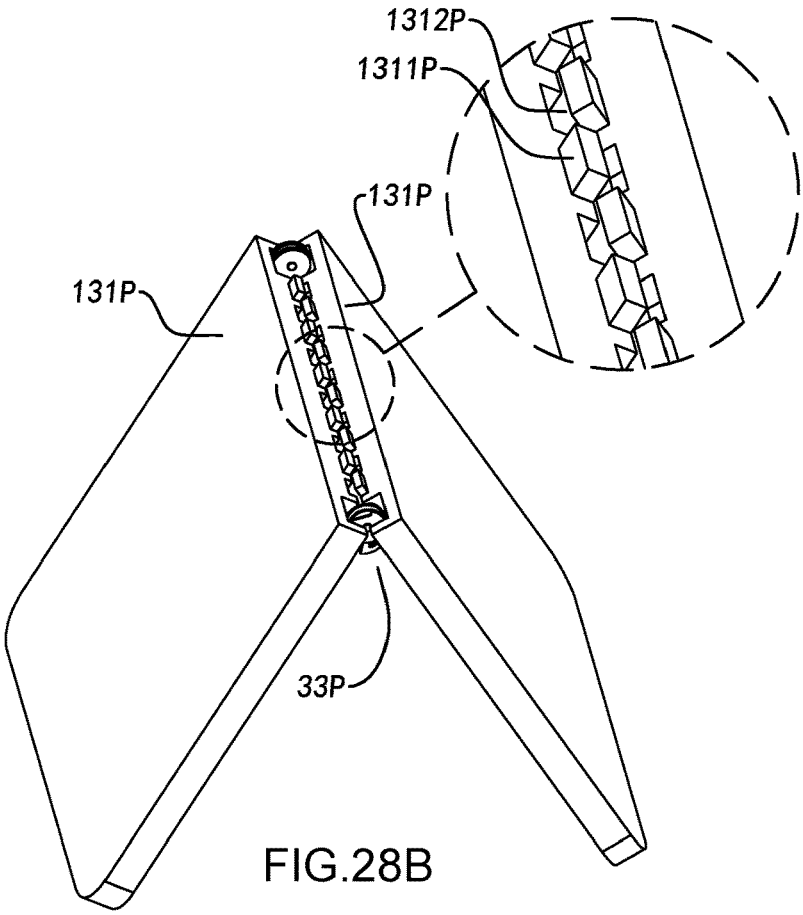
FIG. 28B is a perspective view illustrating the connection relationship of two pivoting portions of the bed panel of the bed according to the above fifth preferred embodiment of the present invention.
Figure 28C:
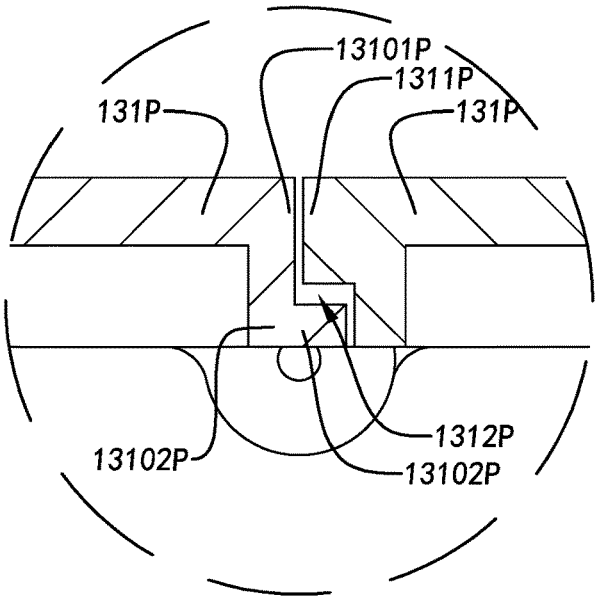
FIG. 28C is a partial sectional view of the bed panel of the bed according to the above fifth preferred embodiment of the present invention.

As shown in FIGS. 28A to 28C, the bed panel 10P of the bed, according to the above fifth preferred embodiment of the present invention, comprises two pivoting portions 13P, wherein the two pivoting portions 13P of the bed panel 10P are arranged to be pivotally relatively movable, so that the bed panel 10P can be folded to occupy a smaller space and be unfolded to form the bed surface 11P of the bed panel 10P.

Figure 27A:
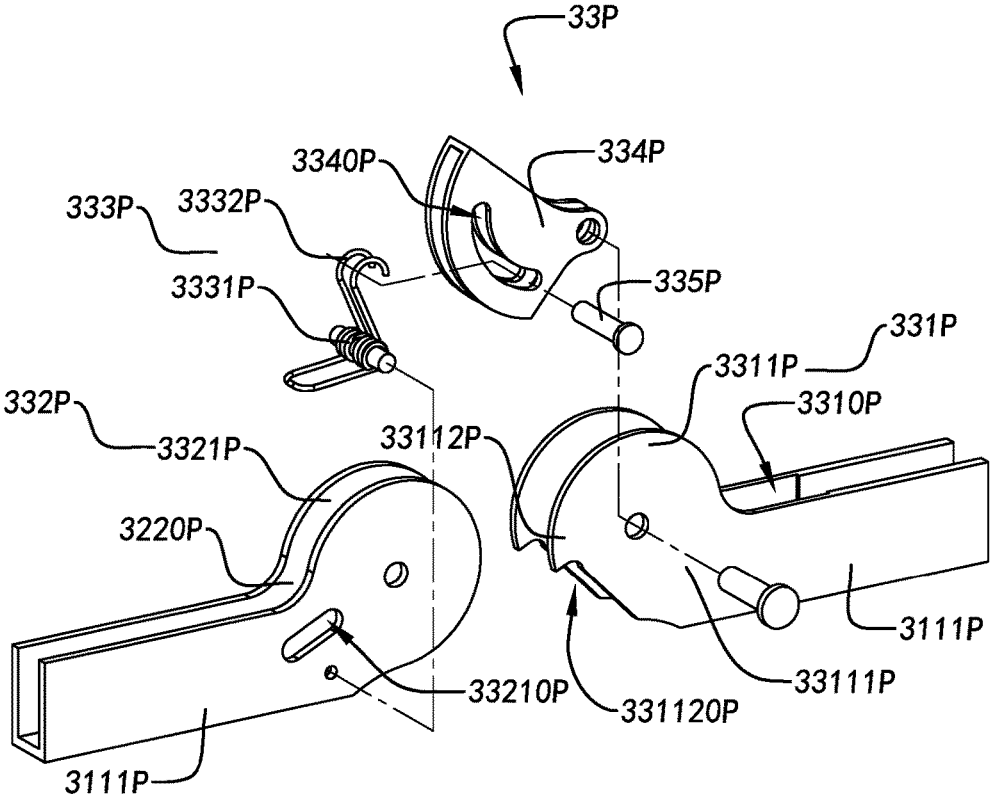
FIG. 27A is an exploded view of the locker of the bed according to the above fifth preferred embodiment of the present invention.
Figure 27B:
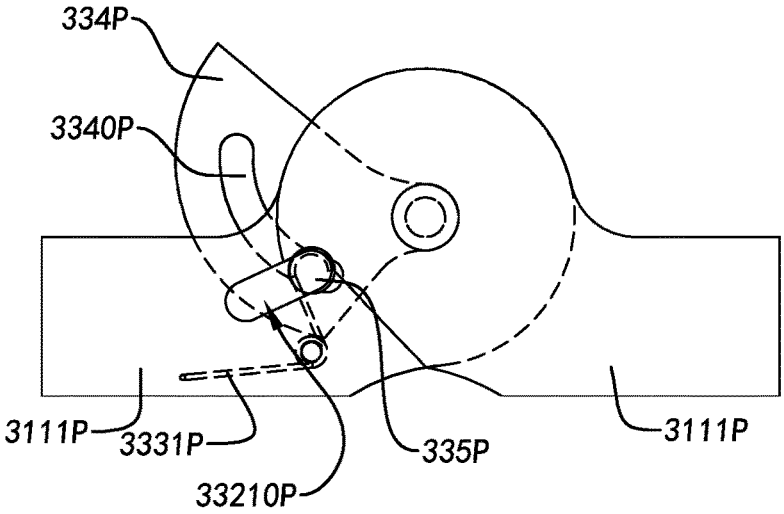
FIG. 27B illustrates the transverse member of the bed according to the above fifth preferred embodiment of the present invention being kept unfolded by the locker.
Figure 27C:
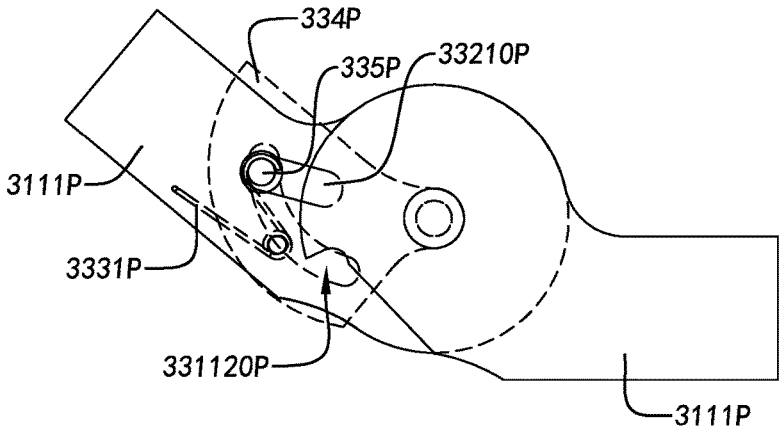
FIG. 27C illustrates the locker of the bed allowing the transverse member of the supporter of the bed to be folded according to the above fifth preferred embodiment of the present invention.

As shown in FIGS. 27A to 27C, the supporter 30P further comprises two lockers 33P. Each transverse member 311P of the supporting frame 31P of the supporter 30P comprises two supporting elements 3111P. Each locker 33P is arranged between the two supporting elements 3111P of the transverse member 311P of the supporting frame 31P of the supporter 30P. The locker 33P is arranged to allow the two supporting elements 3111P of the transverse member 311P of the supporting frame 31P to pivot with respect to each other.

As shown in FIGS. 27A to 27C, each locker 33P of the supporter 30P is arranged to have a locked state and an unlocked state. When the locker 33P is in the locked state, the locker 33P can prevent the two supporting elements 3111P of the transverse member 311P to pivot with respect to each other, and when the locker 33P is in the unlocked state, the locker 33P allows the two supporting elements 3111P to freely pivot with respect to each other. Person skilled in the art would understand that because the supporting frame 31P of the supporter 30P is arranged on the bottom surface 12P of the bed panel 10P, when the locker 33P is set in the locked state, the two pivoting portions 13P of the bed panel 10P will be kept unfolded and opened to form the bed surface 11P. When the locker 33P is set in the unlocked state, the locker 33P will allow the two supporting elements 3111P of the transverse member 311P to pivot with respect to each other and allow the two pivoting portions 13P of the bed panel 10P to pivot with respect to each other.

As shown in FIGS. 27A to 27C, the locker 33P of the supporter 30P of the bed according to the above fifth preferred embodiment of the present invention, comprises a first locking unit 331P, a second locking unit 332P, a holder 333P, an operating portion 334P, and a locking member 335P.

As shown in FIGS. 27A to 27C of the drawings, the first locking unit 331P comprises two first walls 3311P. The second locking unit 332P comprises two second walls 3321P. The two first walls 3311P of the first locking unit 331P respectively extends outwardly from a supporting element 3111P of the transverse member 311P. The two second walls 3321P of the second locking unit 332P respectively extends outwardly from another supporting element 3111P of the transverse member 311P. The two first walls 3311P of the first locking unit 331P are separately arranged to form a first mounting groove 3310P therebetween. The two second wall 3321P of the second locking unit 332P are separately arranged to form a second mounting groove 3320P therebetween. Each of the first wall 3311P comprises an extending portion 33111P extended from the supporting element 3111P of the transverse member 311P and a locking portion 33112P extended from extending end 33111P. The locking portion 33112P forms a locking groove 331120P. Each second wall 3321P of the second locking unit 332P have a first guiding groove 33210P extended upwardly and outwardly. The operating portion 334P has a curvingly extended second guiding groove 3340P. The second locking unit 332P is arranged at the first mounting groove 3310P of the first locking unit 331P. The operating portion 334P is arranged at the second mounting groove 3320P of the second locking unit 332P. The first guiding groove 33210P of the second wall 3321P, the second guiding groove 3340P of the operating portion 334P, and the locking groove 331120P of the first wall 3311P are coincided, so as to allow the locking member 335P to penetrate the first guiding groove 33210P of the second wall 3321P, the second guiding groove 3340P of the operating portion 334P, and the locking groove 331120P of the first wall 3311P. The holder 333P is arranged in the second mounting groove 3320P and extended to the locking member 35P. Besides, the holder 333P is allowed to keep the locking member 335P in the second guiding groove 3340P. In other words, the locker 33P of the supporter 30P comprises a first locking unit 331P, a second locking unit 332P, a holder 333P, an operating portion 334P, and a locking member 335P. The first locking unit 331P has a first mounting groove 3310P and a locking groove 331120P. The two locking units 332P have a second mounting groove 3320P and a first guiding groove 33210P. The operating portion 334P has a curvingly extended second guiding groove 3340P. The second locking unit 332P is arranged at the first mounting groove 3310P of the first locking unit 331P. The operating portion 334P is pivotally arranged at the second mounting groove 3320P of the second locking unit 332P. The first guiding groove 33210P of the second wall 3321P, the second guiding groove 3340P of the operating portion 334P, and the locking groove 331120P of the first wall 3311P are coincided, so as to allow the locking member 335P to penetrate the first guiding groove 33210P of the second wall 3321P, the second guiding groove 3340P of the operating portion 334P, and the locking groove 331120P of the first wall 3311P. The holder 333P is allowed to keep the locking member 335P in the locking groove 331120P.

As shown in FIGS. 27A to 27C, the holder 333P of the locker 33P of the supporter 30P comprises a fixing end 3331P and a retaining end 3332P extended from the fixing end 3331P. The retaining end 3332P is arranged at the locking member 335P of the locker 33P of the supporter 30P and is allowed to hold the locking member 335P at a proper position, such that the locking member 335P will still be kept at the second guiding groove 3340P of the operating portion 334P. Preferably, the retaining end 3332P of the holder 333P is a resilient element, so as to provide a resilience to constantly keep the locking member 335P in the locking groove 331120P of the second locking unit 332P when the transverse member 31 is in an unfolded state.

Person skilled in the art would understand that the locker 33P of the supporter 30P is arranged for the following mechanism. On one hand, when the transverse member 311P of the supporter 30P is to be unfolded, the second locking unit 332P will be arranged in the first mounting groove 3310P of the first locking unit 331P, the operating portion 334P will be arranged in the second mounting groove 3320P of the second locking unit 332P, and the first guiding groove 33210P of the second wall 3321P, the second guiding groove 3340P of the operating portion 334P, and the locking groove 331120P of the first wall 3311P will be coincided. Thus, the locking member 335P can be arranged to penetrate the first guiding groove 33210P of the second wall 3321P, the second guiding groove 3340P of the operating portion 334P, and the locking groove 331120P of the first wall 3311P at the same time. Therefore, the locking member 335P will constantly be kept in the locking groove 331120P of the second locking unit 332P. On the other hand, when the transverse member 311P of the supporter 30P is to be folded, the second locking unit 332P will drive the locking member 335P to move upwardly along the second guiding groove 3340P of the operating portion 334P and drive the operating portion 334P to pivot with respect to each other to the first locking unit 331P, so as to make the transverse member 311P of the supporting frame 31P of the supporter 30P be folded. Person skilled in the art would understand that when the supporting frame 31P of the supporter 30P of the bed is foldable, the foldable bed panel 10P of the bed can be correspondingly folded as well.

As shown in FIGS. 28A to 28C, the bed panel 10P of the bed, according to the above fifth preferred embodiment of the present invention, comprises two pivoting portions 13P, wherein the two pivoting portions 13P of the bed panel 10P are arranged to be pivotally relatively movable, so that the bed panel 10P can be folded to occupy a smaller space and be unfolded to form the bed surface 11P of the bed panel 10P.

As shown in FIGS. 26A to 26D, the two pivoting portions 13P of the bed panel 10P is respectively arranged on the two supporting elements 3111P of each of the transverse members 311P of the supporting frame 31P of the supporter 30P. The two supporting elements 3111P of each of the transverse members 311P of the supporting frame 31P of the supporter 30P are arranged to pivot with respect to each other, so that the two pivoting portions 13P of the bed panel 10P can be relatively pivotally moved.

As shown in FIGS. 28A to 28C, each of pivoting portions 13P of the bed panel 10P comprises an engaging end 131P and a lengthening portion 132P extended outwardly from the engaging end 131P. The engaging end 131P of each of pivoting portions 13P of the bed panel 10P comprises a plurality of engaging teeth 1311P and has a plurality of engaging holes 1312P. The engaging teeth 1311P and the engaging holes 1312P of the engaging end 131P are interlacedly arranged, so that when the bed panel 10P is unfolded, the engaging ends 131P of the two pivoting portions 13P of the bed panel 10P can mutually engage each other, so as to enhance the intensity and loading capacity of the bed panel 10P.

As shown in FIGS. 28A to 28C, the engaging end 131P of the pivoting portion 13P of the bed panel 10P has an outer wall 1310P. The outer wall 1310P has an upper end portion 13101P and a lower end portion 13102P extended downwardly from the upper end portion 13101P. The engaging teeth 1311P and the engaging holes 1312P of the engaging end 131P are respectively interlacedly aligned on the upper end portion 13101P and the lower end portion 13102P of the outer wall 1310P of the engaging end 131P. The engaging teeth 1311P and the engaging holes 1312P of the engaging ends 131P of the two pivoting portions 13P of the bed panel 10P are arranged to correspond to each other, such that the upper end portions 13101P of the outer walls 1310P of the engaging ends 131P of the two pivoting portions 13P of the bed panel 10P can mutually engage each other and the lower end portions 13102P of the outer walls 1310P of the engaging ends 131P of the two pivoting portions 13P of the bed panel 10P can also mutually engage each other, which enhances the intensity and loading capacity of the bed panel 10P.

It should be noted that when the engaging ends 131P of the two pivoting portions 13P of the bed panel 10P are mutually engaged with each other, the two pivoting portions 13P of the bed panel 10P will form the bed surface 11P of the bed panel 10P and the bed surface 11P is a flat bed surface.

As shown in FIGS. 30A to 30E of the drawings of the present invention, the chair according to a sixth preferred embodiment of the present invention is illustrated. The chair comprises a seat base 10R made of plastic material, a seat back 20R arranged on the seat base 10R, and at least one receiving device 30R. The seat base 10R has a plurality of supporting legs 11R and a chair plate 12R supported by the supporting legs 11R. The supporting legs 11R are arranged to extend downwardly from the chair plate 12R of the seat base 10R and the supporting legs 11R are arranged to be able to support the chair plate 12R of the seat base 10R and to maintain the chair plate 12R of the seat base 10R in a horizontal condition. The receiving device 30R is arranged between the two supporting legs 11R. In other words, the supporting legs 11R support the chair plate 12R of the seat base 10R, so as to keep the chair plate 12R of the seat base 10R horizontal, so that objects can be stably placed on the chair plate 12R of the seat base 10R. Preferably, the chair plate 12R of the seat base 10R is flat. Person skilled in the art would understand that the chair plate 12R of the seat base 10R can be made by blow molding or injection molding. Preferably, the chair plate 12R of the seat base 10R is formed through blow molding. Preferably, the seat back 20R is pivotally arranged on the seat base 10R.

As shown in FIGS. 30A to 32, the seat base 10R of the chair according to a sixth preferred embodiment of the present invention, forms an upper space 101R and a lower space 102R. The upper space 101R is formed above the chair plate 12R of the seat base 10R, and the lower space 102R is formed below the chair plate 12R of the seat base 10R. The receiving device 30R is arranged in the lower space 102R. Person skilled in the art would understand that the receiving device 30R can be any structure that can be arranged on the supporting leg 11R of the chair for receiving objects. Hence, the receiving device 30R herein comprises all mechanisms that were known by person skilled in the art that can be arranged on the supporting leg 11R of the chair and can accommodate objects therein. Preferably, the receiving device 30R is detachably arranged on the supporting leg 11R of the chair. More preferably, the receiving device 30R is solely and suspendingly arranged on the supporting leg 11R. In other words, the receiving device 30R has an absolute structure that can be arranged on the supporting legs 11R, so as to be solely and suspendingly arranged on the supporting legs 11R. Therefore, when the receiving device 30R or a receiving body 31R of the receiving device 30R is removed or detached from the supporting legs 11R, it will not affect the overall aesthetic of the chair.

Figure 31A:
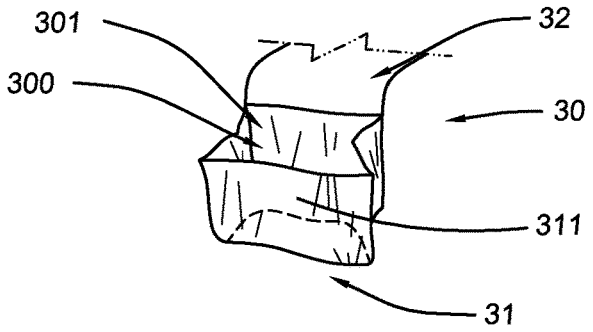
FIG. 31A is a perspective view of the receiving device of the chair according to the above sixth preferred embodiment of the present invention, illustrating the receiving device of the chair being in an unfolded state.
Figure 31B:
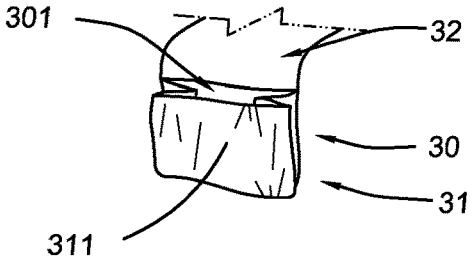
FIG. 31B is a perspective view of the receiving device of the chair according to the above sixth preferred embodiment of the present invention, illustrating the receiving device of the chair being in a folded state.
Figure 32:
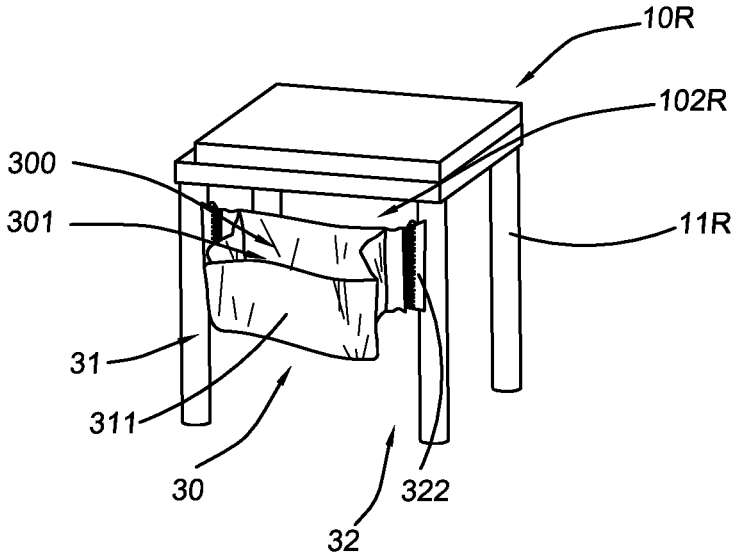
FIG. 32 is a perspective view of the chair according to the above sixth preferred embodiment of the present invention, illustrating the chair being in a folded state.

As shown in FIGS. 31A and 31B, wherein the receiving device 30R of the chair according to the above sixth preferred embodiment of the present invention is further arranged to be openable and retractable. When the receiving device 30R is opened, the receiving device 30R forms a receiving cavity 300R, wherein the receiving cavity 300R has a receiving opening 301R. When the receiving device 30R is retracted, the receiving device 30R is folded so as to occupy a smaller space. Person skilled in the art would understand that the receiving device 30R can be arranged to allow a user to manually unfold and pack up the receiving device 30R. The receiving device 30R can also be arranged to remain open when it is arranged at the supporting leg 11R of the chair. The receiving device 30R can also be arranged to be remained opened when the receiving device 30R is arranged on the supporting leg 11R of the chair. When the seat back 20R and/or the seat base 10R of the chair is folded, the receiving device 30R will be folded and retracted as well.

Figure 30A:
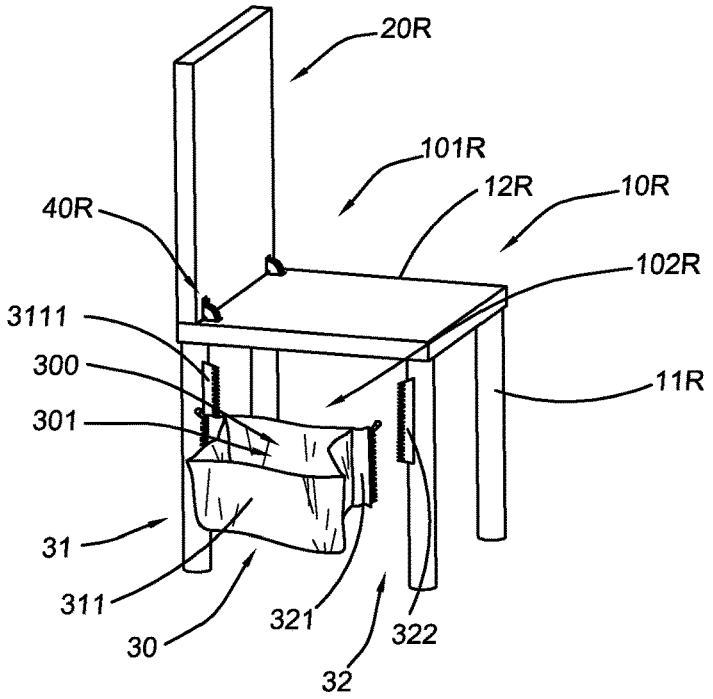
FIG. 30A is a perspective view of the chair according to a sixth preferred embodiment of the present invention, illustrating the receiving device of the chair being arranged on the supporter of the chair.

As shown in FIG. 30A, the receiving device 30R of the chair according to a sixth preferred embodiment of the present invention comprises a receiving body 31R and at least one connecting element 32R. The receiving body 31R forms the receiving cavity 300R. The connecting element 32R is respectively arranged on the receiving body 31R and the supporting leg 11R of the chair.

It is understandable that the receiving body 31R of the receiving device 30R or the main structure of the receiving device 30R is made of soft material, so that when the receiving device 30R is arranged on the supporting leg 11R, the receiving body 31R of the receiving device 30R will not affect the folding of the supporting leg 11R and/or the seat base 10R. Person skilled in the art would understand that the soft material is preferably soft material(s) of cotton, hemp, silk, wool, chemical fiber, etc. The soft material can also be other material suitable for producing the receiving body 31R of the receiving device 30R. Person skilled in the art would understand that the receiving device 30R further comprises a supporting shelf, wherein the receiving body 31R of the receiving device 30R is arranged on the supporting shelf and the supporting shelf is arranged to be able to keep the receiving body 31R in the open state. Preferably, the supporting shelf of the receiving device 30R is a foldable supporting shelf, so that the receiving device 30R can be folded into the folded state.

As shown in FIG. 30A, the receiving device 30R of the chair according to a sixth preferred embodiment of the present invention comprises a receiving body 31R and two connecting elements 32R. The receiving body 31R comprises two side walls 311R. Each of the connecting elements 32R comprises a first connector 321R and a second connector 322R. The two side walls 311R of the receiving body 31R are separately arranged and each side wall 311R has two ends 3111R. The first connectors 321R of the connecting elements 32R are respectively arranged on the two ends 3111R of one side wall 311R of the receiving body 31R. The second connector 322R of one connecting element 32R of the two connecting elements 32R of the receiving device 30R is arranged on one supporting leg 11R of the seat base 10R, and the second connector 322R of another connecting element 32R is arranged on another supporting leg 11R of the seat base 10R. In other words, the receiving device 30R is arranged between two supporting legs 11R of the seat base 10R. Besides, when the receiving device 30R is arranged between the two supporting legs 11R of the seat base 10R because the two connecting elements 32R of the receiving device 30R are both arranged on the same side wall 311R of the receiving body 31R of the receiving device 30R, the two side walls 311R of the receiving body 31R of the receiving device 30R will be kept separated under the influence of gravity, so as to cause the receiving body 31R of the receiving device 30R remained opened.

As shown in FIG. 30A, the second connectors 322R and the first connectors 321R of the connecting elements 32R are arranged to be able to detachably connected together, so that the receiving body 31R of the receiving device 30R can be detached or removed from the supporting legs 11R. As shown in FIG. 30A, the connecting element 32R of the receiving device 30R preferably has a zipper structure, wherein the first connector 321R and the second connector 322R of the connecting element 32R can be zipped together. As shown in FIG. 30A, the first connector of the second connector 322R of each connecting element 32R respectively have a toothed chain 3211R or 3221R, such that the connecting element 32R has a zipper structure and the first connector 321R and the second connector 322R of each connecting element 32R can be zipped together. Hence, the connecting type between the first connector 321R and the second connector 322R of the connecting element 32R of the receiving device 30R is zipping type.

Alternatively, the connecting element 32R of the receiving device 30R has a hanger structure, so that the receiving device 30R can be hung on the supporting leg 11R. In other words, the connecting element 32R can be a hanger, so that the receiving body 31R of the receiving device 30R can be detachably hung on the hanger.

Figure 30B:
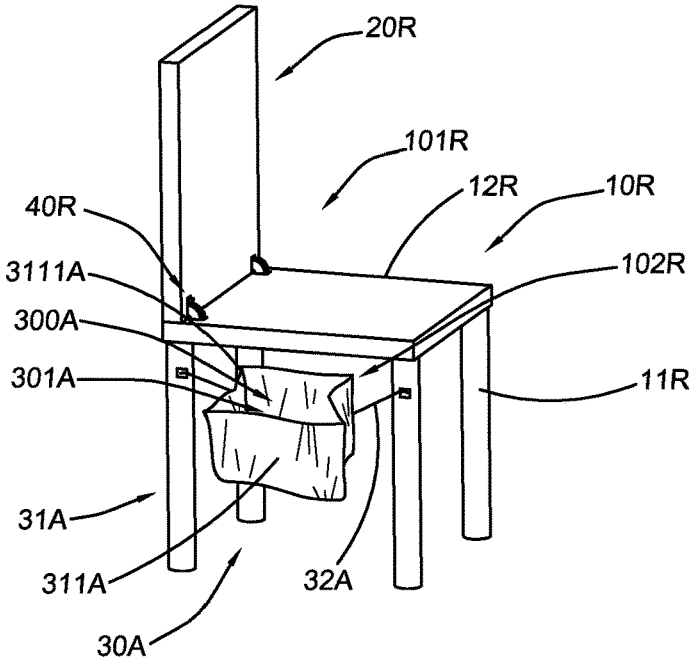
FIG. 30B illustrates an alternative of the receiving device of the chair according to the above sixth preferred embodiment of the present invention.

FIG. 30B of the drawings illustrates an alternative of the receiving device 30R of the chair according to the above sixth preferred embodiment of the present invention. A connecting element 32A of the two connecting elements 32A of the receiving device 30A is respectively arranged on an end portion 3111A of a side wall 311A of the receiving body 31A and a supporting leg 11R of the seat base 10R. Another connecting element 32A is respectively arranged on another end portion 3111A of the side wall 311A of the receiving body 31A and another supporting leg 11R of the seat base 10R. Therefore, the receiving device 30A is arranged between two supporting legs 11R of the seat base. Besides, when the receiving device 30A is arranged between the two supporting legs 11R of the seat base 10R because the two connecting elements 32A of the receiving device 30A are both arranged on the same side wall 311A of the receiving body 31A of the receiving device 30A, the two side walls 311A of the receiving body 31A of the receiving device 30A will be kept separated under the influence of gravity, so as to cause the receiving body 31A of the receiving device 30A remained opened. Preferably, the connecting element 32A of the receiving device 30A has a linear structure, so as to make the connecting element 32A of the receiving device 30A be respectively detachably tied on the two supporting legs 11R of the seat base 10R. Therefore, the connecting type of the connecting element 32A of the receiving device 30A and the supporting leg 11R of the seat base 10R is rope tying type.

Figure 30C:
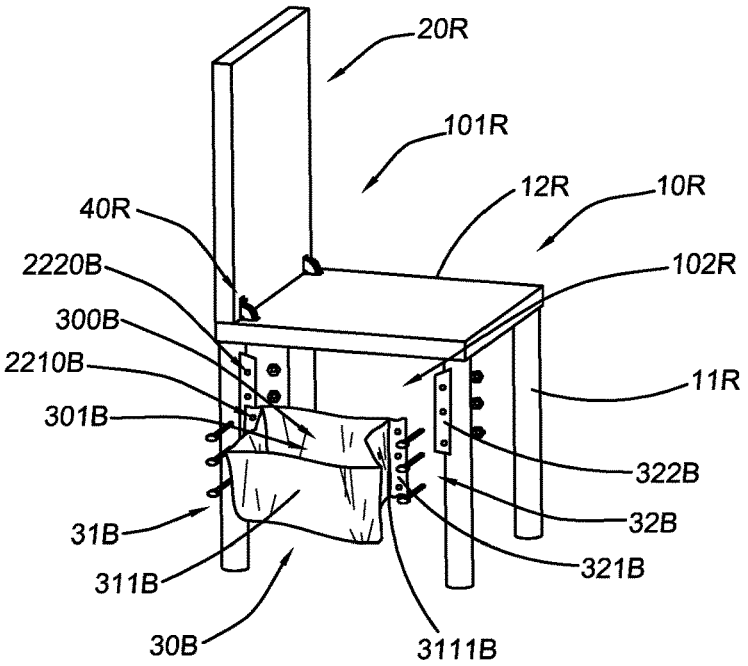
FIG. 30C illustrates another alternative of the receiving device of the chair according to the above sixth preferred embodiment of the present invention.

FIG. 30C of the drawings refers to an alternative of the receiving device 30R of the chair according to the above sixth preferred embodiment of the present invention, wherein the receiving device 30B comprises a receiving body 31B and two connecting elements 32B. The receiving body 31B comprises two side walls 311B. Each of the connecting elements 32B comprises a first connector 321B and a second connector 322B. The two side walls 311B of the receiving body 31B are separately arranged and each side wall 311B has two ends 3111B. The first connectors 321B of the connecting elements 32B are respectively arranged on the two ends 3111B of one side wall 311B of the receiving body 31B. The second connector 322B of one connecting element 32B of the two connecting elements 32B of the receiving device 30B is arranged on one supporting leg 11R of the seat base 10R, and the second connector 322B of another connecting element 32B is arranged on another supporting leg 11R of the seat base 10R. In other words, the receiving device 30B is arranged between two supporting legs 11R of the seat base 10R. Besides, when the receiving device 30B is arranged between the two supporting legs 11R of the seat base 10R because the two connecting elements 32B of the receiving device 30B are both arranged on the same side wall 311B of the receiving body 31B of the receiving device 30B, the two side walls 311B of the receiving body 31B of the receiving device 30B will be kept separated under the influence of gravity, so as to cause the receiving body 31B of the receiving device 30B remained opened.

As shown in FIG. 30C, the second connector 322B and the first connector 321B of the connecting element 32B are arranged to respectively have at least one screw hole 3210B or 3220B, so that the first connector 321B and the second connector 322B can be detachably screwed with each other. Thus, the receiving body 31B of the receiving device 30B can be detached or removed from the supporting leg 11R. As shown in FIG. 30C, the connecting element 32B of the receiving device 30B further comprises at least one screw 323B. The screw 323B can screw the first connector 321B and the second connector 322B through the screw holes 3210B and 3220B thereof. Therefore, the connecting type of the connecting element 32B of the receiving device 30B and the supporting leg 11R of the seat base 10R is screwing connection.

Figure 30D:
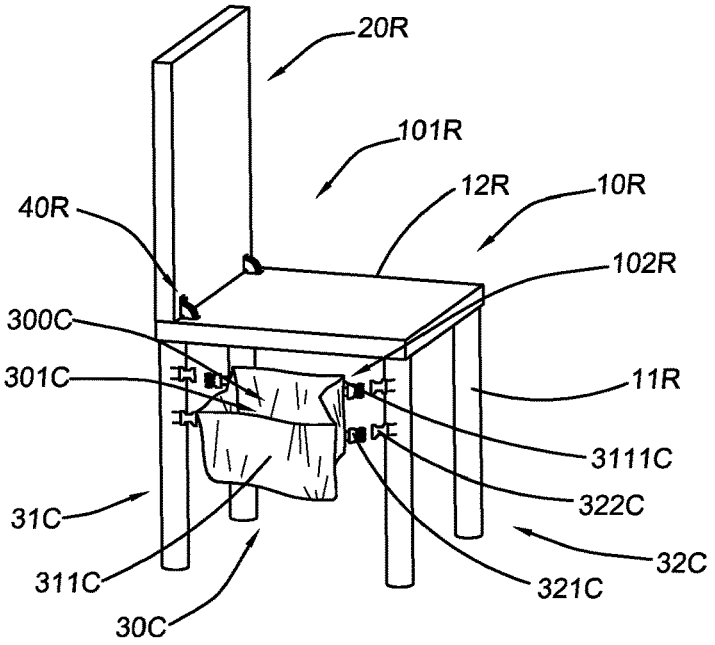
FIG. 30D illustrates another alternative of the receiving device of the chair according to the above sixth preferred embodiment of the present invention.

FIG. 30D of the drawings refers to an alternative of the receiving device 30R of the chair according to the above sixth preferred embodiment of the present invention, wherein the receiving device 30C comprises a receiving body 31C and two connecting elements 32C. The receiving body 31C comprises two side walls 311C. Each of the connecting elements 32C comprises a first connector 321C and a second connector 322C. The two side walls 311C of the receiving body 31C are separately arranged and each side wall 311C has two ends 3111C. The first connectors 321C of the connecting elements 32C are respectively arranged on the two ends 3111C of one side wall 311C of the receiving body 31C. The second connector 322C of one connecting element 32C of the two connecting elements 32C of the receiving device 30C is arranged on one supporting leg 11R of the seat base 10R, and the second connector 322C of another connecting element 32C is arranged on another supporting leg 11R of the seat base 10R. In other words, the receiving device 30C is arranged between two supporting legs 11R of the seat base 10R. Besides, when the receiving device 30C is arranged between the two supporting legs 11R of the seat base 10R because the two connecting elements 32C of the receiving device 30C are both arranged on the same side wall 311C of the receiving body 31C of the receiving device 30C, the two side walls 311C of the receiving body 31C of the receiving device 30C will be kept separated under the influence of gravity, so as to cause the receiving body 31C of the receiving device 30C remained opened.

As shown in FIG. 30D, the second connectors 322C and the first connectors 321C of the connecting elements 32C are arranged to be able to detachably connected together, so that the receiving body 31C of the receiving device 30C can be detached or removed from the supporting legs 11R. As shown in FIG. 30D, the connecting element 32C of the receiving device 30C is a detachable buckle, so as allow the first connector 321C and the second connector 322C of the connecting element 32C to be detachably locked or buckled together. As shown in FIG. 30D, the first connector 321C of the connecting element 32C is arranged to have an engaging end structure of a detachable buckle, wherein the second connector 322C is arranged to have a locking end of a detachable buckle, such that the first connector 321C and the second connector 322C of the connecting element 32C can be locked or buckled together. Alternatively, the first connector 321C of the connecting element 32C is arranged to have a locking end structure of a detachable buckle, wherein the second connector 322C is arranged to have an engaging end of a detachable buckle, such that the first connector 321C and the second connector 322C of the connecting element 32C can be locked or buckled together. Therefore, the connecting type of the connecting element 32C of the receiving device 30C and the supporting leg 11R of the seat base 10R is buckling connection.

Figure 30E:
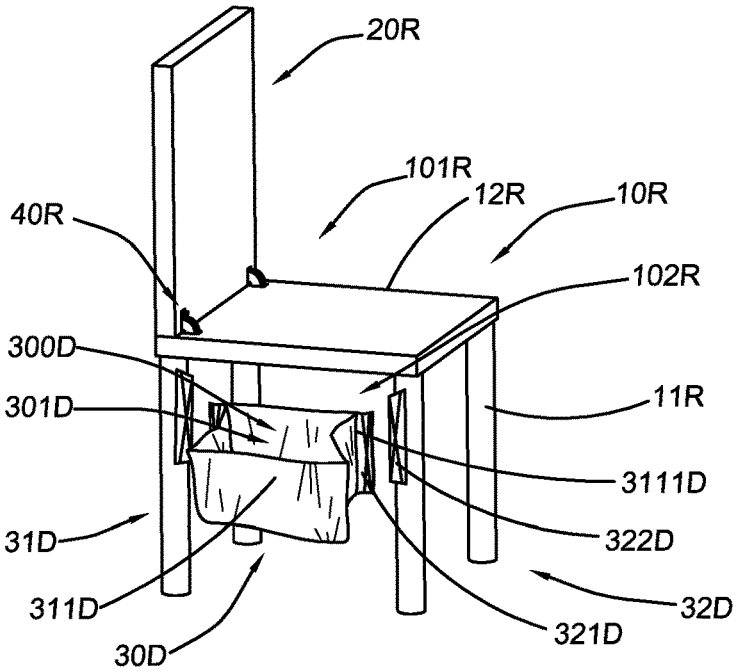
FIG. 30E illustrates another alternative of the receiving device of the chair according to the above sixth preferred embodiment of the present invention.
Figure 30F:
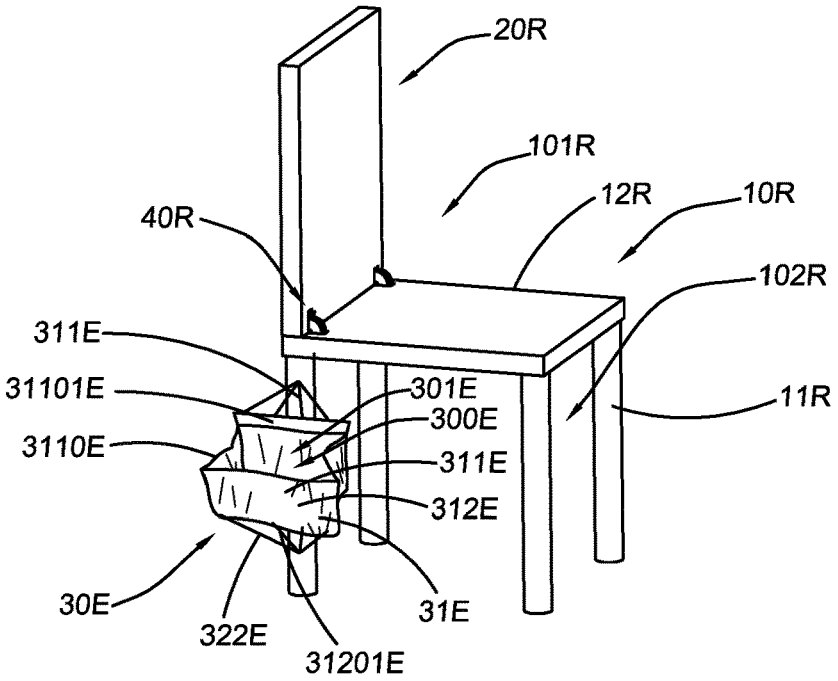
FIG. 30F illustrates another alternative of the receiving device of the chair according to the above sixth preferred embodiment of the present invention.

FIG. 30E of the drawings refers to an alternative of the receiving device 30R of the chair according to the above sixth preferred embodiment of the present invention, wherein the receiving device 30D comprises a receiving body 31D and two connecting elements 32D. The receiving body 31D comprises two side walls 311D. Each of the connecting elements 32D comprises a first connector 321D and a second connector 322D. The two side walls 311D of the receiving body 31D are separately arranged and each side wall 311D has two ends 3111D. The first connectors 321D of the connecting elements 32D are respectively arranged on the two ends 3111D of one side wall 311D of the receiving body 31D. The second connector 322D of one connecting element 32D of the two connecting elements 32D of the receiving device 30D is arranged on one supporting leg 11R of the seat base 10R, and the second connector 322D of another connecting element 32D is arranged on another supporting leg 11R of the seat base 10R. In other words, the receiving device 30D is arranged between two supporting legs 11R of the seat base 10R. Besides, when the receiving device 30D is arranged between the two supporting legs 11R of the seat base 10R because the two connecting elements 32D of the receiving device 30D are both arranged on the same side wall 311D of the receiving body 31D of the receiving device 30D, the two side walls 311D of the receiving body 31D of the receiving device 30D will be kept separated under the influence of gravity, so as to cause the receiving body 31D of the receiving device 30D remained opened.

As shown in FIG. 30E, the second connectors 322D and the first connectors 321D of the connecting elements 32D are arranged to be able to detachably connected together, so that the receiving body 31D of the receiving device 30D can be detached or removed from the supporting legs 11R. As shown in FIG. 30E, the connecting element 32D of the receiving device 30D is a hook and loop fastener or magic tape so as allow the first connector 321D and the second connector 322D of the connecting element 32D to be detachably hook-loop fastened together. As shown in FIG. 30E, the first connector 321D of the connecting element 32D is arranged to have a hook structure of a hook and loop fastener, wherein the second connector 322D is arranged to have a loop structure of a hook and loop fastener, such that the first connector 321D and the second connector 322D of the connecting element 32D can be hook-loop fastened together. Alternatively, the first connector 321D of the connecting element 32D is arranged to have a loop structure of a hook and loop fastener, wherein the second connector 322D is arranged to have a hook structure of a hook and loop fastener, such that the first connector 321D and the second connector 322D of the connecting element 32D can be hook-loop fastened together. Therefore, the connecting type of the connecting elements 32D of the receiving device 30D and the supporting legs 11R of the seat base 10R is hook-loop fastening or bonding type.

FIG. 30F of the drawings illustrate an alternative of the receiving device 30R of the chair according to the above sixth preferred embodiment of the present invention, wherein the receiving body 31E of the receiving device 30E comprises an upper end 311E and a lower end 312E extended downwardly from the upper end 311E. The upper end 311E forms an upper end periphery 3110E, and the lower end 312E forms a lower end periphery 3120E. The upper end periphery 3110E forms a receiving opening 301E. The connecting element 32E comprises at least one first connector 321E and at least one second connector 322E. The first connector 321E is arranged on the upper end periphery 3110E of the upper end 311E of the receiving device 30E and is slantly extended upwardly and inwardly from the upper end periphery 3110E to the supporting leg 11R. The second connector 322E is arranged at the lower end periphery 3120E of the lower end 312E of the receiving device 30E and is slantly extended downwardly and inwardly from the lower end periphery 3120E to the supporting leg 11R. Preferably, the first connector 321E is arranged on an inner side 31101E of the upper end periphery 3110E of the upper end 311E of the receiving device 30E, and the second connector 322E is arranged on an outer side 31201E of the lower end periphery 3120E of the lower end 312E of the receiving device 30E, so as to help to keep the receiving device 30E opened. More preferably, the first connector 321E and the second connector 322E of the connecting element 32E of the receiving device 30E are respectively detachably arranged on the upper end periphery 3110E of the upper end 311E of the receiving body 31E of the receiving device 30E and the lower end periphery 3120E of the lower end 312E of the receiving body 31E of the receiving device 30E. The first connector 321E and the second connector 322E of the connecting element 32E of the receiving device 30E can also be respectively and detachably arranged on the supporting leg 11R. Most preferably, the first connector 321E and the second connector 322E of the connecting element 32E of the receiving device 30E are respectively linear. Alternatively, the first connector 321E and the second connector 322E of the connecting element 32E of the receiving device 30E are respectively band shaped.

As shown in FIG. 30F, each of the supporting legs 11R is arranged on the chair plate 12R of the seat base 10R. The first connector 321E of the connecting element 32E of the receiving device 30E is respectively arranged on the upper end periphery 3110E of the upper end 311E of the receiving device 30E and one supporting leg 11R of the seat base 10R. The second connector 322E is respectively arranged on the lower end periphery 3120E of the lower end 312E of the receiving device 30E and the supporting leg 11R of the seat base 10R.

As shown in FIGS. 30A to 30F, the seat base 10R of the chair according to the above sixth preferred embodiment of the present invention further comprises at least two pivoting portions 40. The two pivoting portions 40 of the seat base 10R are respectively pivotally arranged between the seat back 20R and the seat base 10R, such that the seat back 20R is pivotally arranged on the seat base 10R. Therefore, the seat base 10R can be folded, so as to occupy a smaller space, and be unfolded, so as to allow the user to sit on the chair plate 12R of the seat base 10R.

As shown in FIGS. 30G to 30L of the drawings of the present invention, the chair according to a seventh preferred embodiment of the present invention is illustrated. The chair comprises a seat base 10R made of plastic material, a seat back 20R arranged on the seat base 10R, and at least one receiving device 30F. The seat base 10R has a plurality of supporting legs 11R and a chair plate 12R supported by the supporting legs 11R. The supporting legs 11R are arranged to extend downwardly from the chair plate 12R of the seat base 10R and the supporting legs 11R are arranged to be able to support the chair plate 12R of the seat base 10R and to maintain the chair plate 12R of the seat base 10R in a horizontal condition. The receiving device 30F is arranged between the two supporting legs 11R. In other words, the supporting legs 11R support the chair plate 12R of the seat base 10R, so as to keep the chair plate 12R of the seat base 10R horizontal, so that objects can be stably placed on the chair plate 12R of the seat base 10R. Preferably, the chair plate 12R of the seat base 10R is flat. Person skilled in the art would understand that the chair plate 12R of the seat base 10R can be made by blow molding or injection molding. Preferably, the chair plate 12R of the seat base 10R is formed through blow molding. Preferably, the seat back 20R is pivotally arranged on the seat base 10R.

Figure 30G:
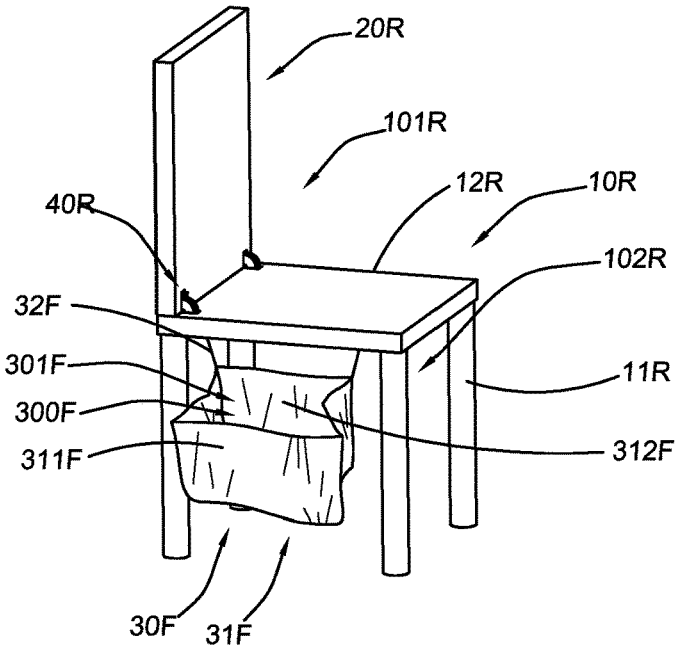
FIG. 30G illustrates a perspective view of the chair according to a seventh preferred embodiment of the present invention.

As shown in FIG. 30G, the seat base 10R of the chair according to a seventh preferred embodiment of the present invention, forms an upper space 101R and a lower space 102R. The upper space 101R is formed above the chair plate 12R of the seat base 10R, and the lower space 102R is formed below the chair plate 12R of the seat base 10R. The receiving device 30F is arranged in the lower space 102R. Person skilled in the art would understand that the receiving device 30F can be any structure that can be arranged on the chair plate 12R of the seat base 10R of the chair for receiving objects. Hence, the receiving device 30F herein comprises all mechanisms that were known by person skilled in the art that can be arranged on the chair plate 12R of the seat base 10R of the chair and can accommodate objects therein. Preferably, the receiving device 30F is detachably arranged on the chair plate 12R of the seat base 10R of the chair. More preferably, the receiving device 30F is solely and suspendingly arranged on the chair plate 12R of the seat base 10R. In other words, the receiving device 30F has an absolute structure that can be arranged on the chair plate 12R of the seat base 10R, so as to be solely and suspendingly arranged on the chair plate 12R of the seat base 10R. Therefore, when the receiving device 30F or a receiving body 31F of the receiving device 30F is removed or detached from the chair plate 12R of the seat base 10R, it will not affect the overall aesthetic of the chair.

Person skilled in the art can understand that the receiving body 31F of the receiving device 30F or the main structure of the receiving device 30F is made of soft material. Person skilled in the art would understand that the soft material is preferably soft material(s) of cotton, hemp, silk, wool, chemical fiber, etc. The soft material can also be other material suitable for producing the receiving body 31F of the receiving device 30F. Person skilled in the art would understand that the receiving device 30F further comprises a supporting shelf, wherein the receiving body 31F of the receiving device 30F is arranged on the supporting shelf and the supporting shelf is arranged to be able to keep the receiving body 31F in the open state. Preferably, the supporting shelf of the receiving device 30F is a foldable supporting shelf, so that the receiving device 30F can be folded into the folded state.

As shown in FIG. 30G, the receiving device 30F of the chair according to a seventh preferred embodiment of the present invention comprises a receiving body 31F and at least one connecting element 32F. The receiving body 31F forms the receiving cavity 300F. The connecting element 32F is respectively arranged on the receiving body 31F and the chair plate 12R of the seat base 10R of the chair. As shown in FIG. 30G, the receiving body 31F comprises an inner wall 312F and an outer wall 311F. Each connecting element 32F of the receiving device 30F is respectively arranged on the inner wall 312F of the receiving body 31F and the chair plate 12R of the seat base 10R. As shown in FIG. 30G, the two side walls 311F and 312F of the receiving body 31F are separately arranged, so when the two connecting elements 32F of the receiving device 30F are both arranged on the inner wall 312F of the receiving body 31F of the receiving device 30F, the two side walls 311F and 312F of the receiving body 31F of the receiving device 30F will be kept separated under the influence of gravity, so as to cause the receiving body 31F of the receiving device 30F remained opened to have the receiving body 31F form a receiving opening 301F facing outwardly. Preferably, the connecting element 32F of the receiving device 30F has a linear structure, so as to make the connecting element 32F of the receiving device 30F be respectively detachably tied on the chair plate 12R of the seat base 10R. Alternatively, the connecting element 32F of the receiving device 30F is band shaped. Therefore, the connecting type of the connecting element 32F of the receiving device 30F and the chair plate 12R of the seat base 10R is rope tying type or belt tying type.

Figure 30H:
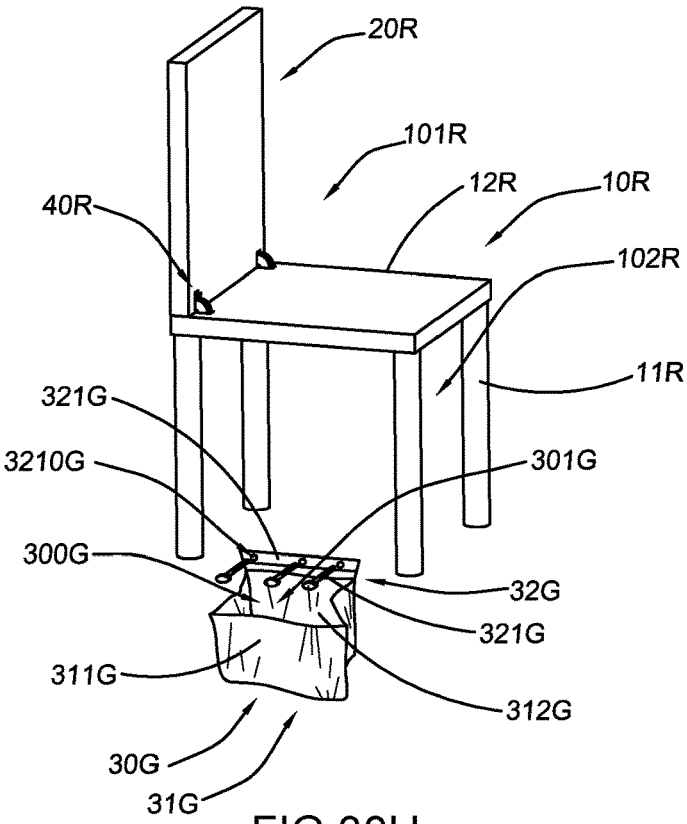
FIG. 30H illustrates an alternative of the receiving device of the chair according to the above seventh preferred embodiment of the present invention.

FIG. 30H of the drawings illustrates an alternative of the receiving device 30F of the chair according to the above seventh preferred embodiment of the present invention. The receiving device 30G comprises a receiving body 31G and a connecting element 32G. The receiving body 31G forms the receiving cavity 300G. The connecting element 32F is respectively arranged on the receiving body 31F and the chair plate 12R of the seat base 10R of the chair. As shown in FIG. 30H, the receiving body 31G comprises an inner wall 312G and an outer wall 311G. The connecting element 32G of the receiving device 30G is respectively arranged on the inner wall 312G of the receiving body 31G and the chair plate 12R of the seat base 10R. As shown in FIG. 30H, the two side walls 311G and 312G of the receiving body 31F are separately arranged, so when the two connecting elements 32G of the receiving device 30G are both arranged on the inner wall 312G of the receiving body 31G of the receiving device 30G, the two side walls 311G and 312G of the receiving body 31G of the receiving device 30G will be kept separated under the influence of gravity, so as to cause the receiving body 31G of the receiving device 30G remained opened to have the receiving body 31G form a receiving opening 301G facing outwardly.

As shown in FIG. 30H, the connecting element 32G of the receiving body 31G further comprises a connecting body 321G extended from the inner wall 312G and a plurality of screwing units 322G. The connecting body 321G has a plurality of screw holes 3210G. The screwing units 322G fix the connecting body 321G of the connecting element 32G on the chair plate 12R of the seat base 10R through the screw holes 3210G. As shown in FIG. 30H, the screwing units 322G of the connecting element 32G of the receiving device 30G are screws. The screws 322G can be screwed at the chair plate 12R through the screw holes 3210G. Therefore, the connecting type of the connecting element 32G of the receiving device 30G and the chair plate 12R of the seat base 10R is screwing connection.

Figure 30I:
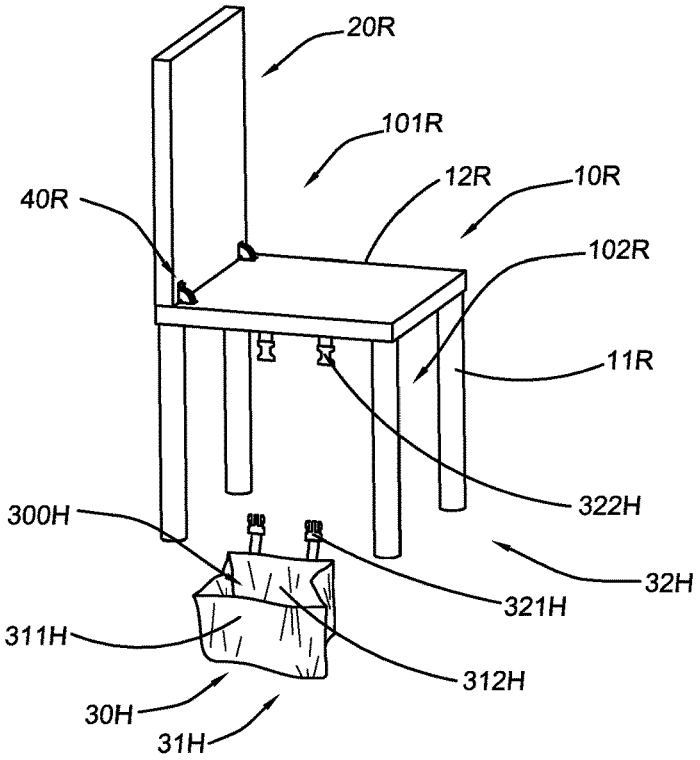
FIG. 30I illustrates another alternative of the receiving device of the chair according to the above seventh preferred embodiment of the present invention.

FIG. 30I of the drawings illustrates another alternative of the receiving device 30F of the chair according to the above seventh preferred embodiment of the present invention, wherein the receiving device 30H comprises a receiving body 31H and two connecting elements 32H. The receiving body 31H comprises an outer wall 311H and an inner wall 312H. Each connecting element 32H comprises a first connector 321H and a second connector 322H. The two side walls 311H and 312H of the receiving body 31H are separately arranged. The first connectors 321H of the connecting elements 32H are respectively arranged on the inner wall 312H of the receiving body 31H. The second connectors 322H are respectively arranged on the chair plate 12R of the seat base 10R. Besides, when the receiving device 30H is arranged on the chair plate 12R of the seat base 10R because the two connecting elements 32H of the receiving device 30H are both arranged on the same inner wall 312H of the receiving body 31H of the receiving device 30H, the two side walls 311H and 312H of the receiving body 31H of the receiving device 30H will be kept separated under the influence of gravity, so as to cause the receiving body 31H of the receiving device 30H remained opened to form a receiving opening 301H facing outwardly.

As shown in FIG. 30I, the connecting element 32H of the receiving device 30H is a detachable buckle, so as allow the first connector 321H and the second connector 322H of the connecting element 32H to be detachably locked or buckled together. As shown in FIG. 30I, the first connector 321H of the connecting element 32H is arranged to have an engaging end structure of a detachable buckle, wherein the second connector 322H is arranged to have a locking end of a detachable buckle, such that the first connector 321H and the second connector 322H of the connecting element 32H can be locked or buckled together. Alternatively, the first connector 321H of the connecting element 32H is arranged to have a locking end structure of a detachable buckle, wherein the second connector 322H is arranged to have an engaging end of a detachable buckle, such that the first connector 321H and the second connector 322H of the connecting element 32H can be locked or buckled together. Hence, the connecting type between the first connector 321H and the second connector 322H of the connecting element 32H of the receiving device 30H is buckling type.

Figure 30J:
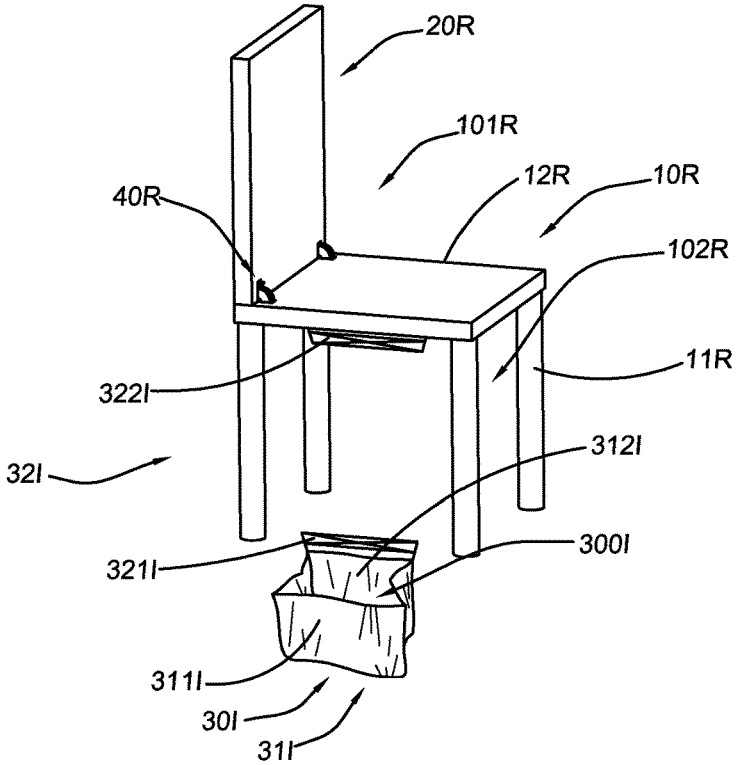
FIG. 30J illustrates another alternative of the receiving device of the chair according to the above seventh preferred embodiment of the present invention.

FIG. 30J of the drawings refers to an alternative of the receiving device 30R of the chair according to the above seventh preferred embodiment of the present invention, wherein the receiving device 30I comprises a receiving body 31I and at least one connecting elements 32I. The receiving body 31I comprises an outer wall 311I and an inner wall 312I. Each connecting element 32I comprises a first connector 321I and a second connector 322I. The two side walls 311I and 312I of the receiving body 31I are separately arranged. The first connectors 321I of the connecting elements 32I are respectively arranged on the inner wall 312I of the receiving body 31I. The second connectors 322I are respectively arranged on the chair plate 12R of the seat base 10R. Besides, when the receiving device 30I is arranged on the chair plate 12R of the seat base 10R because the two connecting elements 32I of the receiving device 30I are both arranged on the same inner wall 312I of the receiving body 31I of the receiving device 30I, the two side walls 311I and 312I of the receiving body 31I of the receiving device 30I will be kept separated under the influence of gravity, so as to cause the receiving body 31I of the receiving device 30I remained opened to form a receiving opening 301I facing outwardly.

As shown in FIG. 30J, the second connector 322I and the first connector 321I of the connecting element 32I are arranged to be able to detachably connected together, so that the receiving body 31I of the receiving device 30I can be detached or removed from the supporter 30. As shown in FIG. 30J, the connecting element 32I of the receiving device 30I is a hook and loop fastener or magic tape so as allow the first connector 321I and the second connector 322I of the connecting element 32I to be detachably hook-loop fastened together. As shown in FIG. 30J, the first connector 321I of the connecting element 32I is arranged to have a hook structure of a hook and loop fastener, wherein the second connector 322I is arranged to have a loop structure of a hook and loop fastener, such that the first connector 321I and the second connector 322I of the connecting element 32I can be hook-loop fastened together. Alternatively, the first connector 321I of the connecting element 32I is arranged to have a loop structure of a hook and loop fastener, wherein the second connector 322I is arranged to have a hook structure of a hook and loop fastener, such that the first connector 321I and the second connector 322I of the connecting element 32I can be hook-loop fastened together. Hence, the connecting type between the first connector 321I and the second connector 322I of the connecting element 32I of the receiving device 30I is hook-loop fastening or bonding type.

Figure 30K:
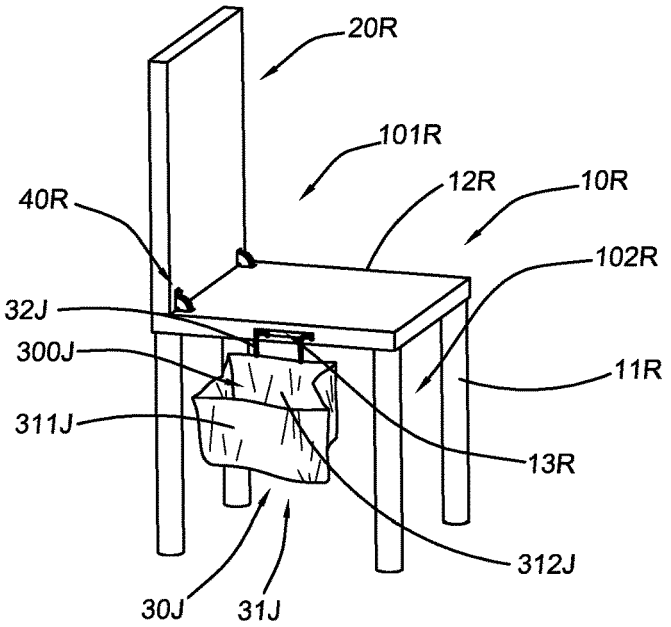
FIG. 30K illustrates another alternative of the receiving device of the chair according to the above seventh preferred embodiment of the present invention.

FIG. 30K of the drawings illustrates an alternative of the receiving device 30R of the chair according to the above seventh preferred embodiment of the present invention. The connecting element 32J of the receiving device 30J has a hanger structure. The connecting element 32J is arranged on the chair plate 12R of the seat base 10R, such that the receiving device 30J is hung on the hanger. In other words, the connecting element 32J can be a hanger, so that the receiving body 31J of the receiving device 30J can be detachably hung on the hanger.

Figure 30L:
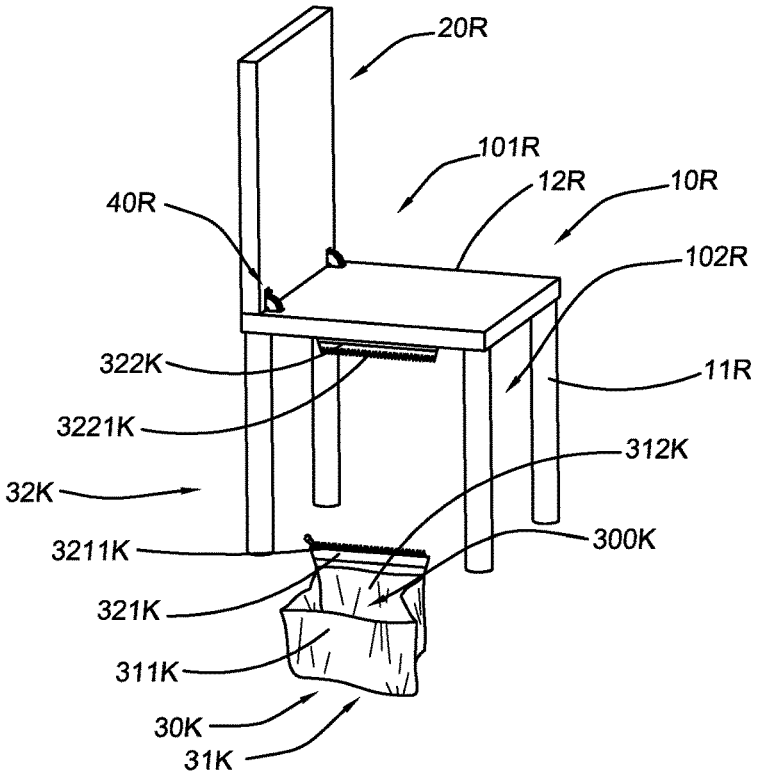
FIG. 30L illustrates another alternative of the receiving device of the chair according to the above seventh preferred embodiment of the present invention.
Figure 30M:
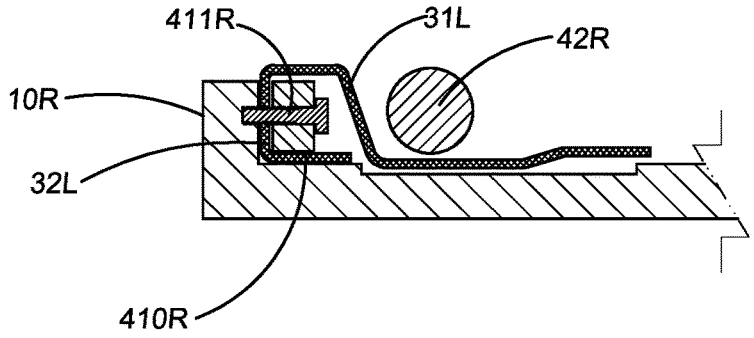
FIG. 30M illustrates a sectional view of the chair according to the above seventh preferred embodiment of the present invention.

FIG. 30L of the drawings illustrates an alternative of the receiving device 30R of the chair according to the above seventh preferred embodiment of the present invention. The connecting element 32K of the receiving device 30K preferably has a zipper structure, wherein the first connector 321K and the second connector 322K of the connecting element 32K can be zipped together. As shown in FIG. 30L, the first connector of the second connector 322K of the connecting element 32K have a toothed chain 3211K or 3221K, such that the connecting element 32K has a zipper structure and the first connector 321K and the second connector 322K of the connecting element 32K can be zipped together. Hence, the connecting type between the first connector 321K and the second connector 322K of the connecting element 32K of the receiving device 30K is zipping type.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A table, comprising:

a table top made of plastic material, wherein said table top has a flat table surface and a bottom surface;

a mounting portion made of plastic material, wherein said mounting portion and said table top are integrated with each other;

at least one receiving device arranged at said mounting portion, wherein said receiving device has a receiving cavity; and a supporter adapted for supporting said table top and keeping said table surface of said table top in a horizontal condition, wherein said supporter is arranged at said bottom surface of said table top, wherein said supporter comprises a supporting tame and at least one supporting leg, wherein said supporting leg is arranged on said supporting frame, wherein said supporting frame of said supporter comprises two transverse members separately arranged on said bottom surface of said table top and two longitudinal members separately arranged between said two transverse members, wherein each said longitudinal member is pivotally arranged between said supporting frame and two said transverse members, wherein said supporting leg of said supporter is respectively arranged on said two longitudinal members of said supporting frame so that each of said supporting legs is capable of moving pivotally with respect to said table top, wherein said supporter further comprises two lockers, respectively arranged on said two transverse members of said supporting frame, wherein each said transverse member of said supporting frame comprises two supporting elements, wherein said locker is arranged between said two supporting elements of said transverse member, wherein said locker is arranged to have a locked state and a unlocked state, wherein when said locker is in said locked state, said locker prevents said two supporting elements of said transverse member to pivot with respect to each other, and when said locker is in said unlocked state, said locker allows said two supporting elements of said transverse member to freely pivot with respect to each other, wherein said locker comprises a first locking unit, a second locking unit, a holder, an operating portion, and a locking member, wherein said first locking unit has a first mounting groove and a locking groove, wherein said two locking units have a second mounting groove and a first guiding groove, wherein said operating portion has a curvingly extended second guiding groove, wherein said second locking unit is arranged at said first mounting groove of said first locking unit, wherein said operating portion is pivotally arranged at said second mounting groove of said second locking unit, wherein said holder is arranged at said second mounting groove and extended to said locking member, wherein said first guiding groove, said second guiding groove of said operating portion, and said locking groove are coincided, so as to allow said locking member to penetrate said first guiding groove, said second guiding groove of said operating portion, and said locking groove, wherein said holder is allowed to keep said locking member in said locking groove.

2. The table, as recited in claim 1, wherein said holder of said locker comprises a fixing end and a retaining end extended from said fixing end, wherein said retaining end is arranged at said locking member of said locker and is allowed to hold said locking member at a proper position, such that when said transverse member of said supporting frame is kept unfolded, said locking member will still be kept at said second guiding groove of said operating portion.

3. A foldable furniture, comprising:

two panel units pivotally connected with each other to pivotally move between an unfolded position and a folded position, wherein at said unfolded position, said panel units are pivotally moved away from each other that at least one of said panel units is retained at a horizontal condition to define a top surface and a bottom surface thereat, wherein at said folded position, said panel units are pivotally moved to overlap with each other; and a receiving device, which is made of soft material, being hung down from said bottom surface of said panel unit along a side thereof when said panel units are moved at said unfolded position, wherein said receiving device has a receiving cavity and a receiving opening communicating with said receiving cavity adapted for allowing an object be placed into said receiving cavity through said receiving opening, wherein said receiving device is received and hidden between said panel units when said panel units are folded at said folded position.

4. The foldable furniture, as recited in claim 3, wherein said receiving device is detachably coupled at said bottom side of said panel unit.

5. The foldable furniture, as recited in claim 3, further comprising a plurality of supporting legs downwardly and foldably extended from said bottom surface of said panel unit, wherein said receiving device is detachably coupled between said supporting legs to hang below said bottom side of said panel unit.

6. The foldable furniture, as recited in claim 3, wherein said panel units are two table panels being pivotally unfolded to form a tabletop, wherein said receiving cavity is hung downwardly at a bottom surface of said tabletop.

7. The foldable furniture, as recited in claim 6, wherein at least one of said panel units is made of plastic.

8. The foldable furniture, as recited in claim 3, wherein said panel units are two bed panels pivotally unfolded to form a bed, wherein said receiving cavity is hung downwardly at a bottom surface of said bed.

9. The foldable furniture, as recited in claim 8, wherein at least one of said panel units is made of plastic.

10. The foldable furniture, as recited in claim 3, wherein at least one of said panel units is made of plastic.

* * * * *